US012037162B1

(12) United States Patent
Kick

(10) Patent No.: US 12,037,162 B1
(45) Date of Patent: Jul. 16, 2024

(54) CONTAINER APPARATUS

(71) Applicant: Merrilee Kick, Plano, TX (US)

(72) Inventor: Merrilee Kick, Plano, TX (US)

(73) Assignee: BUZZBALLZ, LLC, Carrollton, TX (US)

( * ) Notice: Subject to any disclaimer, the term of this patent is extended or adjusted under 35 U.S.C. 154(b) by 0 days.

(21) Appl. No.: 18/613,870

(22) Filed: Mar. 22, 2024

Related U.S. Application Data

(63) Continuation of application No. 18/450,668, filed on Aug. 16, 2023, now Pat. No. 11,975,889, which is a continuation-in-part of application No. 17/465,262, filed on Sep. 2, 2021, now Pat. No. 11,738,903.

(51) Int. Cl.

| | |
|---|---|
| ***B65D 21/02*** | (2006.01) |
| ***B65D 43/02*** | (2006.01) |
| ***B65D 55/08*** | (2006.01) |
| ***B65D 55/16*** | (2006.01) |

(52) U.S. Cl.
CPC ..... *B65D 21/0219* (2013.01); *B65D 43/0283* (2013.01); *B65D 55/08* (2013.01); *B65D 55/16* (2013.01); *B65D 2543/00092* (2013.01); *B65D 2543/00537* (2013.01)

(58) Field of Classification Search
CPC .. B65D 21/0222; B65D 41/04; B65D 1/0276; B65D 7/2835; B65D 1/0246
See application file for complete search history.

(56) References Cited

U.S. PATENT DOCUMENTS

| | | | | |
|---|---|---|---|---|
| 925,861 | A | | 6/1909 | Booth |
| D212,525 | S | * | 10/1968 | Kneapler ..... D9/519 |
| 4,140,464 | A | | 2/1979 | Spurr et al. |
| D259,292 | S | | 5/1981 | Conrad |

(Continued)

FOREIGN PATENT DOCUMENTS

| | | |
|---|---|---|
| CR | 20130449 S | 3/2014 |
| EM | 000996939-0001 | 4/2008 |

(Continued)

OTHER PUBLICATIONS

Andrews, A Fishkeeper's Guide to Fancy Goldfishes, Tetra Press No. 16058, 1987, Salamander Books Ltd., Morris Plains, NJ, 4 pages.

(Continued)

*Primary Examiner* — Ernesto A Grano
(74) *Attorney, Agent, or Firm* — HAYNES AND BOONE, LLP

(57) ABSTRACT

Apparatus and method(s) according to which a first container lid is sealingly engaged against a container body. Once so sealingly engaged, the container body is stacked onto a second container lid so that a first three-dimensional profile of the second container lid matingly receives a second three-dimensional profile of the container body, which second three-dimensional profile is located at an end portion of the container body opposite the first container lid. In one or more embodiments, the second container lid is identical to the first container lid. In one or more embodiments, the stackable containers have respective detachable and re-attachable container lids. In one or more embodiments, each container body and its corresponding detachable and re-attachable lid are both made of recyclable plastic.

22 Claims, 35 Drawing Sheets

(56) References Cited

U.S. PATENT DOCUMENTS 5,215,204 A * 6/1993 Beck ..... B65D 55/16 215/258
5,725,115 A * 3/1998 Bosl ..... B65D 55/16 215/258
D400,400 S * 11/1998 Hurst ..... D7/515
5,871,111 A * 2/1999 Pfefferkorn ..... B65D 41/0421 215/354
5,927,499 A * 7/1999 Vesborg ..... B65D 71/06 220/666
6,474,491 B1 * 11/2002 Benoit-Gonin .... B65D 41/3428 220/263
6,574,883 B2 * 6/2003 Giblin ..... D06F 58/203 68/17 R
D487,697 S * 3/2004 Rosen ..... D9/519
D561,043 S * 2/2008 Lepoitevin ..... D9/519
D562,685 S * 2/2008 Millspaw ..... D9/500
D574,240 S * 8/2008 Szczesniak ..... D9/453
D596,489 S * 7/2009 Weiss ..... D9/519
D648,217 S * 11/2011 Fahey ..... D9/519
D650,280 S * 12/2011 de Peyerimhoff ..... D9/519
D663,619 S * 7/2012 Pillet ..... D9/503
D675,102 S * 1/2013 Crowe ..... D9/554
D675,528 S * 2/2013 Beaver ..... D9/551
D699,578 S * 2/2014 Marina ..... D9/519
D701,767 S * 4/2014 Marina ..... D9/500
D703,068 S * 4/2014 Kick ..... D9/776
D704,567 S * 5/2014 Sanders ..... D9/519
8,720,716 B2 * 5/2014 Campbell ..... B65D 41/34 215/253
D710,153 S * 8/2014 Marini ..... D7/901
D711,247 S * 8/2014 Sanders ..... D9/519
D721,585 S * 1/2015 Gonzalez Rodriguez ..... D9/519
D732,978 S * 6/2015 Kick ..... D9/772
D739,259 S * 9/2015 Sanders ..... D9/519
D739,267 S * 9/2015 Kick ..... D9/776
9,278,781 B1 * 3/2016 Boldis ..... B65D 21/0231
D772,722 S * 11/2016 Kick ..... D9/551
9,643,762 B2 * 5/2017 Maguire ..... B65D 41/3447
9,776,779 B2 * 10/2017 Campbell ..... B65D 41/34
D809,391 S * 2/2018 Funk ..... D9/519
D820,106 S * 6/2018 Jasani ..... D9/600
D864,725 S 10/2019 Staab et al.
10,625,914 B2 * 4/2020 Wang ..... C08L 23/04
10,654,625 B2 * 5/2020 Migas ..... B65D 41/3428
10,836,544 B2 * 11/2020 Kim ..... B65D 41/48
11,046,491 B2 * 6/2021 Wang ..... B65D 53/02
D934,688 S * 11/2021 Whittington ..... D9/503
11,332,290 B2 * 5/2022 Maguire ..... B65D 41/04
11,485,550 B2 * 11/2022 Naumann ..... B65D 47/0823
11,713,170 B2 * 8/2023 Mélan-Moutet ... B65D 41/3447 215/252
11,807,436 B2 * 11/2023 Lamoureux ..... B65D 55/16
2008/0245757 A1 * 10/2008 Durand ..... B65D 1/0223 215/47
2010/0133729 A1 6/2010 Shah
2011/0253720 A1 * 10/2011 Kick ..... B65D 1/16 220/608
2012/0018337 A1 * 1/2012 Furey ..... B65D 21/0231 206/520
2013/0240401 A1 * 9/2013 Hall ..... B65D 23/102 220/601
2014/0027336 A1 * 1/2014 Bou Mezrag ..... B65D 21/0231 206/519
2014/0061150 A1 * 3/2014 Park ..... B65D 21/0204 215/44
2014/0061328 A1 * 3/2014 Haymond ..... B65D 43/02 239/6
2015/0251827 A1 * 9/2015 Campbell ..... B65D 55/16 215/258
2015/0344177 A1 * 12/2015 Kick ..... B65D 21/0219 206/505
2019/0168935 A1 * 6/2019 Wang ..... B65D 53/02
2019/0185233 A1 * 6/2019 Wang ..... B65D 55/16
2021/0039840 A1 * 2/2021 Benoit-Gonin .... B65D 41/3447
2022/0017269 A1 * 1/2022 Haas ..... B65D 41/325
2023/0145263 A1 * 5/2023 Lohrman ..... B65D 41/0428 215/235

FOREIGN PATENT DOCUMENTS

EM 001155980-0023 8/2009
EM 001632233-0002 11/2009
JP 05-032248 A 2/1993

OTHER PUBLICATIONS

U.S. Registration No. 549,097, Miscellaneous Juice Bottle Design, File History retrieved May 3, 2024, 96 pages.
General Foam Plastics Corporation Catalog, Pumpkin Buckets, 2005, Norfolk, VA, 23 pages.
DW Staff, McDonald's, Coke Run Afoul of German Law with Ball-Bottle, Published Jun. 2, 2006, Screenshot dated May 6, 2024, Retrieved from www.dw.com.
Staff Writer, Coke Kicks Off World Cup Activity, Published Apr. 24, 2006, Screenshot dated May 6, 2024, Retrieved from www.talkingretail.com.
Football Shaped Diet Coke Bottle on a White Background, Promotional Bottle to Celebrate the 2006 World Cup, May 12, 2006, Screenshot May 6, 2024, Retrieved from www.alamy.com.
Hoffman, Coca Cola 2009 Holiday Ornament Bottles, Published Nov. 30, 2009, Screenshot dated May 6, 2024, Retrieved from thedieline.com.
The JoyServe Store, 16 Oz Plastic Fish Bowl (12 Pack) 4 Inch Heavy Duty Plastic Ivy Bowls, for Candy, Carnival Games, Prizes, Centerpieces, and Party Decoration Supplies, BPA-Free, retrieved from www.amazon.com, 10 pages.

* cited by examiner

CONTAINER APPARATUS

CROSS-REFERENCE TO RELATED APPLICATIONS

This application is a continuation of U.S. patent application Ser. No. 18/450,668, filed Aug. 16, 2023 bearing, which is a continuation-in-part of U.S. patent application Ser. No. 17/465,262, filed Sep. 2, 2021 bearing, the entire disclosures of which are hereby incorporated herein by reference.

This application is related to U.S. Patent Application No. 29/910, 146, filed Aug. 16, 2023 bearing, which is a continuation-in-part of U.S. patent application Ser. No. 29/806, 332 ("the '332 Application"), filed Sep. 2, 2021 bearing, which is a continuation-in-part of U.S. application Ser. No. 29/784,376 (the "'376 Application"), filed May 19, 2021 bearing, which is a continuation of U.S. application Ser. No. 29/771,082 (the "'082 Application"), filed Feb. 19, 2021 bearing, which is a continuation of U.S. application Ser. No. 29/740,976, filed Jul. 8, 2020 bearing, now issued as U.S. Patent No. D911,179, which is a continuation of U.S. application Ser. No. 29/708,953, filed Oct. 10, 2019 bearing, now issued as U.S. Pat. No. D911,843, the entire disclosures of which are hereby incorporated herein by reference; the '376 Application is also a continuation of U.S. application Ser. No. 16/598,443 (the "'443 Application"), filed Oct. 10, 2019 bearing, now issued as U.S. Pat. No. 11,484,152, the entire disclosure of which is hereby incorporated herein by reference; and the '082 Application is also a continuation of the '443 Application.

TECHNICAL FIELD

The present application relates generally to containers, and, more particularly, to a stackable container, the stackable container including a container body and a container lid, at least a portion of which container lid is detachable from, and re-attachable to, the container body. In some embodiments, the container lid includes a security band and a tether.

BRIEF DESCRIPTION OF THE DRAWINGS

FIG. 2C-1 is a front view of a portion of the container body of FIG. 1, according to one or more embodiments.

FIG. 2C-2 is a rear view of the portion of the container body of FIG. 2C-1, according to one or more embodiments.

FIG. 3C-1 is a cross-sectional view of the container lid of FIG. 1 taken along the line 3C-1-3C-1 of FIG. 3B, according to one or more embodiments.

FIG. 3C-2 is a cross-sectional view of the container lid of FIG. 1 taken along the line 3C-2-3C-2 of FIG. 3B, according to one or more embodiments.

FIG. 7C-1 is a cross-sectional view of the container lid of FIG. 6 taken along the line 7C-1-7C-1 of FIG. 7B, according to one or more embodiments.

FIG. 7C-2 is a cross-sectional view of the container lid of FIG. 6 taken along the line 7C-2-7C-2 of FIG. 7B, according to one or more embodiments.

DETAILED DESCRIPTION

Figure 1:
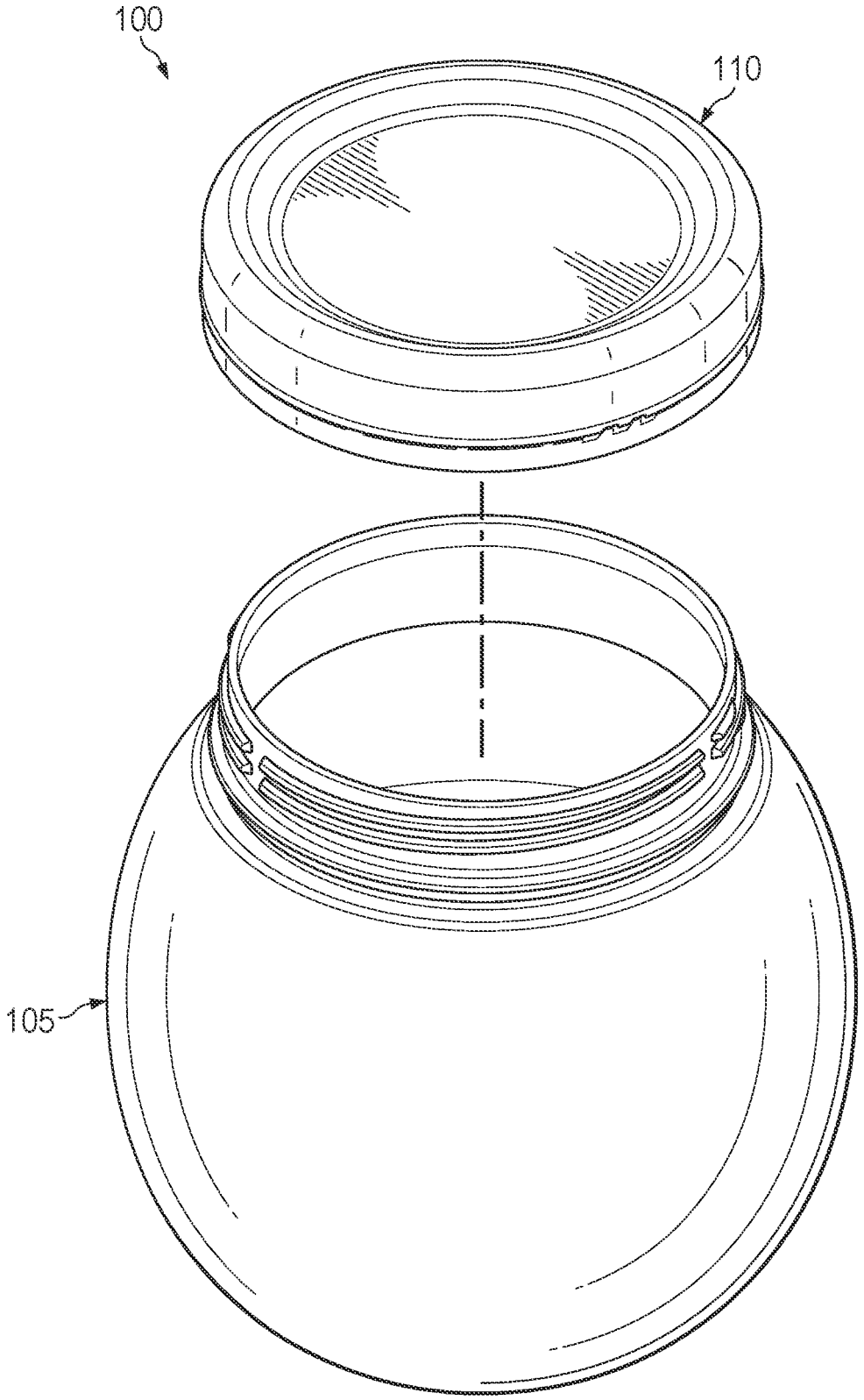
FIG. 1 is a top-front-left perspective view of a first container apparatus in a first operational state or configuration, the first container apparatus including a container body and a container lid, according to one or more embodiments.

Referring to FIG. 1, in an embodiment, a container apparatus is generally referred to by the reference numeral 100. The container apparatus 100 includes a container body 105 and a container lid 110.

Referring to FIGS. 2A through 2F, in an embodiment, the container body 105 extends along a central axis 115 and defines an internal cavity 120. The container body 105 includes a side wall 125, a neck 130, and a bottom wall 135. The side wall 125 is frustospherical or frustospheroidal, that is, in the shape of a truncated sphere or a truncated spheroid (i.e., a sphere-like but not perfectly spherical body). In addition, or instead, the side wall 125 (or a portion thereof) may be or include another curved shape, a cylindrical shape, a tapered shape (e.g., a frustoconical shape), another shape, or a combination thereof. The side wall 125 defines axially opposing end portions 140*a* and 140*b*. In one or more embodiments, the side wall 125 defines a radius of curvature R1 (shown in FIG. 2F), at least at the end portion 140*b*. In addition, or instead, at least a portion of the end portion 140*b* of the side wall 125 may be frustoconical. In combination, the end portion 140*b* of the side wall 125 and the bottom wall 135 of the container body 105 define, and may be referred to herein as, a "three-dimensional profile"; this three-dimensional profile mirrors another three-dimensional profile defined by the container lid 110, as will be described in further detail below. In one or more embodiments, the neck 130 is cylindrical. The neck 130 defines an outer diameter D1, axially opposing end portions 145*a* and 145*b*, and a mouth 150 via which the internal cavity 120 of the container body 105 is accessible. The end portion 145*b* of the neck 130 is connected to the side wall 125 at the end portion 145*a* of the side wall 125. An external collar 155 extends around the neck 130 and outwardly therefrom. External threads 160*a-b* also extend around the neck 130. The external threads 160*a-b* are positioned relatively farther from the side wall 125 than the external collar 155.

Figure 2A:
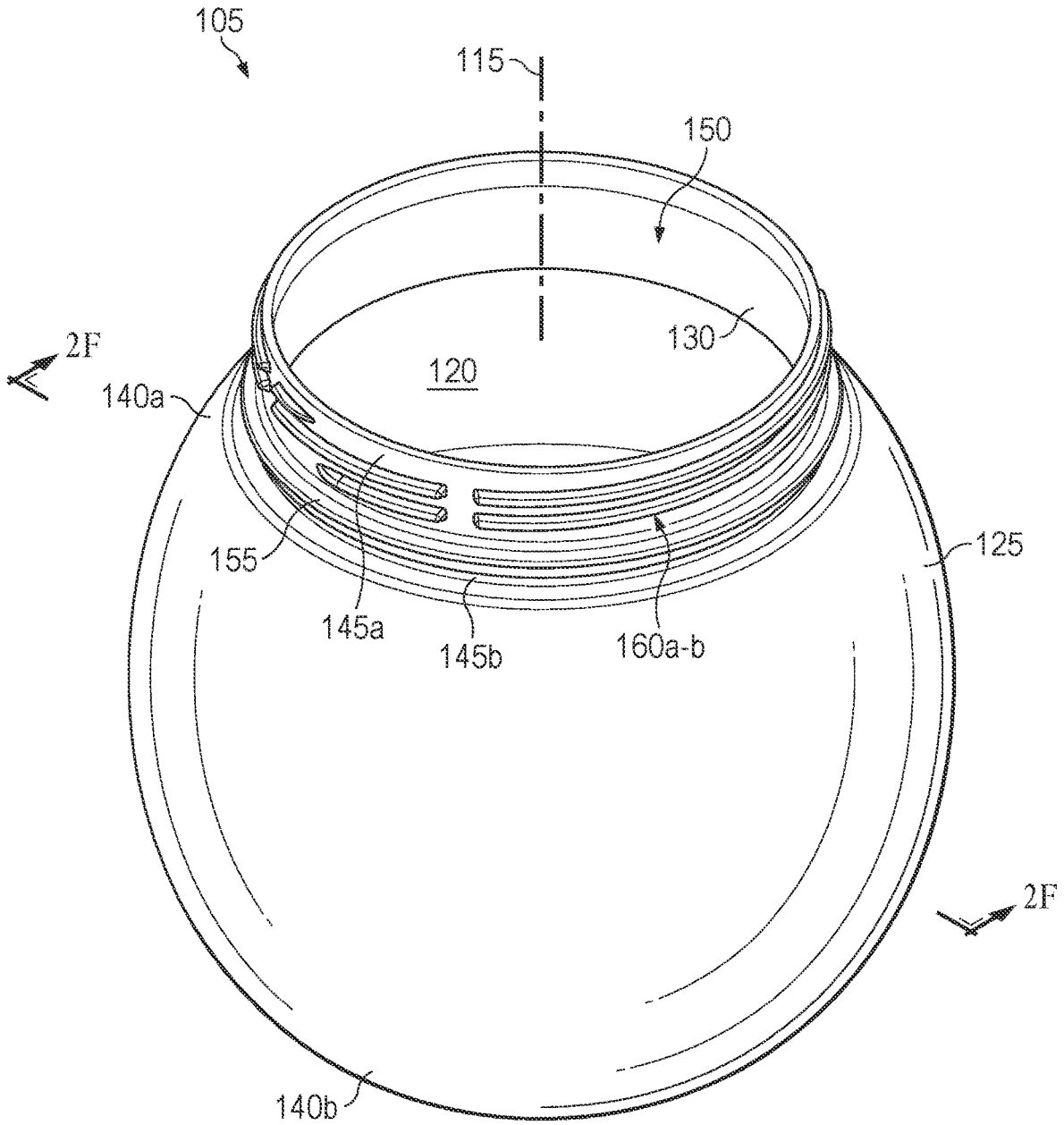
FIG. 2A is a top-front-left perspective view of the container body of FIG. 1, according to one or more embodiments.
Figure 2B:
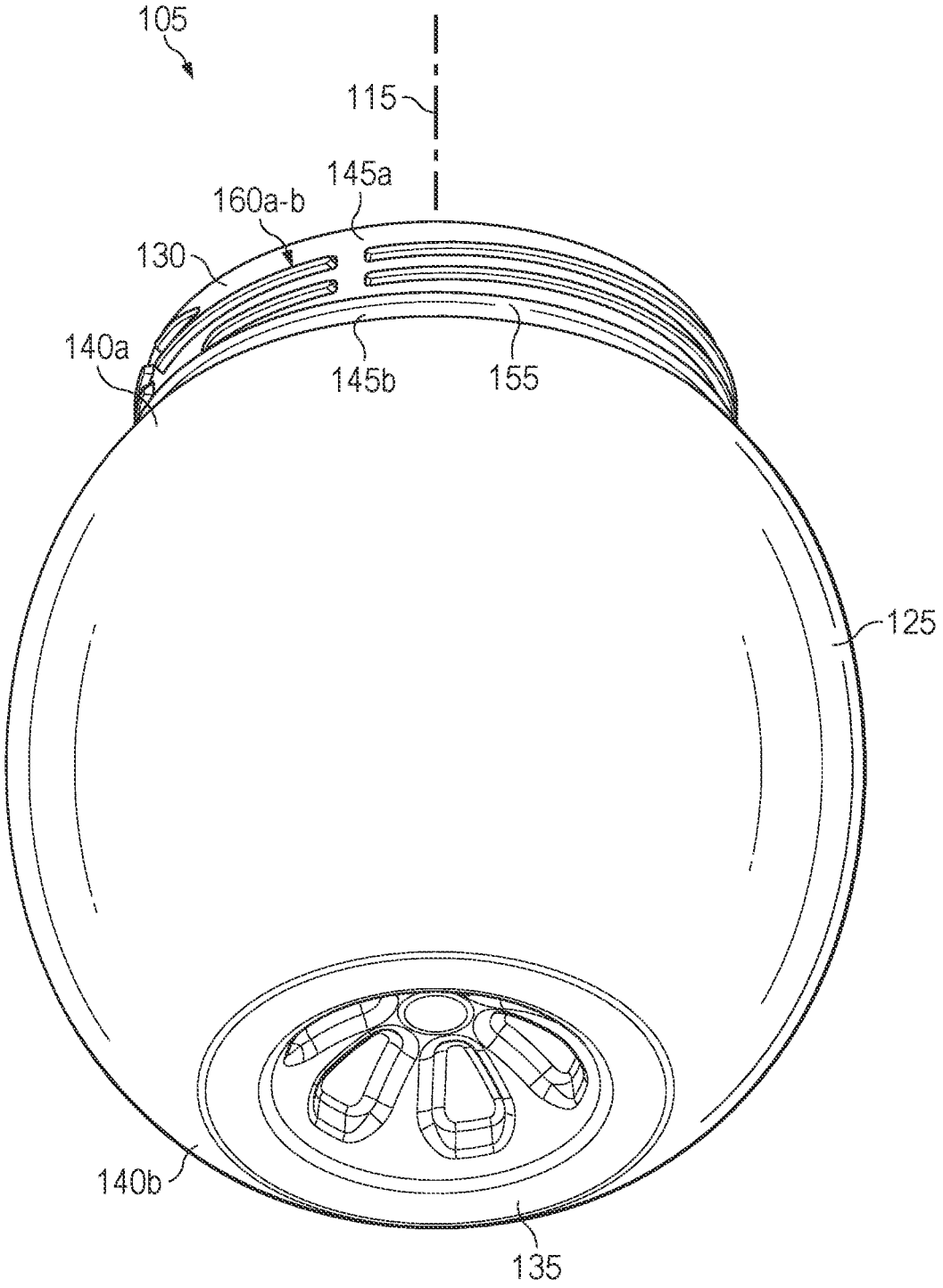
FIG. 2B is a bottom-rear-right perspective view of the container body of FIG. 1, according to one or more embodiments.
Figures 1, 2C:
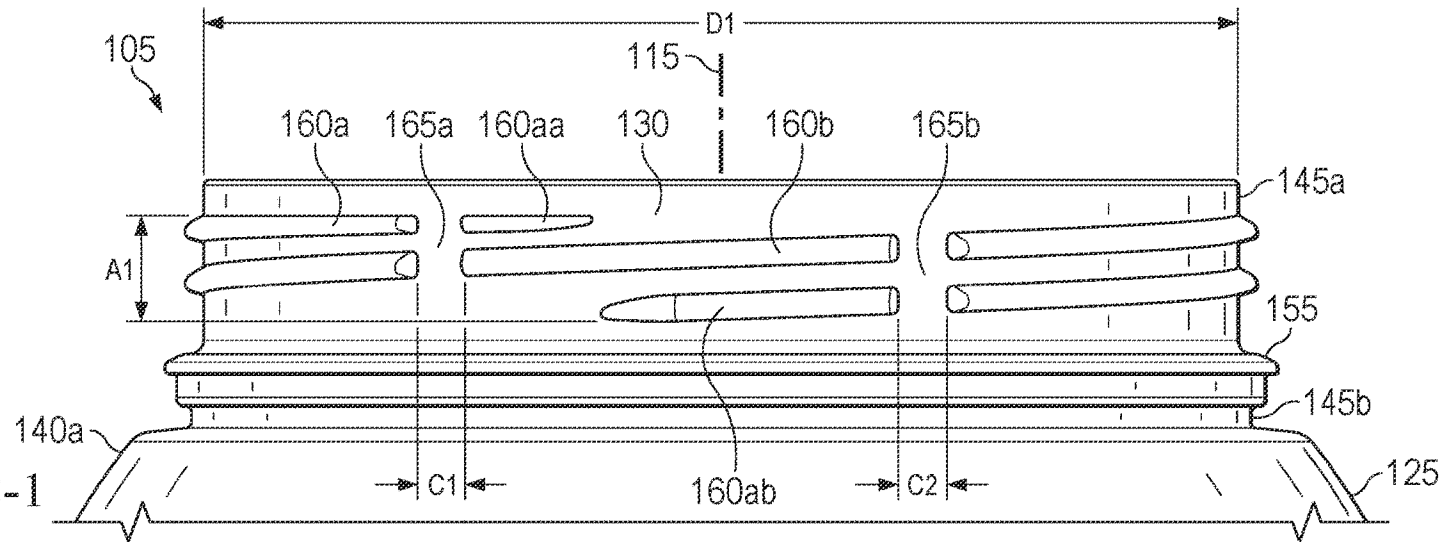

As shown in FIG. 2C-1, the external thread 160*a* defines circumferentially opposing end portions 160*aa* and 160*ab*. The end portions 160*aa* and 160*ab* of the thread 160*a* are each tapered. Moreover, the external thread 160*a* extends spirally around the neck 130, causing the circumferentially opposing end portions 160*aa* and 160*ab* to be axially spaced apart from each other by a gap having an axial dimension A1. The end portion 160*aa* of the thread 160*a* extends relatively closer to the end portion 145*a* of the neck 130 than the end portion 160*ab* of the thread 160*a*, and the end portion 160*ab* of the thread 160*a* extends relatively closer to the end portion 145*b* of the neck 130 than the end portion 160*aa* of the thread 160*a*. The external thread 160*b* extends through the gap between the end portions 160*aa* and 160*ab* of the thread 160*a*.

Figures 2, 2C:
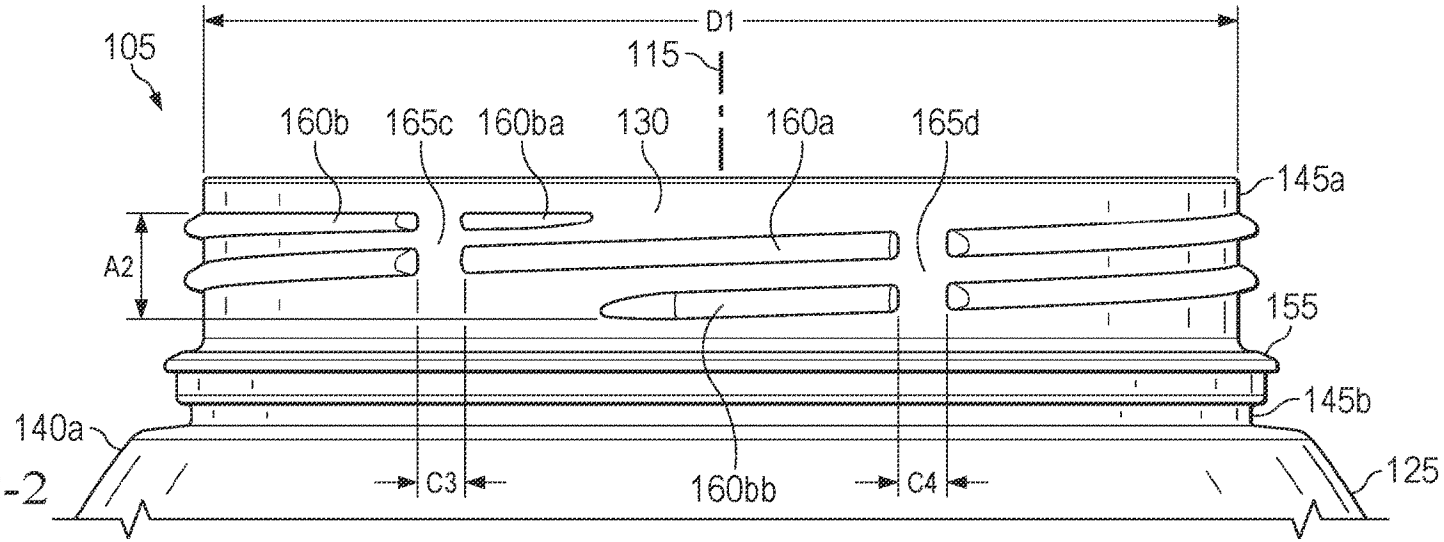

As shown in FIG. 2C-2, the external thread 160*b* defines circumferentially opposing end portions 160*ba* and 160*bb*. The end portions 160*ba* and 160*bb* of the thread 160*b* are each tapered. Moreover, the external thread 160*b* extends spirally around the neck 130, causing the circumferentially opposing end portions 160*ba* and 160*bb* to be axially spaced apart from each other by a gap having an axial dimension A2. In one or more embodiments, the axial dimensions A1 and A2 are the same. The end portion 160*ba* of the thread 160*b* extends relatively closer to the end portion 145*a* of the neck 130 than the end portion 160*bb* of the thread 160*b*, and the end portion 160*bb* of the thread 160*b* extends relatively closer to the end portion 145*b* of the neck 130 than the end portion 160*ba* of the thread 160*b*. The external thread 160*a* extends through the gap between the end portions 160*ba* and 160*bb* of the thread 160*b*.

Figure 2D:
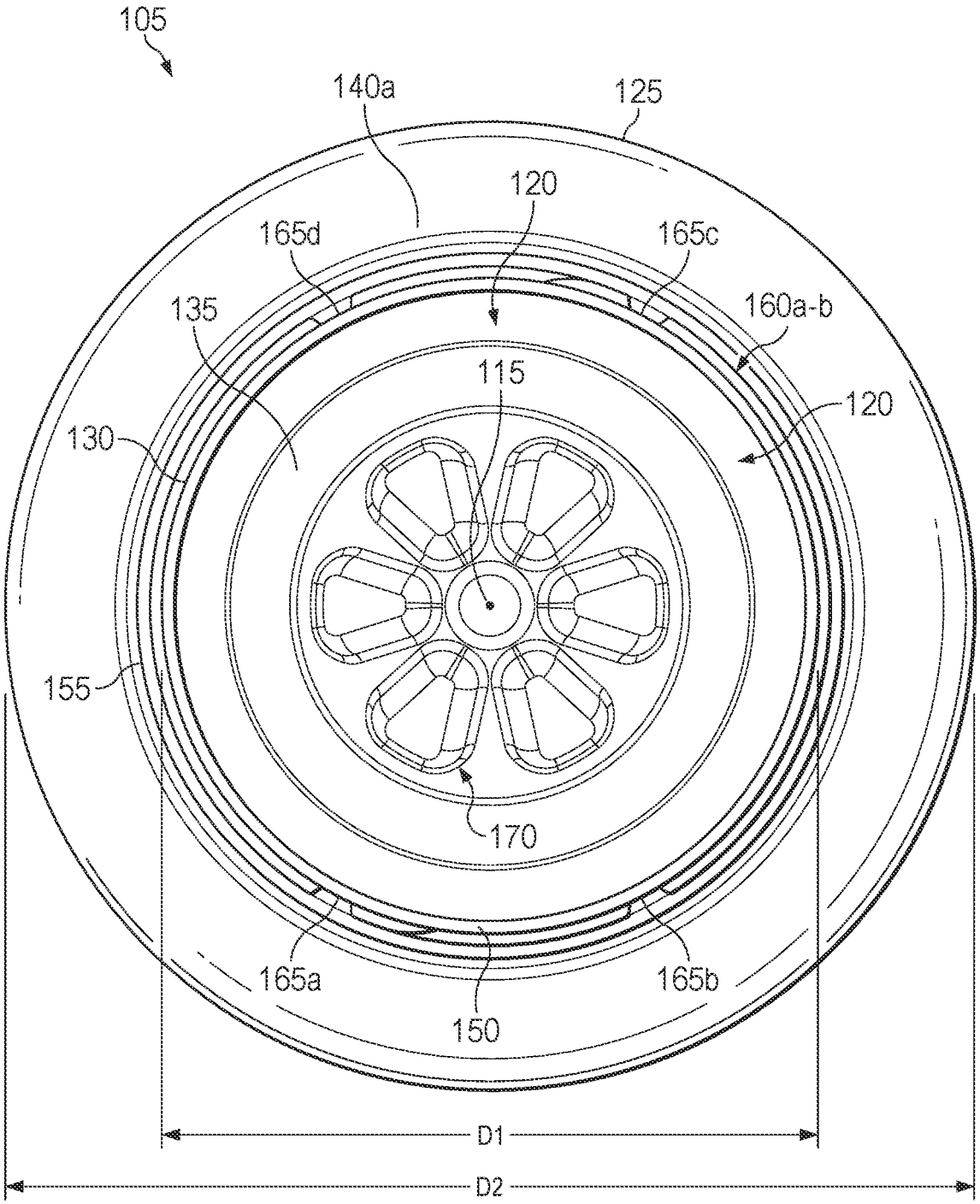
FIG. 2D is a top view of the container body of FIG. 1, according to one or more embodiments.

As shown in FIGS. 2C-1 and 2D, a pair of circumferentially-spaced gaps 165*a-b* are formed axially through the external threads 160*a-b* and exteriorly along the neck 130. More particularly, the gap 165*a* defines a circumferential dimension C1, and is formed exteriorly along the neck 130, and axially through: the end portion 160*aa* of the external thread 160*a*; and a medial portion of the external thread 160*b* between the opposing end portions 160*ba* and 160*bb*. Likewise, the gap 165*b* defines a circumferential dimension C2, and is formed exteriorly along the neck 130 and axially through; a medial portion of the external thread 160*b* between the opposing end portions 160*ba* and 160*bb*; and the end portion 160*ab* of the external thread 160*a*. In one or more embodiments, the circumferential dimensions C1 and C2 are the same.

As shown in FIGS. 2C-2 and 2D, a pair of circumferentially-spaced gaps 165*c-d* are formed axially through the external threads 160*a-b* and exteriorly along the neck 130. More particularly, the gap 165*c* defines a circumferential dimension C3, and is formed exteriorly along the neck 130, and axially through: the end portion 160*ba* of the external thread 160*b*; and a medial portion of the external thread 160*a* between the opposing end portions 160*aa* and 160*ab*. Likewise, the gap 165*d* defines a circumferential dimension C4, and is formed exteriorly along the neck 130 and axially through; a medial portion of the external thread 160*a* between the opposing end portions 160*aa* and 160*ab*; and the end portion 160*bb* of the external thread 160*b*. In one or more embodiments, the circumferential dimensions C3 and C4 are the same. In one or more embodiments, the circumferential dimensions C1, C2, C3, and C4 are the same.

Figure 2E:
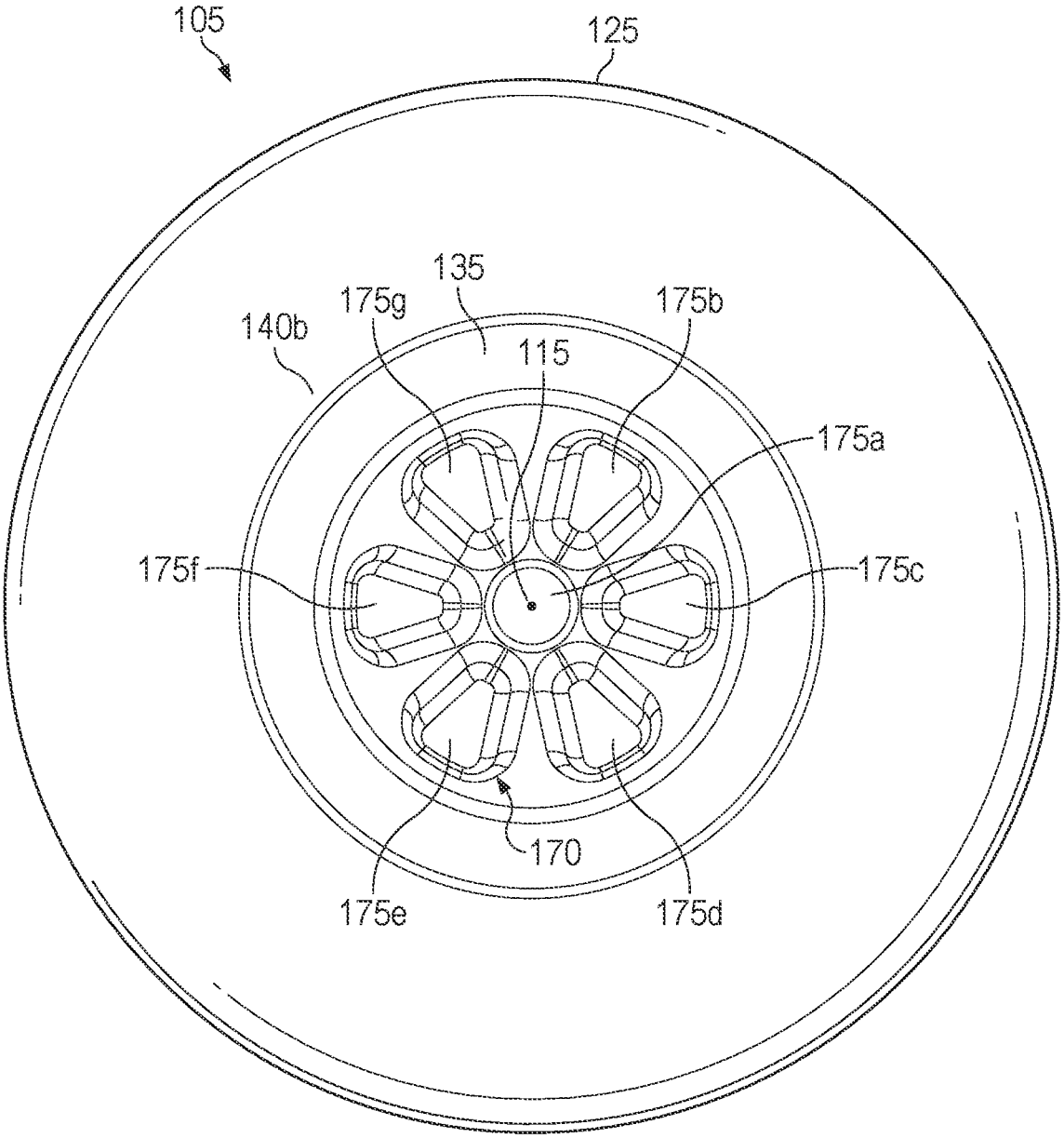
FIG. 2E is a bottom view of the container body of FIG. 1, according to one or more embodiments.

As shown in FIG. 2E, the bottom wall 135 is connected to the side wall 125 at the end portion 140*b* of the side wall 125. An external indentation pattern 170 is formed into the bottom wall 135. The external indentation pattern 170 includes a central indentation 175*a* and petal indentations 175*b-g* distributed (e.g., evenly) around the central indentation 175*a*.

Figure 2F:
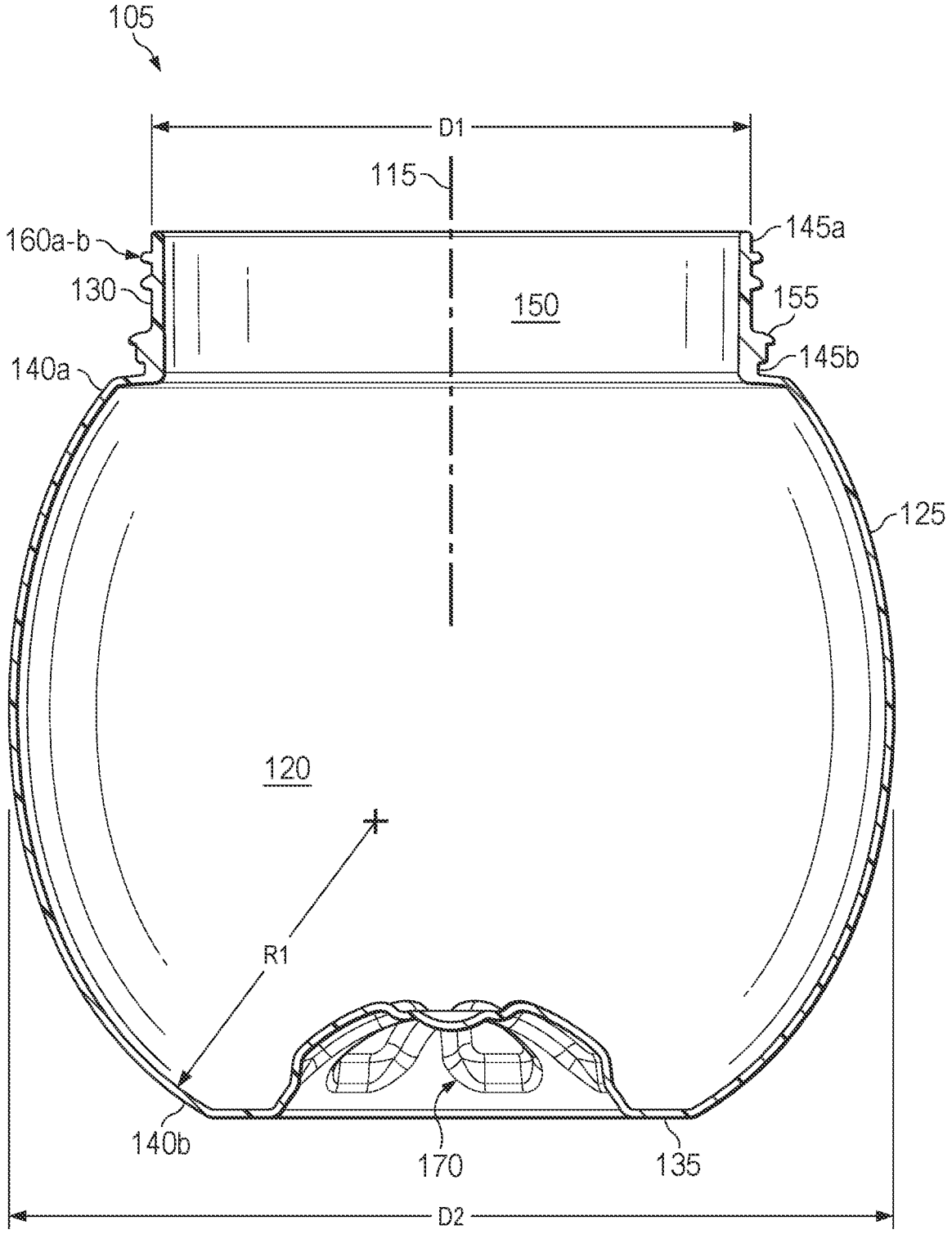
FIG. 2F is a cross-sectional view of the container body of FIG. 1 taken along the line 2F-2F of FIG. 2A, according to one or more embodiments.

As shown in FIGS. 2D and 2F, the side wall 125 of the container body 105 defines a maximum outer diameter D2. In one or more embodiments, the first ratio of the outer diameter D1 of the neck 130 to the outer diameter D2 of the side wall 125 exceeds a threshold, or is within a range, that makes it difficult (at least more so than in conventional container-lid-to-container-body-arrangements) to seal gas pressure within the internal cavity 120 of the container body 110 from atmosphere; this difficulty is addressed and overcome by various feature(s)/component(s) of the container body 105 and the container lid 110, which feature(s)/component(s) will be discussed in further detail below.

For example, in one or more embodiments, a first ratio of the outer diameter D1 of the neck 130 to the outer diameter D2 of the side wall 125 is greater than or equal to 1:2. For another example, in one or more embodiments, the first ratio of the outer diameter D1 of the neck 130 to the outer diameter D2 of the side wall 125 is greater than or equal to 1:2 and less than or equal to 7:8. For yet another example, in one or more embodiments, the first ratio of the outer diameter D1 of the neck 130 to the outer diameter D2 of the side wall 125 is greater than or equal to 1:2 and less than or equal to 3:4. For yet another example, in one or more embodiments, the first ratio of the outer diameter D1 of the neck 130 to the outer diameter D2 of the side wall 125 is greater than or equal to 2:3. For yet another example, in one or more embodiments, the first ratio of the outer diameter D1 of the neck 130 to the outer diameter D2 of the side wall 125 is greater than or equal to 2:3 and less than or equal to 7:8. For yet another example, in one or more embodiments, the first ratio of the outer diameter D1 of the neck 130 to the outer diameter D2 of the side wall 125 is greater than or equal to 2:3 and less than or equal to 3:4.

In one or more embodiments, the container body 105 is made of an appropriate plastic/synthetic resin, such as, for example, polyethylene terephthalate (PET) resin. In addition, or instead, the container body 105 may be or include polyamide resin, polycarbonate resin, polyacetal resin, polybuthylene terephthalate resin, another synthetic resin having a sufficient resistance to chemicals, the like, or any combination thereof. In one or more embodiments, the container body 105 is made of recyclable plastic. In one or more embodiments, the container body 105 may be formed by molding process(es), such as, for example, biaxial orientation blow molding process(es), direct blow molding process (es), injection blow molding process(es), other molding process(es), the like, or any combination thereof.

Referring to FIGS. 3A through 3D, in an embodiment, the container lid 110 extends along a central axis 180 and includes a side wall 185 and a top wall 190. In one of more embodiments, the side wall 185 is cylindrical. The side wall 185 defines an inner diameter D3 and axially opposing end portions 195*a* and 195*b*. The inner diameter D3 of the side wall 185 is equal to or greater than the outer diameter D1 of the neck 130. Internal ridges, or internal threads 200*a-b*, extend circumferentially along the side wall 185. In one or more embodiments, the second ratio of the inner diameter D3 of the side wall 185 of the container lid 110 to the outer diameter D2 of the side wall 125 of the container body 105 exceeds a threshold, or is within a range, that makes it difficult (at least more so than in conventional container-lid-to-container-body-arrangements) to seal gas pressure within the internal cavity 120 of the container body 110 from atmosphere; this difficulty is addressed and overcome by various feature(s)/component(s) of the container body 105 and the container lid 110, which feature(s)/component(s) will be discussed in further detail below.

For example, in one or more embodiments, a second ratio of the inner diameter D3 of the side wall 185 of the container lid 110 to the outer diameter D2 of the side wall 125 of the container body 105 is greater than or equal to 1:2. For another example, in one or more embodiments, the second ratio of the inner diameter D3 of the side wall 185 of the container lid 110 to the outer diameter D2 of the side wall 125 of the container body 105 is greater than or equal to 1:2 and less than or equal to 7:8. For yet another example, in one or more embodiments, the second ratio of the inner diameter D3 of the side wall 185 of the container lid 110 to the outer diameter D2 of the side wall 125 of the container body 105 is greater than or equal to 1:2 and less than or equal to ¾. For yet another example, in one or more embodiments, the second ratio of the inner diameter D3 of the side wall 185 of the container lid 110 to the outer diameter D2 of the side wall 125 of the container body 105 is greater than or equal to 2:3. For yet another example, in one or more embodiments, the second ratio of the inner diameter D3 of the side wall 185 of the container lid 110 to the outer diameter D2 of the side wall 125 of the container body 105 is greater than or equal to 2:3 and less than or equal to 7:8. For yet another example, in one or more embodiments, the second ratio of the inner diameter D3 of the side wall 185 of the container lid 110 to the outer diameter D2 of the side wall 125 of the container body 105 is greater than or equal to 2:3 and less than or equal to 3:4.

Figure 3A:
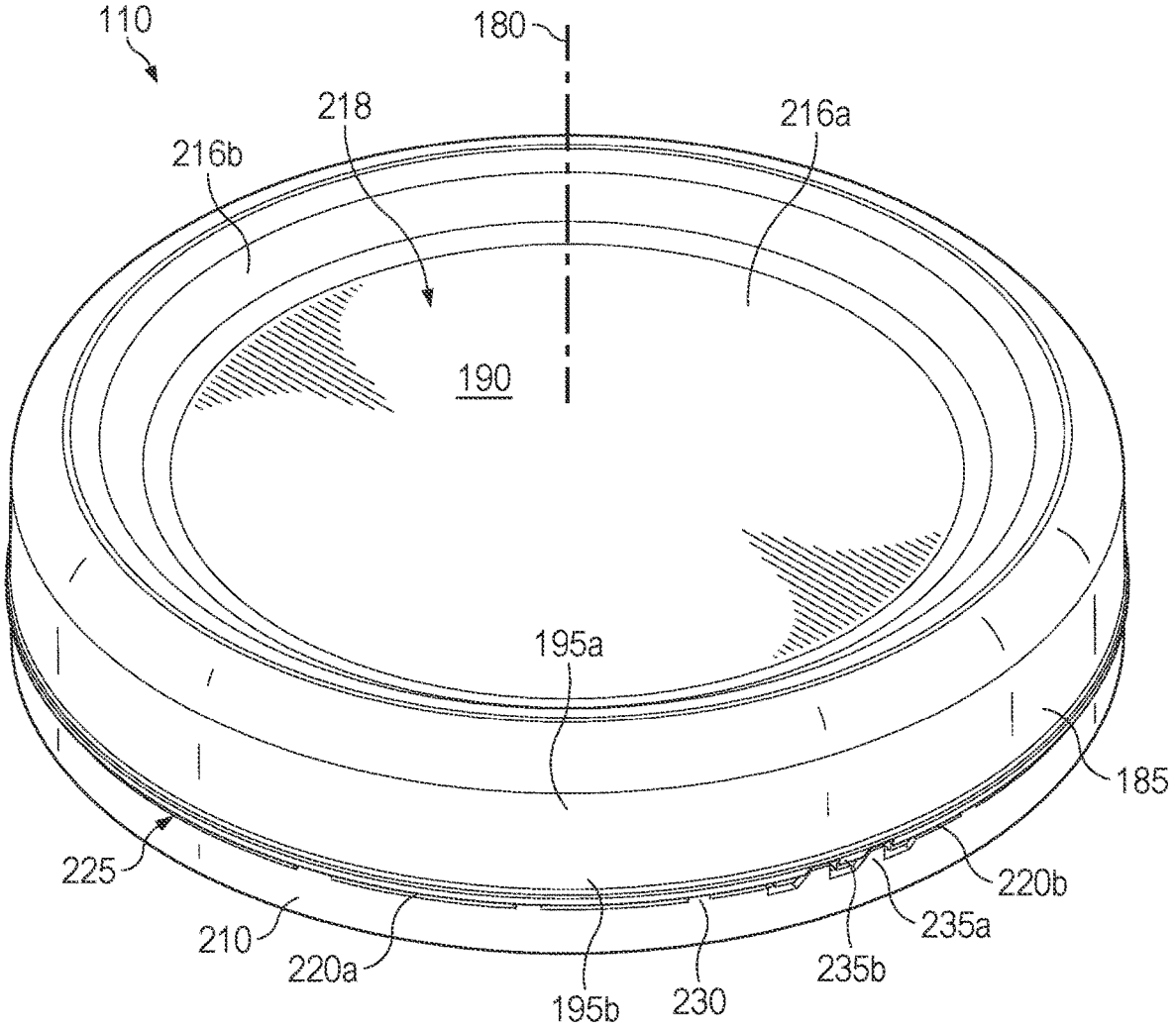
FIG. 3A is a top-front-left perspective view of the container lid of FIG. 1, according to one or more embodiments.
Figure 3B:
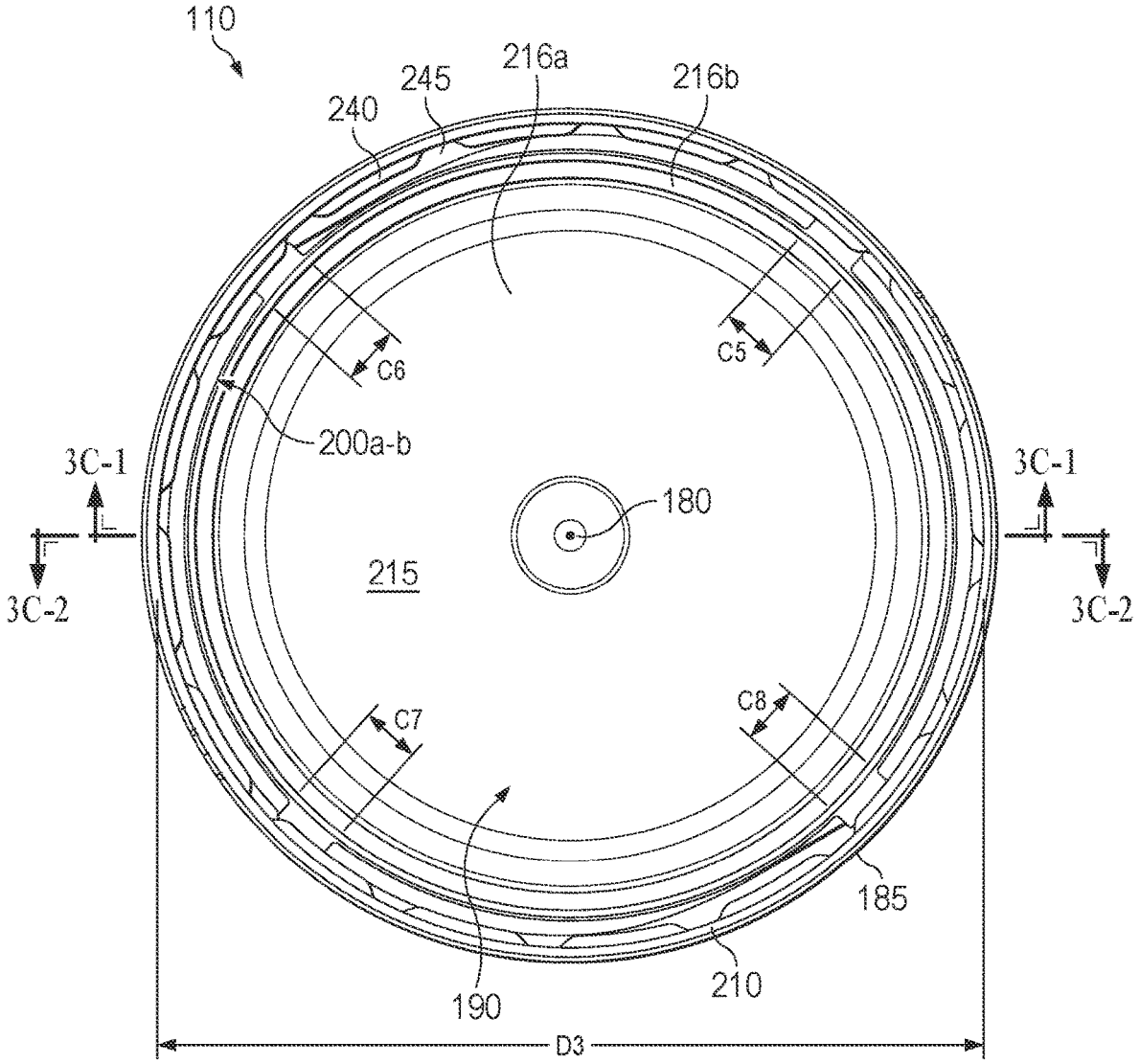
FIG. 3B is a bottom view of the container lid of FIG. 1, according to one or more embodiments.
Figures 1, 3C:
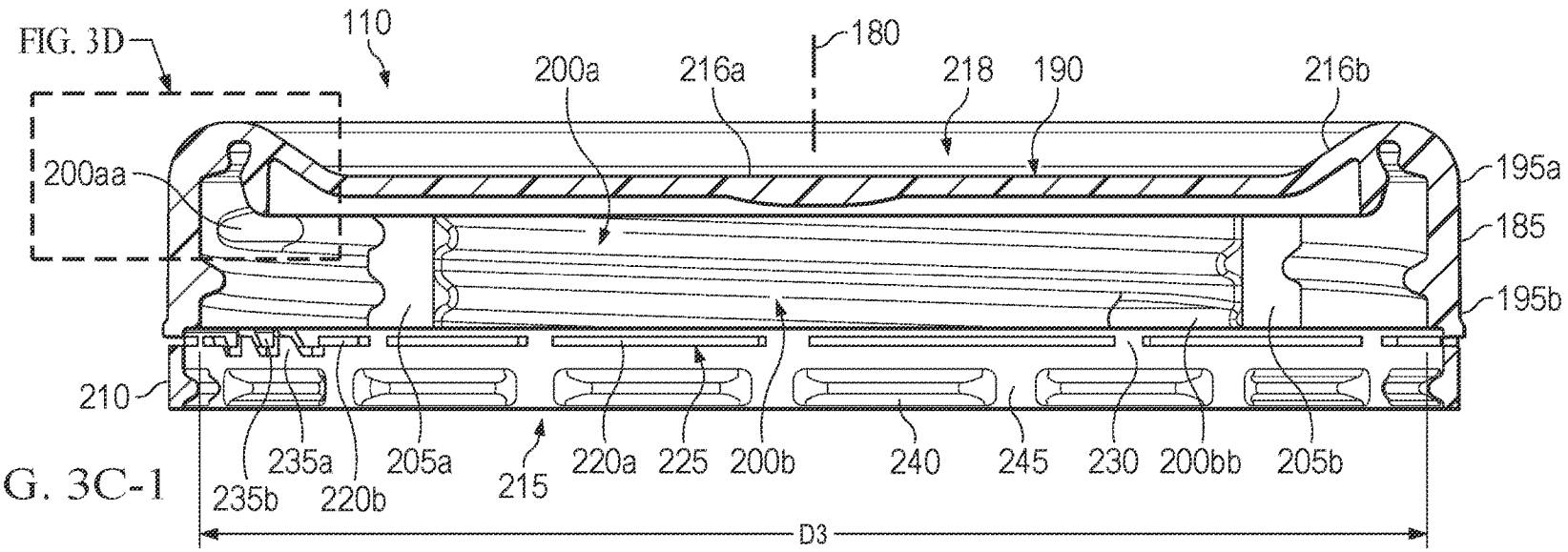
Figures 2, 3C:
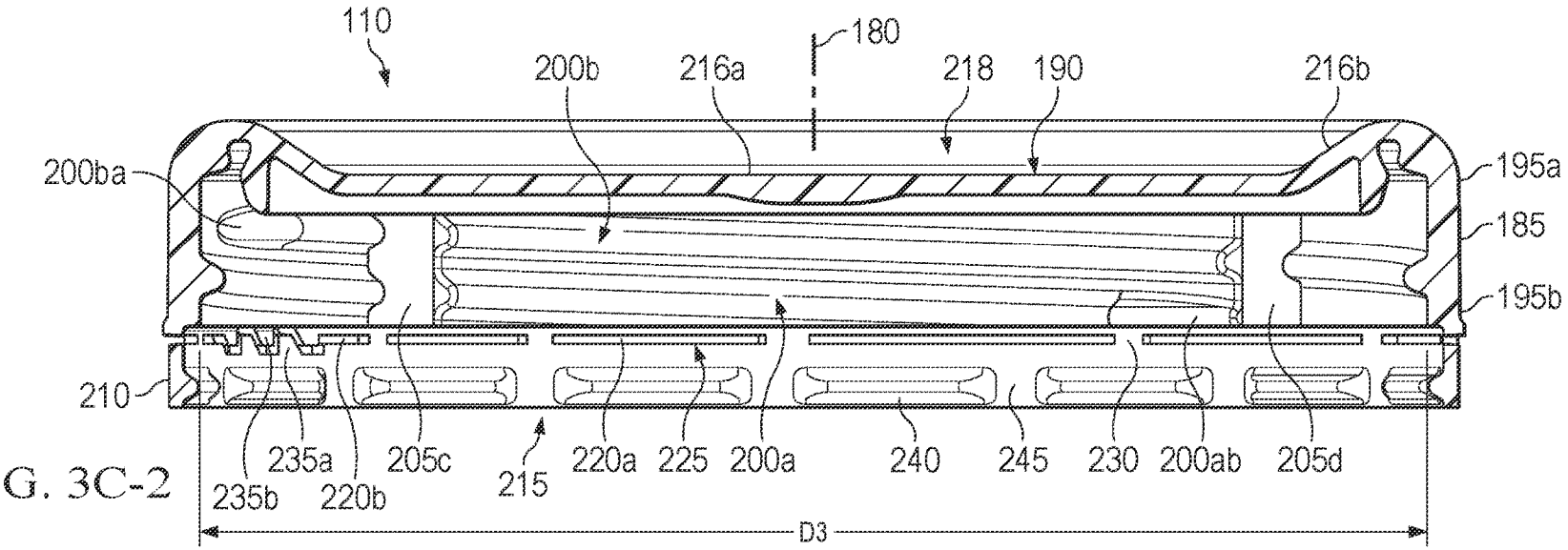

As shown in FIG. 3C-1 and 3C-2, the internal thread 200*a* defines circumferentially opposing end portions 200*aa* (visible in FIG. 3C-1) and 200*ab* (visible in FIG. 3C-2). The end portions 200*aa* and 200*bb* of the thread 200*a* are each tapered. Moreover, the internal thread 200*a* extends spirally along the side wall 185, causing the circumferentially opposing end portions 200*aa* and 200*ab* to be axially and circumferentially spaced apart from each other. The end portion 200*aa* of the thread 200*a* extends relatively closer to the end portion 195*a* of the side wall 185 than the end portion 200*ab* of the thread 200*a*, and the end portion 200*ab* of the thread 200*a* extends relatively closer to the end portion 195*b* of the side wall 185 than the end portion 200*aa* of the thread 200*a*.

Likewise, the internal thread 200*b* defines circumferentially opposing end portions 200*ba* (visible in FIG. 3C-2) and 200*bb* (visible in FIG. 3C-1). The end portions 200*ba* and 200*bb* of the thread 200*b* are each tapered. Moreover, the internal thread 200*b* extends spirally along the side wall 185, causing the circumferentially opposing end portions 200*ba* and 200*bb* to be axially and circumferentially spaced apart from each other. The end portion 200*ba* of the thread 200*b* extends relatively closer to the end portion 195*a* of the side wall 185 than the end portion 200*bb* of the thread 200*b*, and the end portion 200*bb* of the thread 200*b* extends relatively closer to the end portion 195*b* of the side wall 185 than the end portion 200*ba* of the thread 200*b*.

As shown in FIGS. 3B, 3C-1, and 3C-2, a plurality of circumferentially-spaced gaps 205*a-d* are formed axially through the internal threads 200*a-b* and radially into the side wall 185. More particularly, the gap 205*a* defines a circumferential dimension C5, and is formed radially into, and interiorly along, the side wall 185, and axially through: the end portion 200*aa* of the internal thread 200*a*; and a medial portion of the internal thread 200*b* between the opposing end portions 200*ba* and 200*bb*.

The gap 205*b* defines a circumferential dimension C6, and is formed radially into, and interiorly along, the side wall 185, and axially through: a medial portion of the external thread 200*b* between the opposing end portions 200*ba* and 200*bb*. Optionally, the gap 205*b* may also be formed axially through the end portion 200*bb* of the internal thread 200*b*. In one or more embodiments, the circumferential dimensions C5 and C6 are the same.

The gap 205*c* defines a circumferential dimension C7, and is formed radially into, and interiorly along, the side wall 185, and axially through: the end portion 200*ba* of the internal thread 200*b*; and a medial portion of the internal thread 200*a* between the opposing end portions 200*aa* and 200*ab*. In one or more embodiments, the circumferential dimension C7 is the same as the circumferential dimension C5, the circumferential dimension C6, or both.

The gap 205*d* defines a circumferential dimension C8, and is formed radially into, and interiorly along, the side wall 185, and axially through: a medial portion of the external thread 200*b* between the opposing end portions 200*ba* and 200*bb*. Optionally, the gap 205*d* may also be formed axially through the end portion 200*ab* of the internal thread 200*a*. In one or more embodiments, the circumferential dimension C8 is the same as the circumferential dimension C5, the circumferential dimension C6, the circumferential dimension C7, or any combination thereof.

As shown in FIGS. 3A, 3C-1, and 3C-2, the top wall 190 is connected to the side wall 185 at the end portion 195*a* of the side wall 185. A security band 210 is detachably connected to the side wall 185 at the end portion 195*b* of the side wall 185. As a result, the side wall 185, the top wall 190, and the security band 210, in combination, define an internal region 215. The top wall 190 includes a central portion 216*a* and an outer edge portion 216*b*. In one or more embodiments, at least a portion of the central portion 216*a* is planar. In one or more embodiments, the outer edge portion 216*b* extends circumferentially. The outer edge portion 216*b* connects the central portion 216*a* to the end portion 195*a* of the side wall 185. The central portion 216*a* and at least a portion of the outer edge portion 216*b*, in combination, define an external concavity 218 of the container lid 110.

Perforations 220*a-b* are formed radially through the container lid 110, at a circumferential border 225 between the security band 210 and the end portion 195*b* of the side wall 185, leaving separable segments 230 interposed between the perforations 220*a-b*, which separable segments 230 detachably connect the security band 210 to the end portion 195 of the side wall 185. The perforations 220*a* are straight. In contrast, the perforations 220*b* are jagged, forming opposing ramps 235*a-b* in the security band 210 and the side wall 185, respectively. In one or more embodiments, the perforations 220*a-b* include ten (10) straight perforations 220*a* and two (2) jagged perforations 220*b*, with the two (2) jagged perforations 220*b* circumferentially opposing each other so that five (5) of the straight perforations 220*a* extend circumferentially between the two (2) jagged perforations 220*b* on one side of the container lid 110, and the other five (5) of the straight perforations 220*a* extending circumferentially between the two (2) jagged perforations 220*b* on the other side of the container lid 110.

As shown in FIGS. 3B, 3C-1, and 3C-2, internal ridges 240 extend radially inwardly from the security band 210, leaving gaps 245 interposed therebetween. In one or more embodiments, the container security band 210 includes ten (14) of the circumferentially-spaced internal ridges 240.

Figure 3D:
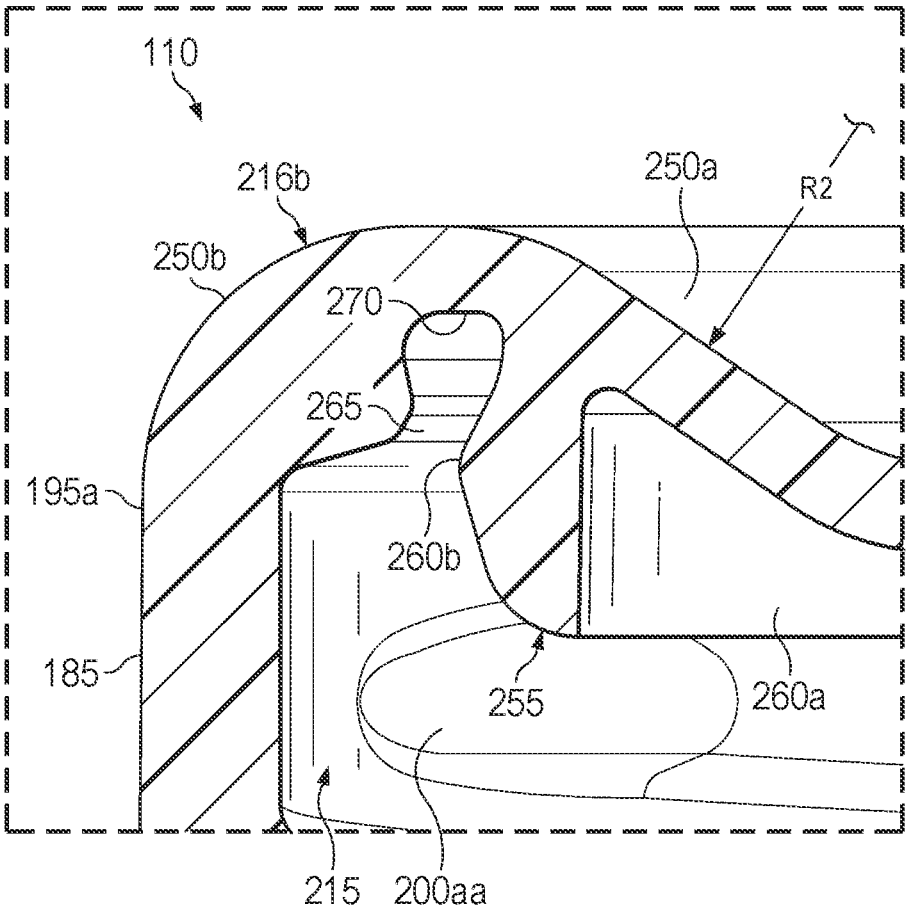
FIG. 3D is an enlarged cross-sectional view of a portion of the container lid of FIG. 3C-1, according to one or more embodiments.

As shown in FIG. 3D, the outer edge portion 216*b* of the top wall 190 includes external surfaces 250*a-b*. The external surface 250*a* extends circumferentially, faces radially inwardly, and, in combination with the central portion 216*a* of the top wall 190, defines the external concavity 218 of the container lid 110. In one or more embodiments, at least a portion of the external surface 250*a* is curved. For example, the at least a portion of the external surface 250*a* may define a radius of curvature R2 (shown in FIG. 3D), which radius of curvature R2 is the same as the radius of curvature R1. In addition, or instead, at least a portion of the external surface 250*a* may be frustoconical. In combination, the central portion 216*a* of the top wall 190 of the container lid 110 and the external surface 250*a* of the outer edge portion 216*b* of the top wall 190 of the container lid 110 define, and may be referred to herein as, a "three-dimensional profile"; this three-dimensional profile mirrors the three-dimensional profile defined by the container body 105, as described in detail above.

The external surface 250*b* extends circumferentially and faces radially outwardly. In one or more embodiments, at least a portion of the external surface 250*b* is curved. An internal collar 255 extends inwardly from the outer edge portion 216*b* of the top wall 190, opposite the external surface 250*a*, and into the internal region 215. The internal collar 255 extends circumferentially and includes an internal surface 260*a* and an external bulbous protrusion 260*b*. In one or more embodiments, the internal surface 260*a* is cylindrical. An internal ridge 265 extends inwardly from the outer edge portion 216*b* of the top wall 190, opposite the external surface 250*b*, and into the internal region 215. In addition, or instead, the internal ridge 265 may extend inwardly from the side wall 185 of the container lid 110. The internal ridge 265 extends circumferentially, and, in combination with the internal collar 255, defines an internal annular groove 270 of the container lid 110 (i.e., the internal annular groove 270 extends between the internal collar 255 and the internal ridge 265).

In one or more embodiments, the container lid 110 is made of the same resin material as the container body 105. Alternatively, the container lid 110 may be made of a different resin material than the container body 105. In one or more embodiments, the container lid 110 is made of an appropriate plastic/synthetic resin, such as, for example, polyethylene terephthalate (PET) resin. In addition, or instead, the container lid 110 may be or include polyamide resin, polycarbonate resin, polyacetal resin, polybuthylene terephthalate resin, another synthetic resin having a sufficient resistance to chemicals, the like, or any combination thereof. In one or more embodiments, the container lid 110 is made of recyclable plastic. In one or more embodiments, the container lid 110 and the container body 105 are both made of recyclable plastic. In one or more embodiments, the container lid 110 may be formed by molding process(es), such as, for example, biaxial orientation blow molding process(es), direct blow molding process(es), injection blow molding process(es), other molding process(es), the like, or any combination thereof.

Figure 4A:
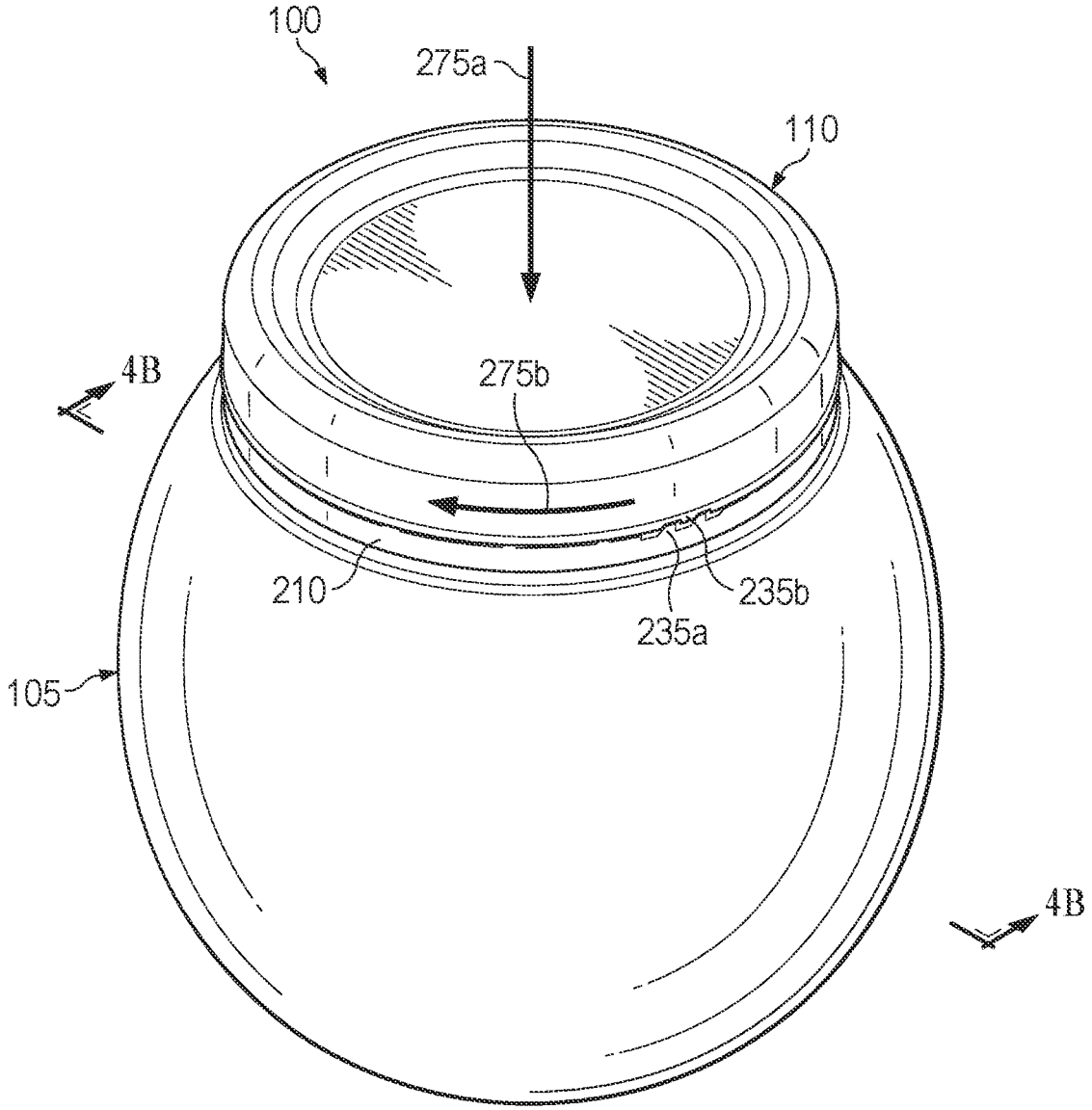
FIG. 4A is a top-front-left perspective view of the first container apparatus of FIG. 1 in a second operational state or configuration, according to one or more embodiments.
Figure 4B:
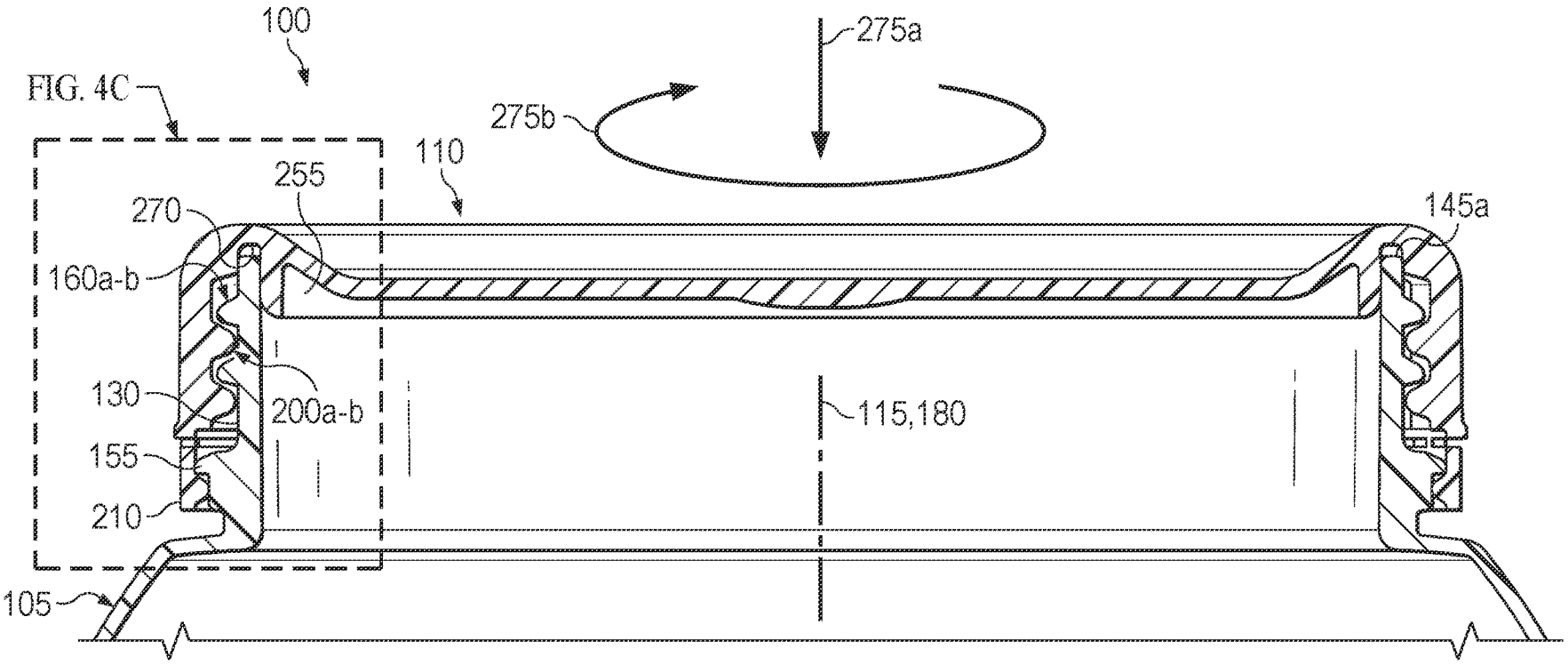
FIG. 4B is a cross-sectional view of the first container apparatus of FIG. 4A taken along the line 4B-4B of FIG. 4A, according to one or more embodiments.
Figure 4C:
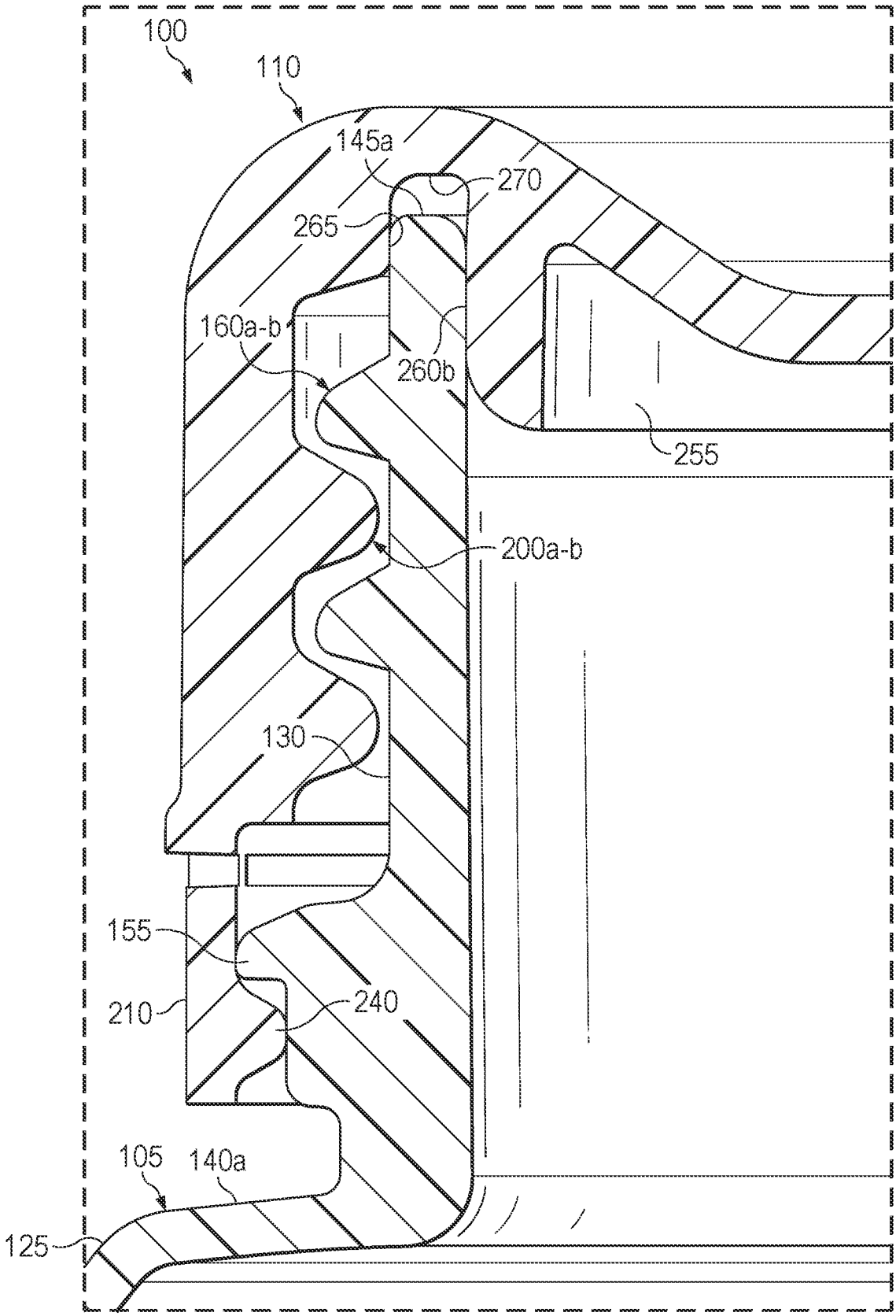
FIG. 4C is an enlarged cross-sectional view of a portion of the first container apparatus of FIG. 4B, according to one or more embodiments.
Figure 4D:
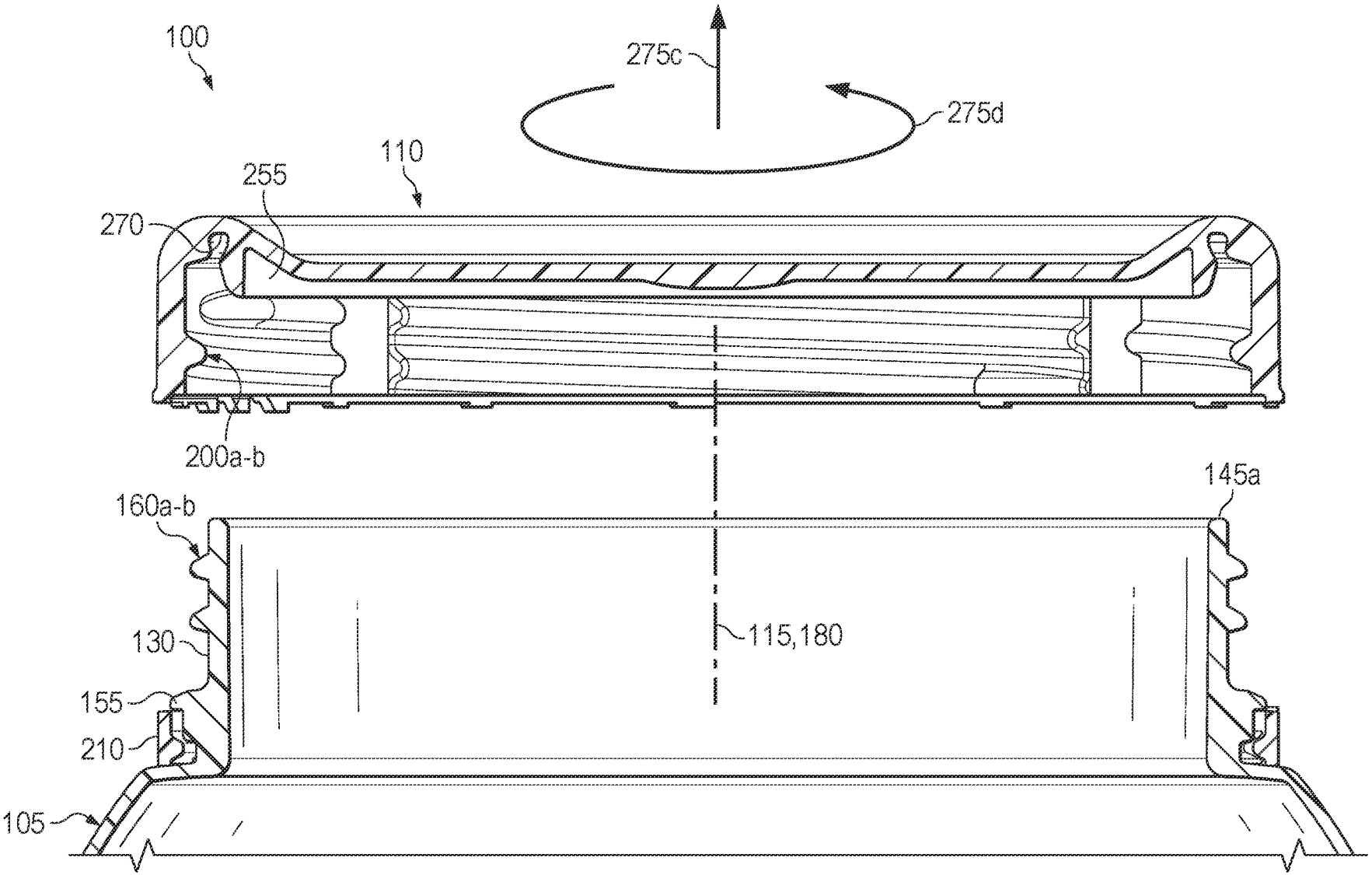
FIG. 4D is a cross-sectional view of the first container apparatus of FIG. 4A (similar to that shown in FIG. 4B) in a third operational state or configuration, according to one or more embodiments.
Figure 4E:
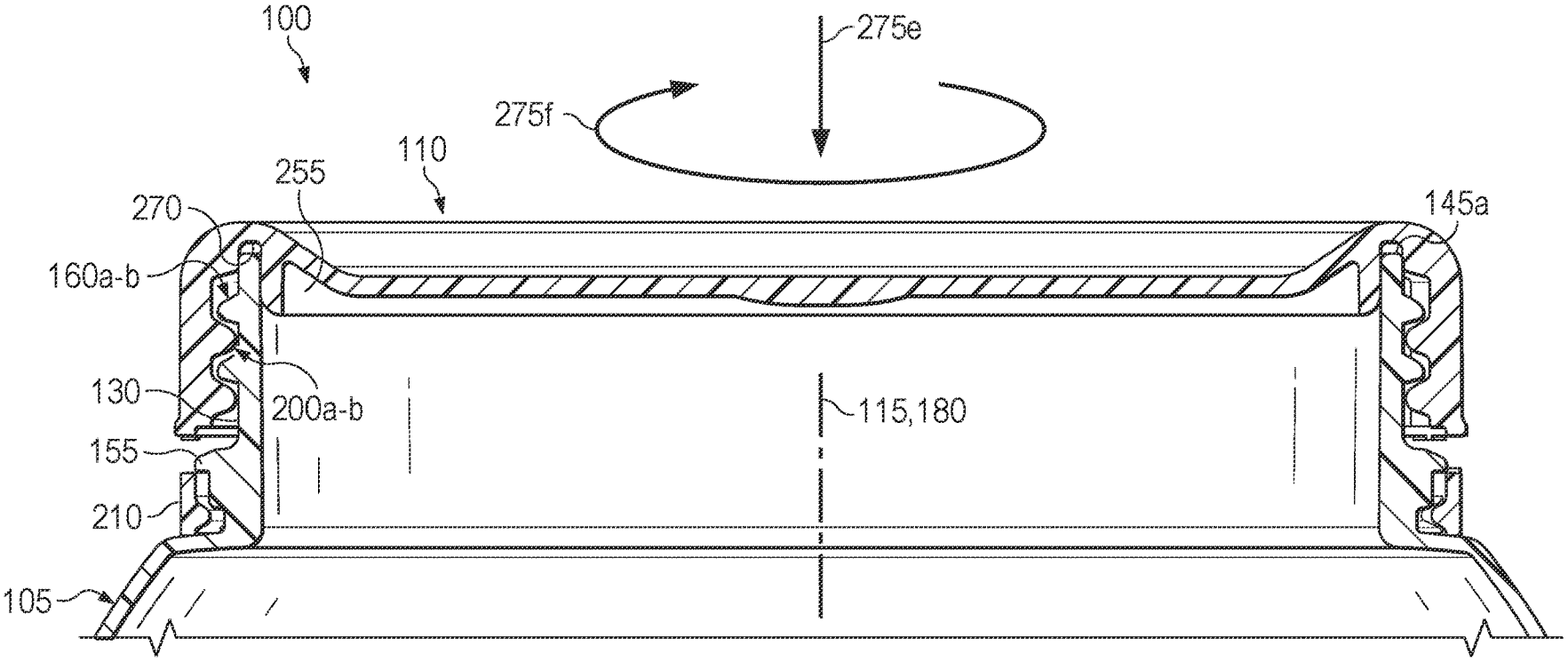
FIG. 4E is a cross-sectional view of the first container apparatus of FIG. 4A (similar to that shown in FIGS. 4B and 4D) in a fourth operational state or configuration, according to one or more embodiments.

Referring to FIGS. 4A through 4C, with continuing reference to FIGS. 1 through 3D, in an embodiment, in operation, the container lid 110 is attachable to the container body 105 by threading the container lid 110 onto the neck 130 of the container body 105, as indicated by arrows 275*a-b* in FIGS. 4A and 4B. In addition, or instead, the container lid 110 may be attachable to the container body 105 using another attachment mechanism, such as, for example, "snap-on" feature(s), locking feature(s), other attachment feature(s), the like, or any combination thereof. In any case, once so attached, the container lid 110 is detachable from, and re-attachable to, the container body 105, as shown in FIGS. 4D and 4E (and discussed in further detail below). More particularly, to attach (or re-attach) the container lid 110 to the container body 105, the end portion 145*a* of the neck 130 of the container body 105 is received within the internal region 215 of the container lid 110 so that the internal threads 200*a-b* of the container lid 110 are engaged with the external threads 160*a-b* of the container body 105. Once so engaged, the container lid 110 is rotated relative to the container body 105 so that the end portions 200*ab* and 200*bb* (shown in FIGS. 3C-1 and 3C-2) of the internal threads 200*a-b* of the container lid 110 are received under, and engaged by, the end portions 160*aa* and 160*ba* (shown in FIGS. 2C-1 and 2C-2) of the external threads 160*a-b* of the container body 105. Once the end portions 200*ab* and 200*bb* of the internal threads 200*a-b* of the container lid 110 are so received under, and engaged by, the end portions 160*aa* and 160*ba* of the external threads 160*a-b* of the container body 105, continued rotation of the container lid 110 relative to the container body 105 threads the container lid 110 onto the container body 105 via sliding engagement between internal threads 200*a-b* of the container lid 110 and the external threads 160*a-b* of the container body 105. Although shown as being threaded onto the container body 105 in the clockwise direction, in one or more embodiments, the threads of the container lid 110 and the threads of the container body 105 are instead each spirally formed in the opposite direction so that the container lid 110 threads onto the container body 105 in a counter-clockwise direction.

In some embodiments, continued threading of the container lid 110 onto the container body 105 causes an end face defined by the end portion 145*a* of the neck 130 of the container 105 to engage (e.g., sealingly) a portion of the container lid 110 defined by the internal annular groove 270. In addition, or instead, continued threading of the container lid 110 onto the container body 105 causes the internal collar 255 to move toward the end portion 145*a* of the neck 130 of the container body 105, eventually causing the end portion 145*a* of the neck 130 of the container body 105 to be received within the internal annular groove 270 of the container lid 110 so that one or both of the external bulbous protrusion 260*b* of the internal collar 255 and the internal ridge 265 of the container lid 110 engage(s) (e.g., sealingly) the end portion 145*a* of the neck 130 of the container body 105.

More particularly, in one or more embodiments, as the end portion 145*a* of the neck 130 of the container body 105 is received into the internal annular groove 270 of the container lid 110, the internal collar 255 flexes radially inwardly, thereby applying a radially-outward recoil force against the inside of the neck 130 at the end portion 145*a*, which radially-outward recoil force engages (e.g., sealingly) the external bulbous protrusion 260*b* of the internal collar 255 with the inside of the neck 130 at the end portion 145*a*. In such embodiment(s), the engagement between the external bulbous protrusion 260*b* of the internal collar 255 and the inside of the neck 130 at the end portion 145*a* facilitates (optionally, in combination with the engagement between the internal ridge 265 of the container lid 110 and the outside of the neck 130 at the end portion 145*a*, discussed below) the sealing of gas pressure within the internal cavity 120 of the container body 110 from atmosphere, even though the first ratio of the outer diameter D1 of the neck 130 to the outer diameter D2 of the side wall 125 is: greater than or equal to 1:2; greater than or equal to 1:2 and less than or equal to 7:8; greater than or equal to 1:2 and less than or equal to 3:4; greater than or equal to 2:3; greater than or equal to 2:3 and less than or equal to 7:8; or greater than or equal to 2:3 and less than or equal to 3:4.

In addition, or instead, in one or more embodiments, as the end portion 145*a* of the neck 130 of the container body 105 is received into the internal annular groove 270 of the container lid 110, the internal ridge 265 of the container lid 110 flexes radially outwardly, thereby applying a radially-inward recoil force against the outside of the neck 130 at the end portion 145*a*, which radially-inward recoil force engages (e.g., sealingly) the internal ridge 265 of the container lid 110 with the outside of the neck 130 at the end portion 145*a*. In such embodiment(s), the engagement between the internal ridge 265 of the container lid 110 and the outside of the neck 130 at the end portion 145*a* facilitates (optionally, in combination with the sealing engagement between the external bulbous protrusion 260*b* of the internal collar 255 and the inside of the neck 130 at the end portion 145*a*) the sealing of the gas pressure within the internal cavity 120 of the container body 110 from atmosphere, even though the second ratio of the inner diameter D3 of the side wall 185 of the container lid 110 to the outer diameter D2 of the side wall 125 of the container body 105 is: greater than or equal to 1:2; greater than or equal to 1:2 and less than or equal to 7:8; greater than or equal to 1:2 and less than or equal to 3:4; greater than or equal to 2:3; greater than or equal to 2:3 and less than or equal to 7:8; or greater than or equal to 2:3 and less than or equal to 3:4.

Continued threading of the container lid 110 onto the container body 105 also causes the security band 210 to move toward the external collar 155 of the container body 105, eventually causing the internal ridges 240 of the security band 210 to slide over and past the external collar 155, thereby trapping the security band 210 of the container lid 110 between the end portion 140*a* of the side wall 125 and the external collar 155 of the container body 105.

In several embodiments, a fluid, such as a beverage for human consumption, is disposed within the internal cavity 120 of the container body; in some embodiments, one or more of the above-described sealing engagements seal gas pressure within the internal cavity 120 of the container body 110 from atmosphere. In several embodiments, a fluid, such as wine such as flavored wine, is disposed within the internal cavity 120 of the container body; in some embodiments, one or more of the above-described sealing engagements seal gas pressure within the internal cavity 120 of the container body 110 from atmosphere.

Referring to FIGS. 4D and 4E, with continuing reference to FIGS. 4A through 4C, in an embodiment the trapping of the security band 210 between the end portion 140*a* of the side wall 125 and the external collar 155 of the container body 105 causes the internal ridges 140 of the security band 210 to contact the external collar 155 of the container body 105 when the container lid 110 is subsequently threaded off of the container body 105 (i.e., by rotating the container lid 110 in a direction opposite the direction 275*b* and relative to the container body 105). As a result of such threading of the container lid 110 off of the container body 105, the internal ridges 240 of the security band 210 contact the external collar 155 of the container body 105, applying a tensile force to the separable segments 230 separably connecting the container lid 110 to the security band 210. Additionally, and as a result, rotational friction between the internal ridges 240 of the security band 210 and the external collar 155 causes relative rotation between the side wall 185 of the container lid 110 and the security band 210, which relative rotation causes the ramp 235*a* of the security band 210 to be engaged by the ramp 235*b* of the side wall 185 (the ramps 235*a-b* are shown in FIGS. 3A, 3C-1, 3C-2, and 4A). Continued threading of the container lid 110 off of the container body 105 causes continued relative rotation between the side wall 185 of the container lid 110 and the security band 210 causes the ramp 235*b* of the side wall 185 to slide along the ramp 235*a* of the security band 210, thereby axially separating the container lid 110 from the security band 210 by breaking the separable segments 230 separably connecting the container lid 110 to the security band 210, as indicated by arrows 275*c-d* in FIG. 4D. Once so axially separated, the security band 210 remains axially trapped between the end portion 140*a* of the side wall 125 and the external collar 155 of the container body 105, as shown in FIG. 4D.

Additionally, when the container lid 110 is threaded off of the container body 105, the end portion 145*a* of the neck 130 is removed from the internal annular groove 270 so that the end portion 145*a* of the neck 130 is sealingly disengaged from one or both of the external bulbous protrusion 260*b* of the internal collar 255 and the internal ridge 265 of the container lid 110. This sealing disengagement of the end portion 145*a* of the neck 130 from the one or both of the external bulbous protrusion 260*b* of the internal collar 255 and the internal ridge 265 of the container lid 110 allows gas pressure within the internal cavity 120 of container body 105 to be released. More particularly, gas pressure is permitted to flow: between the internal collar 255 of the container lid 110 and the inside of the end portion 145*a* of the neck 130 of the container body 105; between the internal ridge 265 of the container lid 110 and the outside of the end portion 145*a* of the neck 130 of the container body 105; through the gaps 205*a-d* (shown in FIGS. 3B, 3C-1, and 3C-2) formed along the container lid 110; and through the gaps 165*a-d* (shown in FIGS. 2C-1, 2C-2, and 2D) formed along the container body 105. The gas pressure eventually exits to atmosphere adjacent the end portion 195*b* of the side wall 185 of the container lid 110 and the end portion 145*b* of the neck 130 of the container body 105.

In several embodiments, a fluid, such as a beverage for human consumption, is disposed within the internal cavity 120 of the container body; in some embodiments, one or more of the above-described sealing engagements seal gas pressure within the internal cavity 120 of the container body 110 from atmosphere; in several embodiments, when the container lid is detached from the container body 110, as shown in FIG. 4D, a human drinks the fluid from the internal cavity 120.

As indicated by arrows 275*e-f* in FIG. 4E, the container lid 110 can be subsequently re-attached to, and sealingly engaged with, the container body 105 in the same manner as that described above in connection with FIGS. 4A through 4C, except that the security band 210 is no longer connected to the rest of the container lid 110 (and so does not slide over and past the external collar 155, but instead remains axially trapped between the end portion 140*a* of the side wall 125 and the external collar 155 of the container body 105); therefore, the re-attachment (and sealing engagement) of the container lid 110 to the container body 105 will not be described in further detail.

In several embodiments, a fluid, such as a beverage for human consumption, is disposed within the internal cavity 120 of the container body; in some embodiments, one or more of the above-described sealing engagements seal gas pressure within the internal cavity 120 of the container body 110 from atmosphere; in several embodiments, when the container lid is detached from the container body 110, as shown in FIG. 4D, a human can drink the fluid from the internal cavity 120 via the mouth 150; in several embodiments, after drinking some of the fluid, the human reattaches the container lid 110 to the container body 105, as shown in FIG. 4E, so that the remaining (undrunk) fluid will not spill out of the internal cavity 120—in several embodiments, in the future the human again detaches the container lid 110 from the container body 105, and again drinks the fluid from the internal cavity 120 via the mouth 150.

Figure 5:
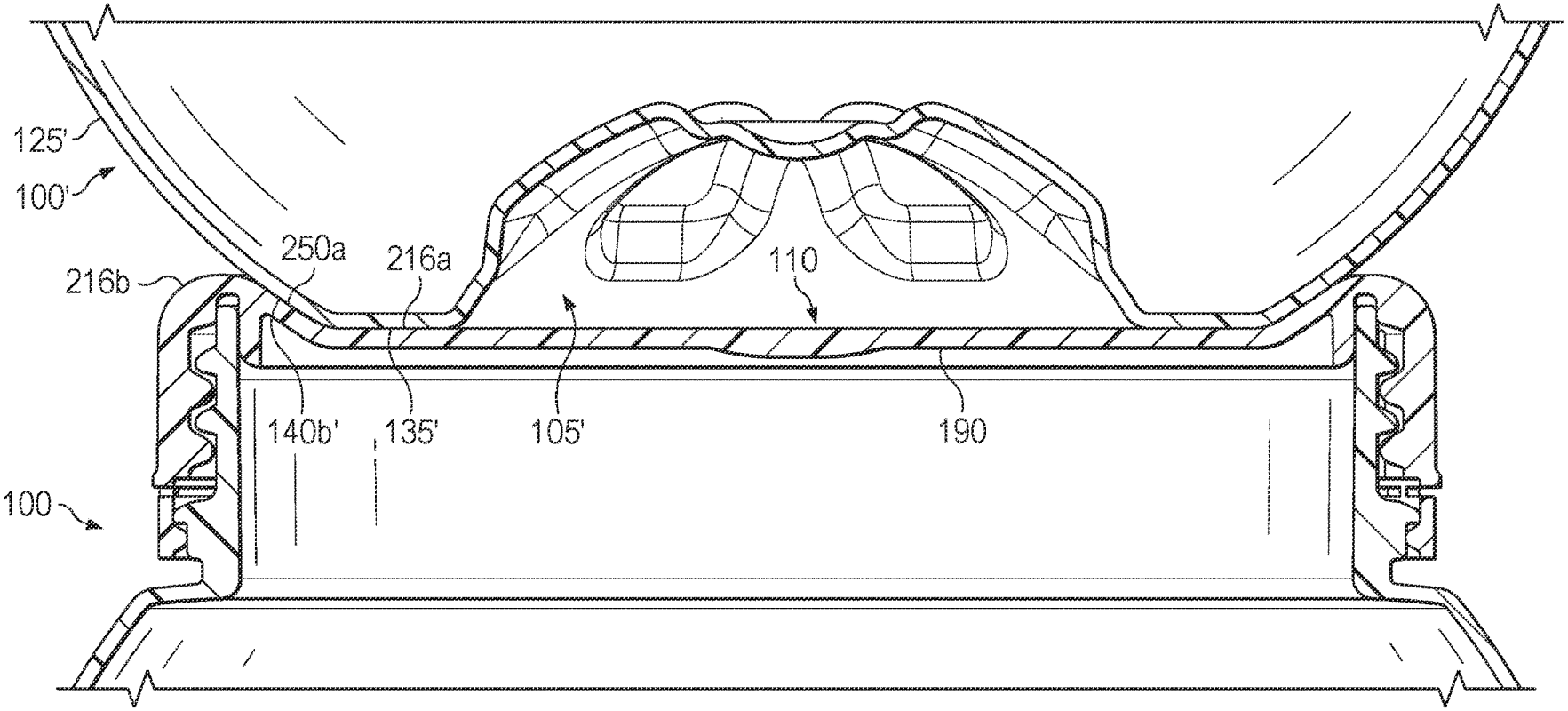
FIG. 5 is a cross-sectional view of the first container apparatus of FIG. 4A together with a second container apparatus, according to one or more embodiments.

Referring to FIG. 5, with continued reference to FIGS. 1 through 4C, in an embodiment, the container apparatus 100 is stackable with another container apparatus, which another container apparatus is substantially identical to the container apparatus 100, and, therefore, is given the same reference numeral, except with the suffix "'" added. In addition, or instead, the container apparatus 100' includes feature(s)/component(s) substantially identical to corresponding feature(s)/component(s) of the container apparatus 100', which substantially identical feature(s)/component(s) are given the same reference numerals, except with the suffix "'" added.

As shown in FIG. 5, when so stacked, a portion of the container body 105' of the container apparatus 100' matingly engages a portion of the container lid 110 of the container apparatus 100. More particularly, the bottom wall 135' of the container body 105' is matingly received by the central portion 216*a* of the top wall 190 of the container lid 110. Additionally, the end portion 140*b'* of the side wall 125' of the container body 105' is matingly received by the external surface 250*a* of the outer edge portion 216*b* of the top wall 190 of the container lid 110. For example, in those embodiment(s) in which the end portion 140*b'* of the side wall 125' of the container body 105' defines the radius of curvature R1', and the external surface 250*a* of the outer edge portion 216*b* of the top wall 190 of the container lid 110 defines the radius of curvature R2 (which is the same as the radius of curvature R1'), the end portion 140*b'* of the side wall 125' of the container body 105' matingly engages the external surface 250*a* of the outer edge portion 216*b* of the top wall 190 of the container lid 110. For another example, in those embodiment(s) in which the end portion 140*b'* of the side wall 125' of the container body 105' defines the frustoconical shape, and the external surface 250*a* of the outer edge portion 216*b* of the top wall 190 of the container lid 110 defines the frustoconical shape, the end portion 140*b'* of the side wall 125' of the container body 105' matingly engages the external surface 250*a* of the outer edge portion 216*b* of the top wall 190 of the container lid 110.

Figure 6:
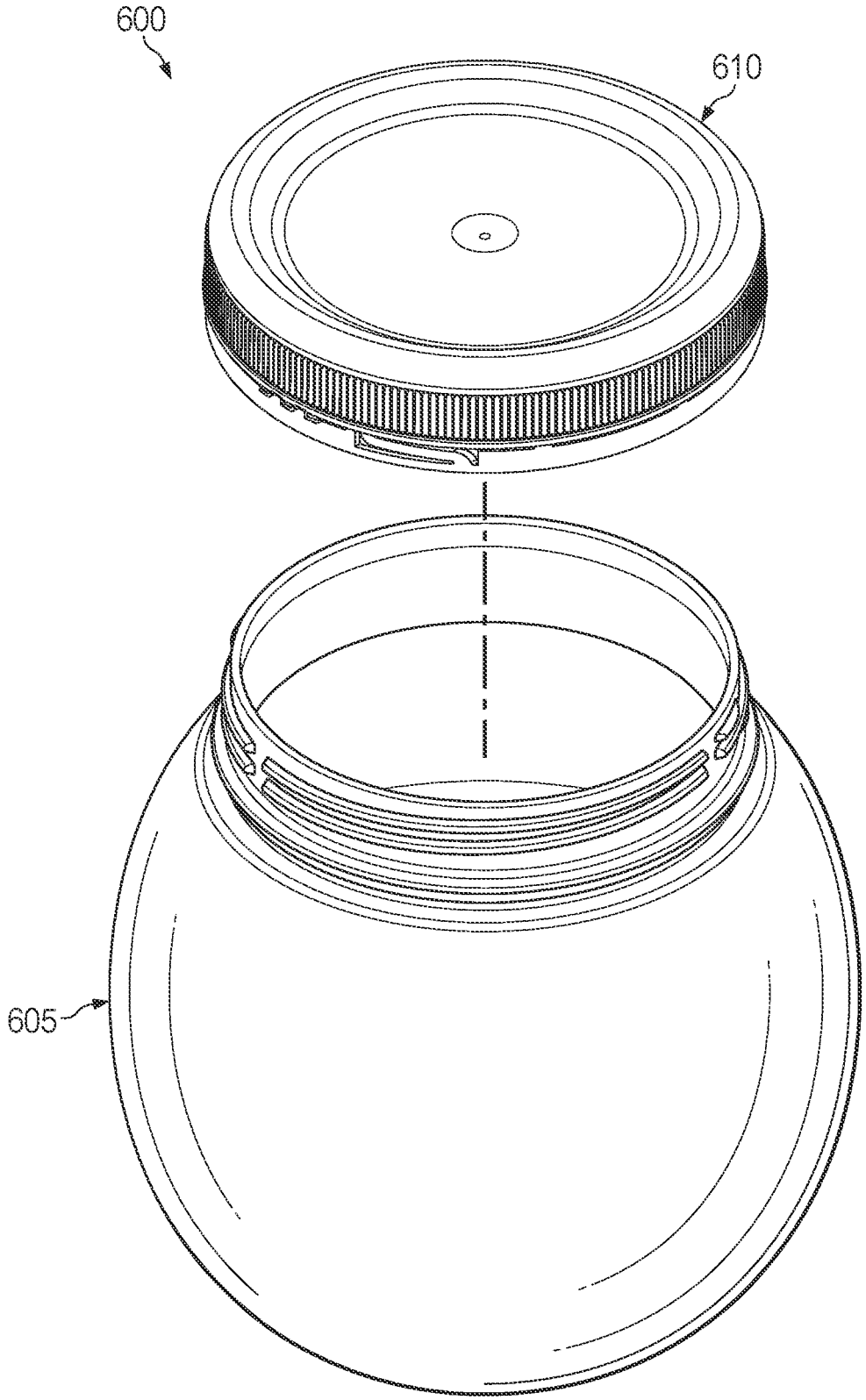
FIG. 6 is a top-front-left perspective view of a third container apparatus in a first operational state or configuration, the third container apparatus including a container body and a container lid, according to one or more embodiments.

Referring to FIG. 6, a second embodiment of the container apparatus is generally referred to by the reference numeral 600. The second embodiment of the container apparatus 600 includes the container body 105 and a container lid 610.

The container body of the second embodiment of the container apparatus 600 is substantially the same as, and in one or more embodiments is identical to, the container body as described with respect to the container apparatus 100 in FIGS. 2A-2F. Therefore, reference to the container body of the second embodiment of the container apparatus 600, or any of its elements, will be made with respect to the description of the container body 105 of the container apparatus 100, and any of its elements, as described above with respect to FIGS. 2A-2F.

Referring to FIGS. 7A through 7D, in an embodiment, the container lid 610 extends along a central axis 180 and includes a side wall 685 and a top wall 690. In one or more embodiments, the side wall 685 is cylindrical. The side wall 685 defines an inner diameter D4 and axially opposing end portions 695*a* and 695*b*. The inner diameter D4 of the side wall 685 is equal to or greater than the outer diameter D1 of the neck 130 of the container body 105. Internal ridges, or internal threads 700*a-b*, extend circumferentially along the side wall 685. In one or more embodiments, an outer surface of the sidewall 685 has surface undulations, raised portions, ridges, or other such features that provide additional grip between a user or a tool and the container lid 610.

In one or more embodiments, the third ratio of the inner diameter D4 of the side wall 685 of the container lid 610 to the outer diameter D2 of the side wall 125 of the container body 105 exceeds a threshold, or is within a range, that makes it difficult (at least more so than in conventional container-lid-to-container-body-arrangements) to seal gas pressure within the internal cavity 120 of the container body 105 from atmosphere; this difficulty is addressed and overcome by various feature(s)/component(s) of the container body 105 and the container lid 610, which feature(s)/component(s) will be discussed in further detail below.

For example, in one or more embodiments, a third ratio of the inner diameter D4 of the side wall 685 of the container lid 610 to the outer diameter D2 of the side wall 125 of the container body 105 is greater than or equal to 1:2. For another example, in one or more embodiments, the third ratio of the inner diameter D4 of the side wall 685 of the container lid 610 to the outer diameter D2 of the side wall 125 of the container body 105 is greater than or equal to 1:2 and less than or equal to 7:8. For yet another example, in one or more embodiments, the third ratio of the inner diameter D4 of the side wall 685 of the container lid 610 to the outer diameter D2 of the side wall 125 of the container body 105 is greater than or equal to 1:2 and less than or equal to 3:4. For yet another example, in one or more embodiments, the third ratio of the inner diameter D4 of the side wall 685 of the container lid 610 to the outer diameter D2 of the side wall 125 of the container body 105 is greater than or equal to 2:3. For yet another example, in one or more embodiments, the third ratio of the inner diameter D4 of the side wall 685 of the container lid 610 to the outer diameter D2 of the side wall 125 of the container body 105 is greater than or equal to 2:3 and less than or equal to 7:8. For yet another example, in one or more embodiments, the third ratio of the inner diameter D4 of the side wall 685 of the container lid 610 to the outer diameter D2 of the side wall 125 of the container body 105 is greater than or equal to 2:3 and less than or equal to 3:4.

Figure 7A:
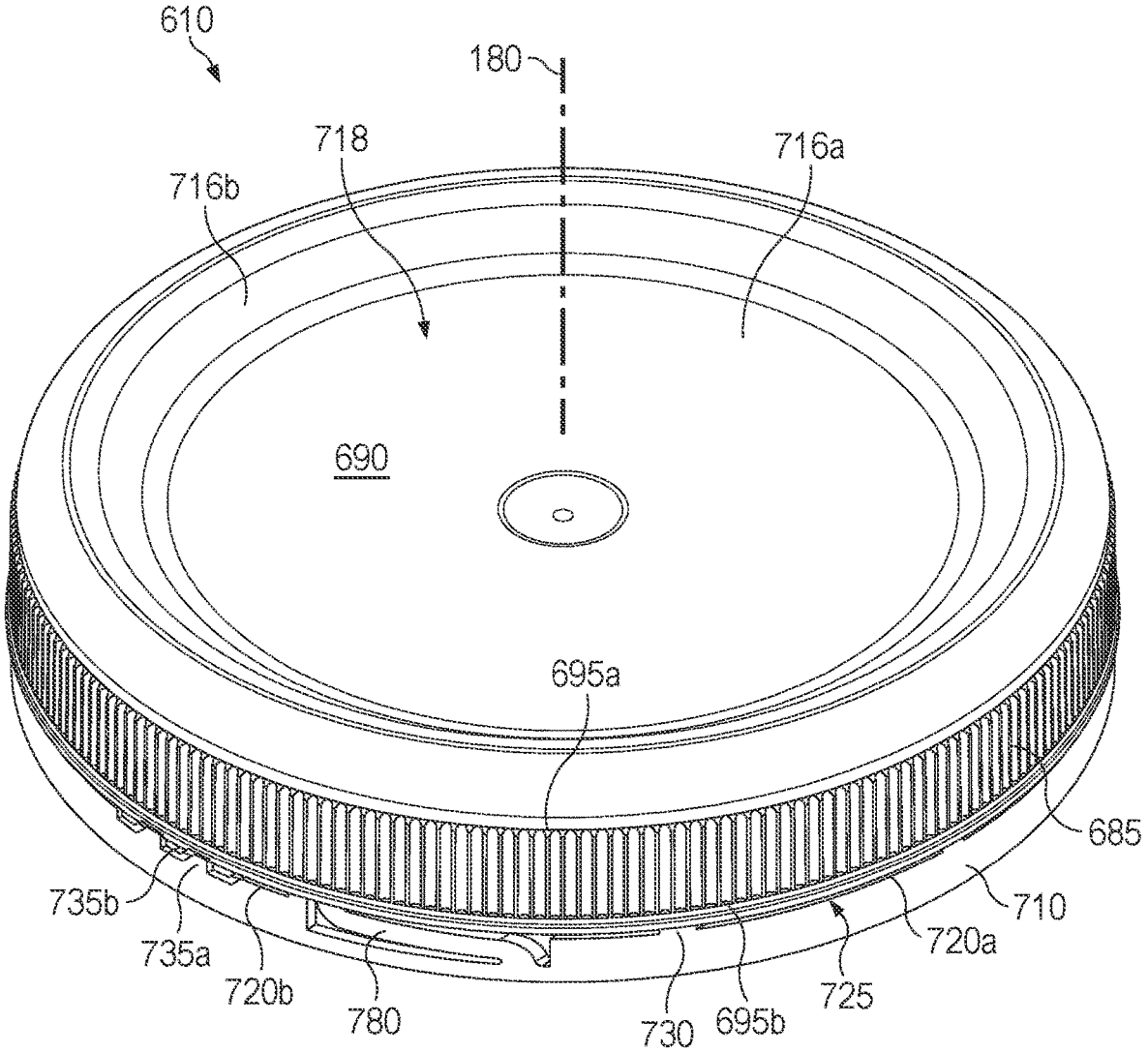
FIG. 7A is a top-front-left perspective view of the container lid of FIG. 6, the container lid including a tether, according to one or more embodiments.
Figure 7B:
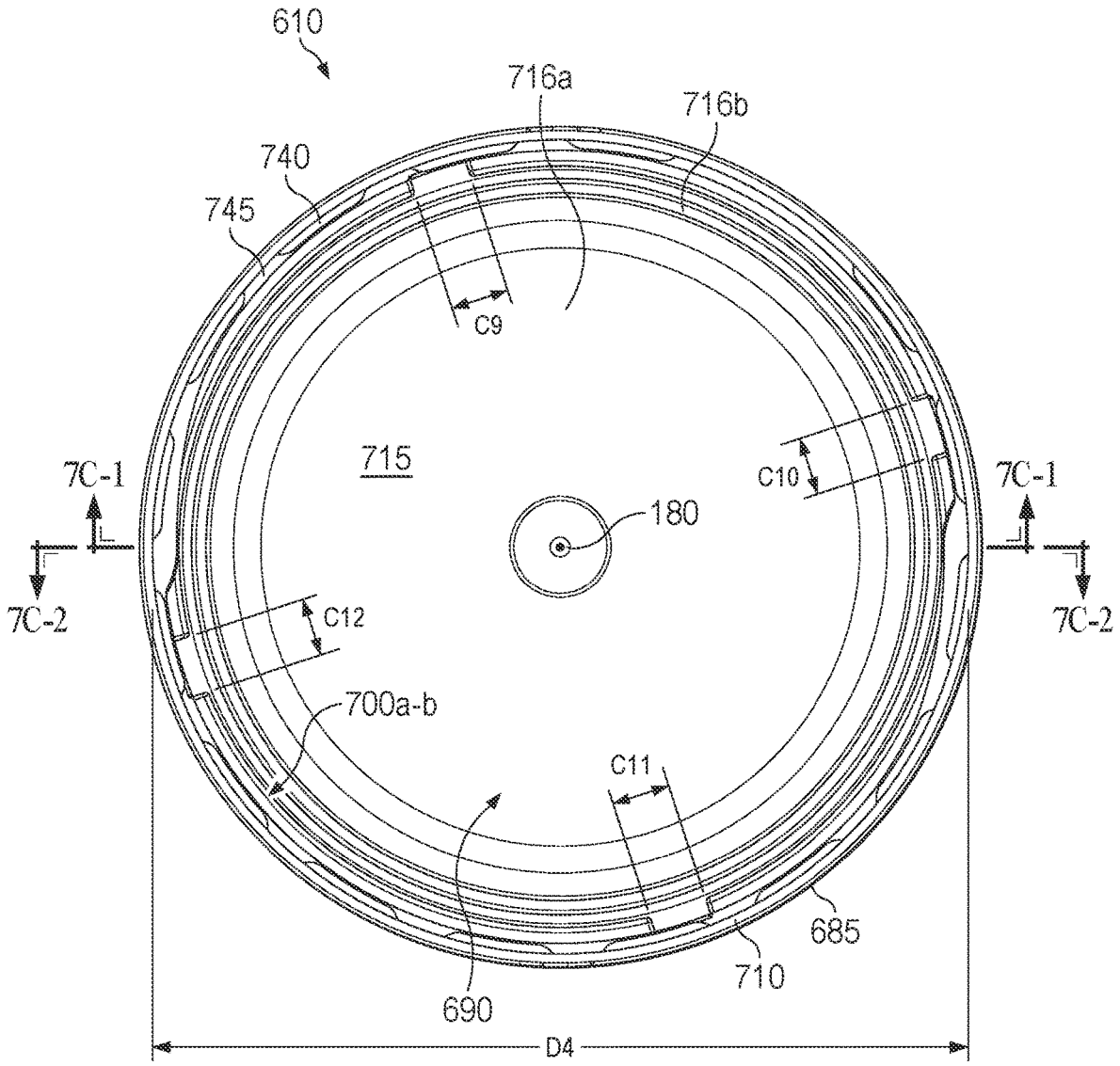
FIG. 7B is a bottom view of the container lid of FIG. 6, according to one or more embodiments.
Figures 1, 7C:
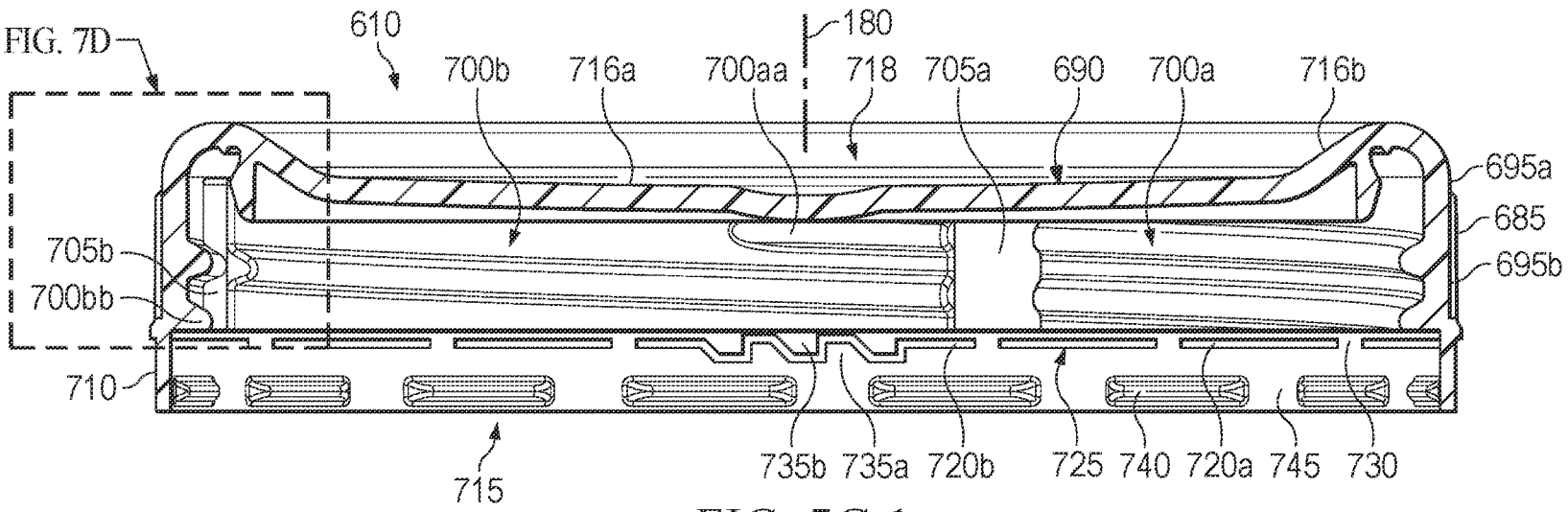
Figures 2, 7C:
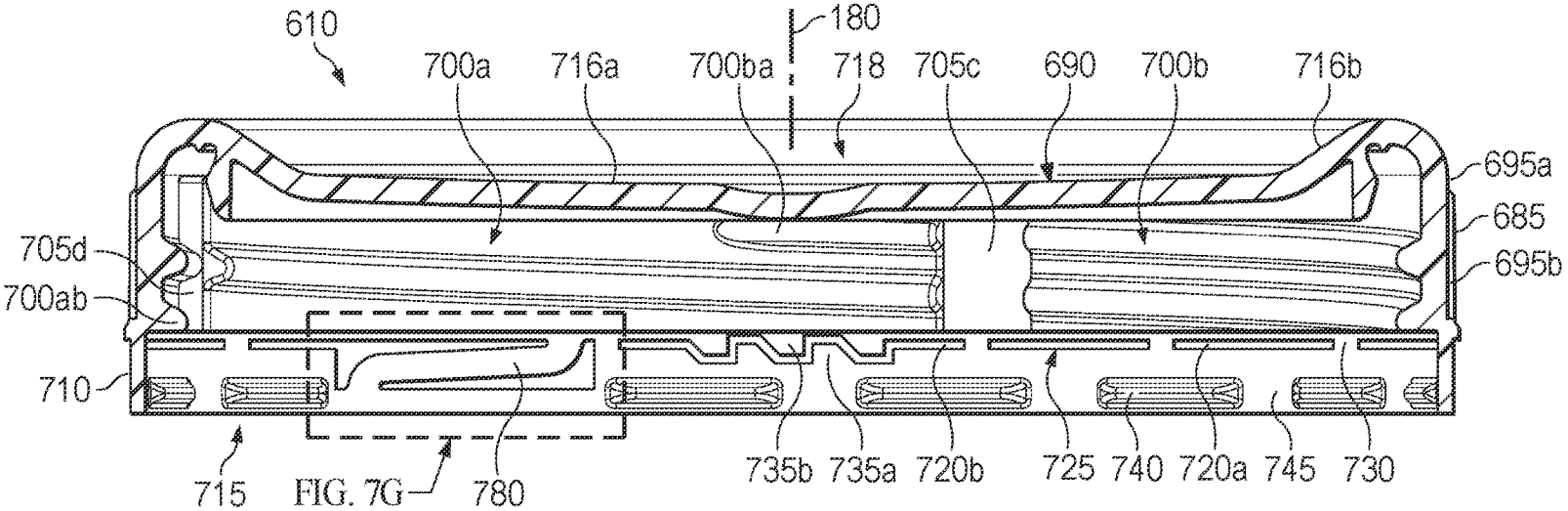

As shown in FIG. 7C-1 and 7C-2, the internal thread 700*a* defines circumferentially opposing end portions 700*aa* (visible in FIG. 7C-1) and 700*ab* (visible in FIG. 7C-2). The end portions 700*aa* and 700*ab* of the thread 700*a* are each tapered. Moreover, the internal thread 700*a* extends spirally along the side wall 685, causing the circumferentially opposing end portions 700*aa* and 700*ab* to be axially and circumferentially spaced apart from each other. The end portion 700*aa* of the thread 700*a* extends relatively closer to the end portion 695*a* of the side wall 685 than the end portion 700*ab* of the thread 700*a*, and the end portion 700*ab* of the thread 700*a* extends relatively closer to the end portion 695*b* of the side wall 685 than the end portion 700*aa* of the thread 700*a*.

Likewise, the internal thread 700*b* defines circumferentially opposing end portions 700*ba* (visible in FIG. 7C-2) and 700*bb* (visible in FIG. 7C-1). The end portions 700*ba* and 700*bb* of the thread 700*b* are each tapered. Moreover, the internal thread 700*b* extends spirally along the side wall 685, causing the circumferentially opposing end portions 700*ba* and 700*bb* to be axially and circumferentially spaced apart from each other. The end portion 700*ba* of the thread 700*b* extends relatively closer to the end portion 695*a* of the side wall 685 than the end portion 700*bb* of the thread 700*b*, and the end portion 700*bb* of the thread 700*b* extends relatively closer to the end portion 695*b* of the side wall 685 than the end portion 700*ba* of the thread 700*b*.

As shown in FIGS. 7B, 7C-1, and 7C-2, a plurality of circumferentially-spaced gaps 705*a-d* are formed axially through the internal threads 700*a-b* and radially into the side wall 685. More particularly, the gap 705*a* defines a circumferential dimension C9, and is formed radially into, and interiorly along, the side wall 685, and axially through: the end portion 700*aa* of the internal thread 700*a*; and a medial portion of the internal thread 700*b* between the opposing end portions 700*ba* and 700*bb*.

The gap 705*b* defines a circumferential dimension C10, and is formed radially into, and interiorly along, the side wall 685, and axially through: a medial portion of the external thread 700*b* between the opposing end portions 700*ba* and 700*bb*. Optionally, the gap 705*b* may also be formed axially through the end portion 700*bb* of the internal thread 700*b*. In one or more embodiments, the circumferential dimensions C9 and C10 are the same.

The gap 705*c* defines a circumferential dimension C11, and is formed radially into, and interiorly along, the side wall 685, and axially through: the end portion 700*ba* of the internal thread 700*b*; and a medial portion of the internal thread 700*a* between the opposing end portions 700*aa* and 700*ab*. In one or more embodiments, the circumferential dimension C11 is the same as the circumferential dimension C9, the circumferential dimension C10, or both.

The gap 705*d* defines a circumferential dimension C12, and is formed radially into, and interiorly along, the side wall 685, and axially through: a medial portion of the external thread 700*b* between the opposing end portions 700*ba* and 700*bb*. Optionally, the gap 705*d* may also be formed axially through the end portion 700*ab* of the internal thread 700*a*. In one or more embodiments, the circumferential dimension C12 is the same as the circumferential dimension C9, the circumferential dimension C10, the circumferential dimension C11, or any combination thereof.

As shown in FIGS. 7A, 7C-1, and 7C-2, the top wall 690 is connected to the side wall 685 at the end portion 695*a* of the side wall 685. A security band 710, having an end portion 711*a* and an end portion 711*b*, is partially, or substantially, detachably connected at end portion 711*a* of the security band 710 to the side wall 685 at the end portion 695*b* of the side wall 685. The security band 710 remains permanently connected to the side wall 685 via a tether 780. As a result, the side wall 685, the top wall 690, and the security band 710, in combination, define an internal region 715. The top wall 690 includes a central portion 716*a* and an outer edge portion 716*b*. In one or more embodiments, at least a portion of the central portion 716*a* is planar. In one or more embodiments, the outer edge portion 716*b* extends circumferentially. The outer edge portion 716*b* connects the central portion 716*a* to the end portion 695*a* of the side wall 685. The central portion 716*a* and at least a portion of the outer edge portion 716*b*, in combination, define an external concavity 718 of the container lid 610.

Perforations 720*a-b* are formed radially through the container lid 610, at a circumferential border 725 between the end portion 711*a* of the security band 710 and the end portion 695*b* of the side wall 685, leaving separable segments 730 interposed between the perforations 720*a-b*, which separable segments 730 detachably connect the end portion 711*a* of the security band 710 to the end portion 695*b* of the side wall 685. The perforations 720*a* are straight. In contrast, the perforations 720*b* are jagged, forming opposing ramps 735*a-b* in the security band 710 and the side wall 685, respectively.

In one or more embodiments, the perforations 720*a-b* include ten (10) straight perforations 720*a* and two (2)

jagged perforations 720*b*, with the two (2) jagged perforations 720*b* circumferentially opposing each other so that six (6) of the straight perforations 720*a* extend circumferentially between the two (2) jagged perforations 720*b* on one side of the container lid 610, and the other four (4) of the straight perforations 720*a* and the tether 780 extending circumferentially between the two (2) jagged perforations 720*b* on the other side of the container lid 610.

In one or more embodiments, the perforations 720*a-b* include ten (10) straight perforations 720*a* and two (2) jagged perforations 720*b*, with the two (2) jagged perforations 720*b* circumferentially opposing each other so that five (5) of the straight perforations 720*a* extend circumferentially between the two (2) jagged perforations 720*b* on one side of the container lid 610, and the other five (5) of the straight perforations 720*a* and the tether 780 extending circumferentially between the two (2) jagged perforations 720*b* on the other side of the container lid 610.

As shown in FIGS. 7B, 7C-1, and 7C-2, internal ridges 740 extend radially inwardly from the security band 710, leaving gaps 745 interposed therebetween. In one or more embodiments, the container security band 710 includes fifteen (15) of the circumferentially-spaced internal ridges 740. In one or more embodiments, the container security band 710 includes ten (10) of the circumferentially-spaced internal ridges 740.

Figure 7D:
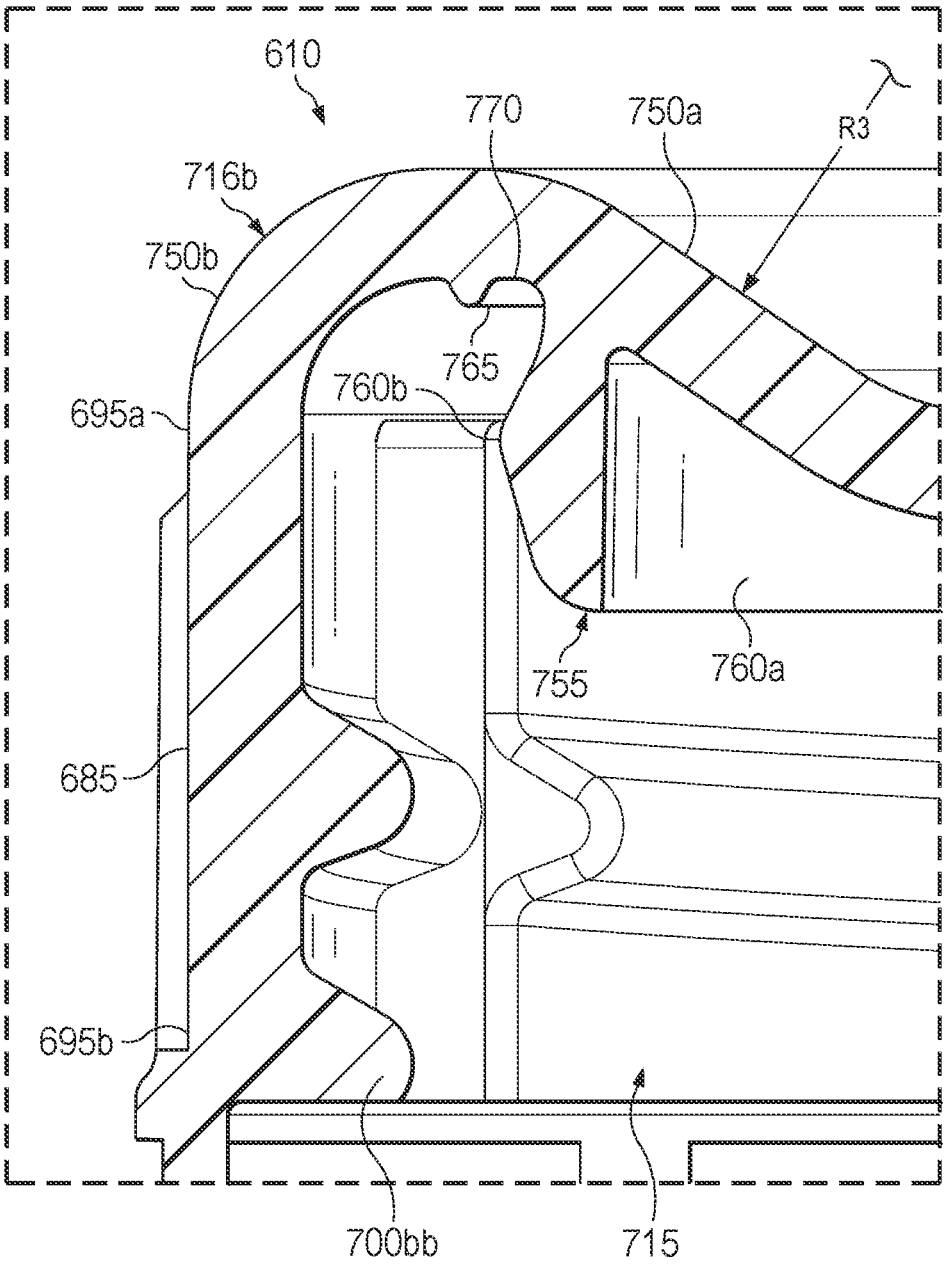
FIG. 7D is an enlarged cross-sectional view of a portion of the container lid of FIG. 7C-1, according to one or more embodiments.
Figure 7E:
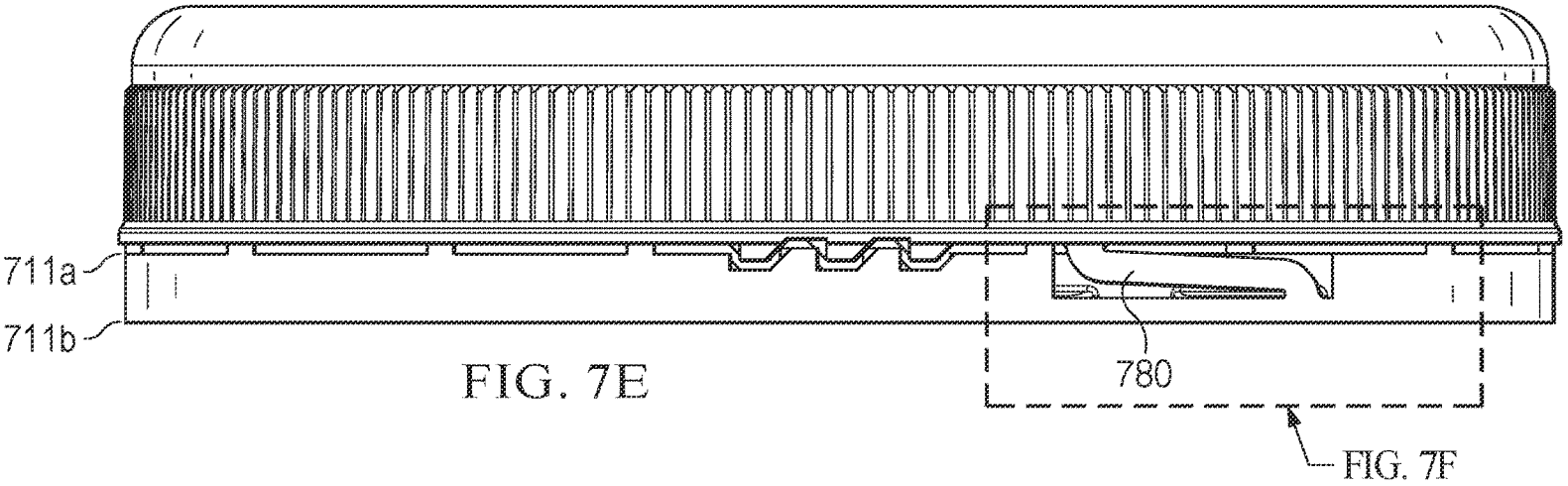
FIG. 7E is a front view of the container lid of FIG. 6, according to one or more embodiments.
Figure 7F:
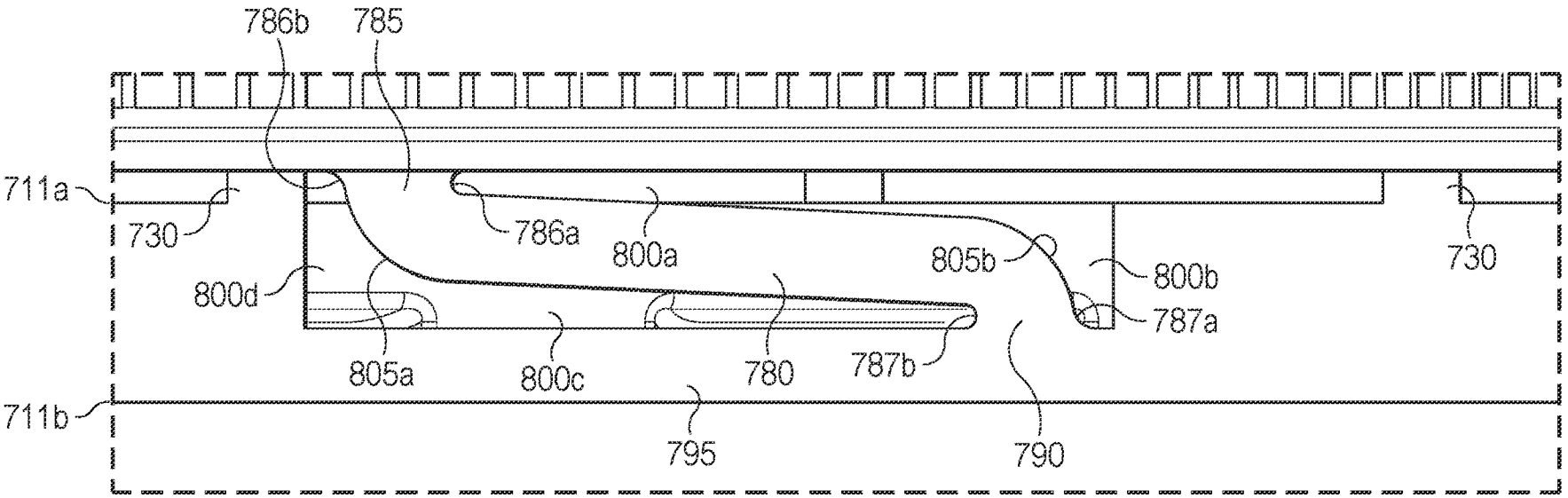
FIG. 7F is an enlarged view of a portion of the container lid identified in FIG. 7E showing the tether, according to one or more embodiments.

As shown in FIG. 7D, the outer edge portion 716*b* of the top wall 690 includes external surfaces 750*a-b*. The external surface 750*a* extends circumferentially, faces radially inwardly, and, in combination with the central portion 716*a* of the top wall 690, defines the external concavity 718 of the container lid 610. In one or more embodiments, at least a portion of the external surface 750*a* is curved. For example, the at least a portion of the external surface 750*a* may define a radius of curvature R3 (shown in FIG. 7D), which radius of curvature R3 is the same as the radius of curvature R1. In addition, or instead, at least a portion of the external surface 750*a* may be frustoconical. In combination, the central portion 716*a* of the top wall 690 of the container lid 610 and the external surface 750*a* of the outer edge portion 716*b* of the top wall 690 of the container lid 610 define, and may be referred to herein as, a "three-dimensional profile"; this three-dimensional profile mirrors the three-dimensional profile defined by the container body 105, as described in detail above.

The external surface 750*b* extends circumferentially and faces radially outwardly. In one or more embodiments, at least a portion of the external surface 750*b* is curved. An internal collar 755 extends inwardly from the outer edge portion 716*b* of the top wall 690, opposite the external surface 750*a*, and into the internal region 715. The internal collar 755 extends circumferentially and includes an internal surface 760*a* and an external bulbous protrusion 760*b*. In one or more embodiments, the internal surface 760*a* is cylindrical. An internal ridge 765 extends inwardly from the outer edge portion 716*b* of the top wall 690, opposite the external surface 750*b*, and into the internal region 715. In addition, or instead, the internal ridge 765 may extend inwardly from the side wall 685 of the container lid 610. The internal ridge 765 extends circumferentially, and, in combination with the internal collar 755, defines an internal annular groove 770 of the container lid 610 (i.e., the internal annular groove 770 extends between the internal collar 755 and the internal ridge 765).

As shown in FIGS. 7A, 7C-2, and 7E-7G, the tether 780 connects the security band 710 to the side wall 685 of the container lid 610. The tether 780 includes a first end portion 785 and a second end portion 790, and is formed within the security band 710 axially between the end portion 711*a* and the end portion 711*b*. The first end portion 785 of the tether is connected to the end portion 695*b* of the side wall 685. The second end portion 790 of the tether is connected to the security band 710 axially between the end portion 711*a* and the end portion 711*b*, so that the second end portion 790 is axially recessed within the security band 710. The second end portion 790 of the tether 780 is connected to the security band 710 along a circumferential extension of the security band 710. The first end portion 785 and the second end portion 790 of the tether are circumferentially spaced apart around the circumference of the security band 710 and/or the circumference of the container lid 610, such that the tether 780 extends along a circumference of the container lid 610. In the embodiment shown, the first end portion 785 of the tether 780 is located circumferentially clockwise relative to the second end portion 790 of the tether 780. As such, when the container lid 610 is rotated counterclockwise relative to the security band 710 and to the container body 105 in order to unscrew (or thread off) the container lid 610 from the container body 105, as will be discussed in more detail below, the tether 780 does not prevent the container lid 610 from rotating relative to the security band 710.

In one or more embodiments, the threads on the container lid 610 and on the container body 105 may be left-hand threads such that the container lid 610 would be unscrewed from the container body 105 by rotating the container lid 610 clockwise. In such embodiment(s), the first end portion 785 of the tether 780 would be located circumferentially counterclockwise relative to the second end portion 790 of the tether 780.

The length of the tether 780 may vary depending on the requirements of the application. Depending on the inner diameter D4 of the sidewall 685 and/or the axial height of the sidewall 685, the length of the tether 780 may vary in order to allow the container lid 610 to be unscrewed and removed from the container body 105. In some embodiments, the tether 780 may extend circumferentially through less than 180 degrees, through less than 120 degrees, through less than 90 degrees, through less than 60 degrees, through less than 45 degrees, or through less than 30 degrees. As will be discussed in more detail below, the length of the tether 780 is optimized to enable the container lid 610 to be removed from the container body 105 while remaining connected via the tether 780 to the security band 710.

The tether 780 is defined by perforations 800*a-d* in the security band 710. The perforations 800*a-d* extend radially through the security band 710. The perforation 800*a* extends circumferentially along the circumferential border 725 between the end portion 711*a* of the security band 710 and the end portion 695*b* of the side wall 685 and in series with the perforations 720*a* (i.e., at the same axial height as the perforations 720*a*). The perforation 800*a* extends circumferentially between an edge 786*a* of the first end portion 785 of the tether 780 that is circumferentially closest to the second end portion 790 of the tether 780 and the separable segment 730 that is circumferentially closest to the edge 786*a* in the counterclockwise direction.

The perforation 800*b* extends transversely to the perforation 800*a*. The perforation 800*b* extends axially along the security band 710 between the circumferential border 725 and an edge 787*a* of the second end portion 790 of the tether 780. In the embodiment shown, the perforation 800*a* and the perforation 800*b* form a generally L-shaped perforation that partially defines the tether 780.

The perforation 800*c* extends circumferentially along the security band 710 at the same axial height as the second end portion 790 of the tether. The perforation 800*c* extends from an edge 787*b* of the second end portion 790 of the tether 780 circumferentially at least until the perforation 800*c* is circumferentially aligned with an edge 786*b* of the first end portion 785 of the tether 780.

The perforation 800*d* extends transversely to the perforation 800*c*. The perforation 800*d* extends axially along the security band 710 between the perforation 800*c* and the edge 786*b* of the first end portion 785 of the tether 780. The perforation 800*d* is circumferentially spaced from the perforation 800*b*. In the embodiment shown, the perforation 800*d* and the perforation 800*c* form a generally L-shaped perforation that partially defines the tether 780.

As shown in FIGS. 7A, 7C-2, and 7E-7G, the width of the tether 780 is consistent from the first end portion 785 to the second end portion 790. In one or more embodiments, the tether 780 may taper from the first end portion 785 to the second end portion 790, such that the first end portion 785 is wider than the second end portion 790, or the tether 780 may taper from the second end portion 790 to the first end portion 785, such that the second end portion 790 is wider than the first end portion 785. In one or more embodiments, as discussed above, the length of the tether 780 may be made shorter or longer depending on the application. The length of the tether 780 may be changed by increasing or decreasing the circumferential locations, or offset, of the first end portion 785 and the second end portion 790 of the tether 780.

As discussed above, the tether 780 is formed within the security band 710. The depth that the tether 780 is recessed axially within the security band 710 is directly related to the width of the tether 780. The wider the tether 780, the further the tether 780 extends axially with the security band 710. The width of the tether 780 is thus also directly related to the axial height of a portion 795 of the security band 710 remaining between the perforation 800*c* and the end portion 711*b* of the security band 710. The portion 795 of the security band 710 remains intact when the separable segments 730 are broken so that the security band 710 remains intact and remains on the container body 105 and under the external collar 155 of the container body 105, as will be discussed in more detail below.

The axial height of the security band 710, the width of the tether 780, and the axial height of the portion 795 of the security band 710 are optimized such that: the tether 780 has sufficient strength to support the container lid 610 and maintain a connection between the container lid 610 and the security band 710 without breaking when the separable segments are broken and the container lid 610 is removed from the container body 105 with the security band 710 still attached to the container body 105; and such that the portion 795 of the security band 710 has sufficient strength to keep the security band 710 together and intact on the container body 105 without breaking.

In one or more embodiments, the width of the tether 780 is equal to the axial height of the portion 795 of the security band 710. In one or more embodiments, the width of the tether 780 and the axial height of the portion 795 of the security band 710 are approximately half the axial height of the security band 710. In one or more embodiments, the width of the tether 780 is approximately 25 percent, 30 percent, 35 percent, 40 percent, 45 percent, 50 percent, 55 percent, 60 percent, 65 percent, 70 percent, or 75 percent of the axial height of the security band 710, and the axial height of the portion 795 of the security band 710 is approximately 75 percent, 70 percent, 65 percent, 60 percent, 55 percent, 50 percent, 45 percent, 40 percent, 35 percent, 30 percent, or 25 percent of the axial height of the security band 710, respectively, such that the sum of the width of the tether 780 and the axial height of the portion 795 of the security band 710 is approximately equal to the axial height of the security band 710.

In the embodiment shown, there are no separable segments 730 directly connecting the tether 780 to the end portion 695*b* of the side wall 685, or directly connecting the tether 780 to the portion 795 of the security band 710. In one or more embodiments, there are separable segments 730 directly connecting the tether 780 to the end portion 695*b* of the side wall 685 and/or directly connecting the tether 780 to the portion 795 of the security band 710 such that when the container lid 610 is opened for the first time, the tether 780 is peeled away, or broken free, from the security band 710 as the separable segments 730 are broken.

In one or more embodiments, edges 805*a* and 805*b* of the tether 780, located at the intersections of the perforations 4*a* and 4*b*, and the perforations 4*c* and 4*d*, respectively, are rounded so that the tether 780 does not have sharp edges/corners when the container lid 610 is opened and the tether 780 is exposed.

In one or more embodiments, the first end portion 785 and the second end portion 790 of the tether 780 are circumferentially aligned when the separable segments 730 are unbroken. In such embodiments, the tether 780 is folded in half such that the tether 780 extends from the first end portion 785 circumferentially in the clockwise, or counterclockwise, direction and then curves 180 degrees and extends back in the opposite direction, at the same radial distance from axis 180 but axially closer to the end portion 711*b* of the security band 710, and terminates at the second end portion 790 of the tether 780. In such embodiment(s), when the container lid 610 is unscrewed and the separable segments 730 are broken, the tether 780 is able to unfold and straighten out.

As shown in FIG. 7C-2, there are no internal ridges 740 within the circumferential section where the tether 780 is located. There are no internal ridges 740 extending along the portion 795 of the security band 710. This allows the portion 795 of the security band 710 to have greater more flexibility while the container lid 610 is being unscrew and tension is applied to the tether 780, as will be described in more detail below. In one or more embodiments, however, there may be internal ridges 740, or modified versions thereof, located on and extending along the portion 795 of the security band 710. The presence of the additional internal ridges 740 would aid in the retention of the security band 710 on the container body 105.

The security band 710 may also be described as having a cutout section within which the tether 780 is located. The cutout section is rectangular and extends radially through the security band 710. The cutout section extends circumferentially around a portion of the security band 710 and axially from the end portion 711*a* through a portion of the axial height of the security band 710. The tether 780 is connected to the container lid 610 at one end of the cutout, and the tether 780 is connected to the security band 710, or more specifically to the portion 795 of the security band 710, at the other end of the cutout.

In one or more embodiments, the container lid 610 is made of the same resin material as the container body 105. Alternatively, the container lid 610 may be made of a different resin material than the container body 105. In one or more embodiments, the container lid 610 is made of an appropriate plastic/synthetic resin, such as, for example, polyethylene terephthalate (PET) resin. In addition, or instead, the container lid 610 may be or include polyamide resin, polycarbonate resin, polyacetal resin, polybuthylene terephthalate resin, another synthetic resin having a sufficient resistance to chemicals, the like, or any combination thereof. In one or more embodiments, the container lid 610 is made of recyclable plastic. In one or more embodiments, the container lid 610 and the container body 105 are both made of recyclable plastic. In one or more embodiments, the container lid 610 may be formed by molding process(es), such as, for example, biaxial orientation blow molding process(es), direct blow molding process(es), injection blow molding process(es), other molding process(es), the like, or any combination thereof.

Figure 7G:
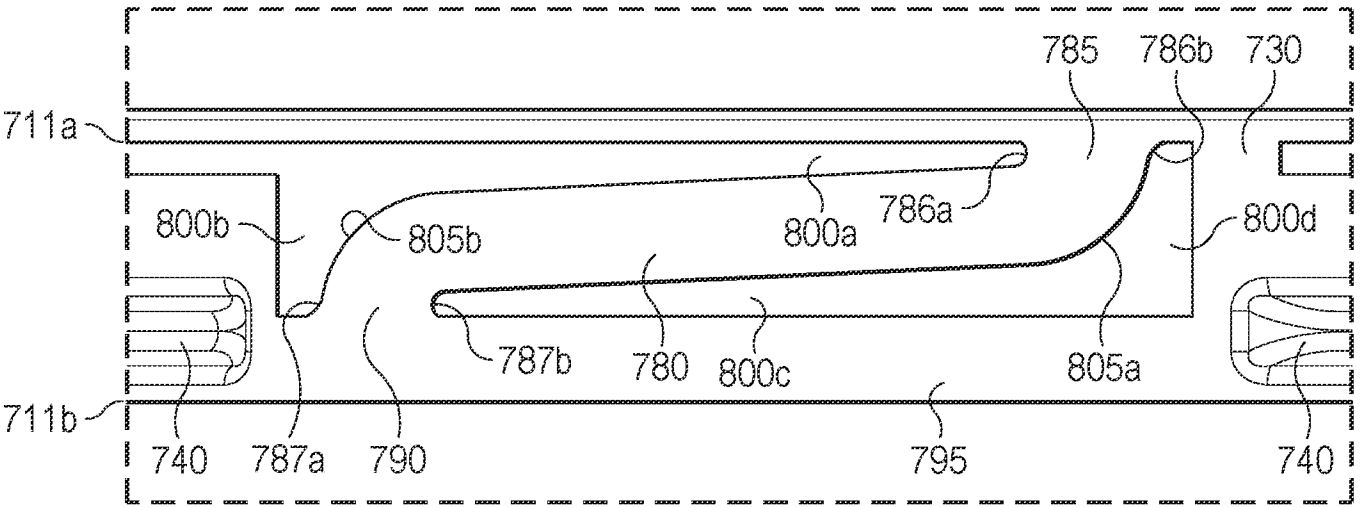
FIG. 7G is an enlarged cross-sectional view of a portion of the container lid identified in FIG. 7C-2 showing the tether, according to one or more embodiments.

Referring to FIGS. 6 through 7G, the container lid 610 is shown in a first configuration in which it is attached to the security band 710, with the separable segments 730 unbroken, and in which the container lid 610 is not yet attached to the container body 105. In FIGS. 8A through 9B, the container lid 610 is shown in a second configuration in which it is attached to the security band 710, with the separable segments 730 unbroken, and in which the container lid 610 is attached to the container body 105. In FIGS. 9C through 9G, the container lid 610 is shown in a third configuration in which the separable segments 730 between the container lid 610 and the security band 710 are broken such that the container lid 610 can be removed from the container body 105 while remaining connected to the security band 710, which remains on the container body 105, via the tether 780.

Figure 8A:
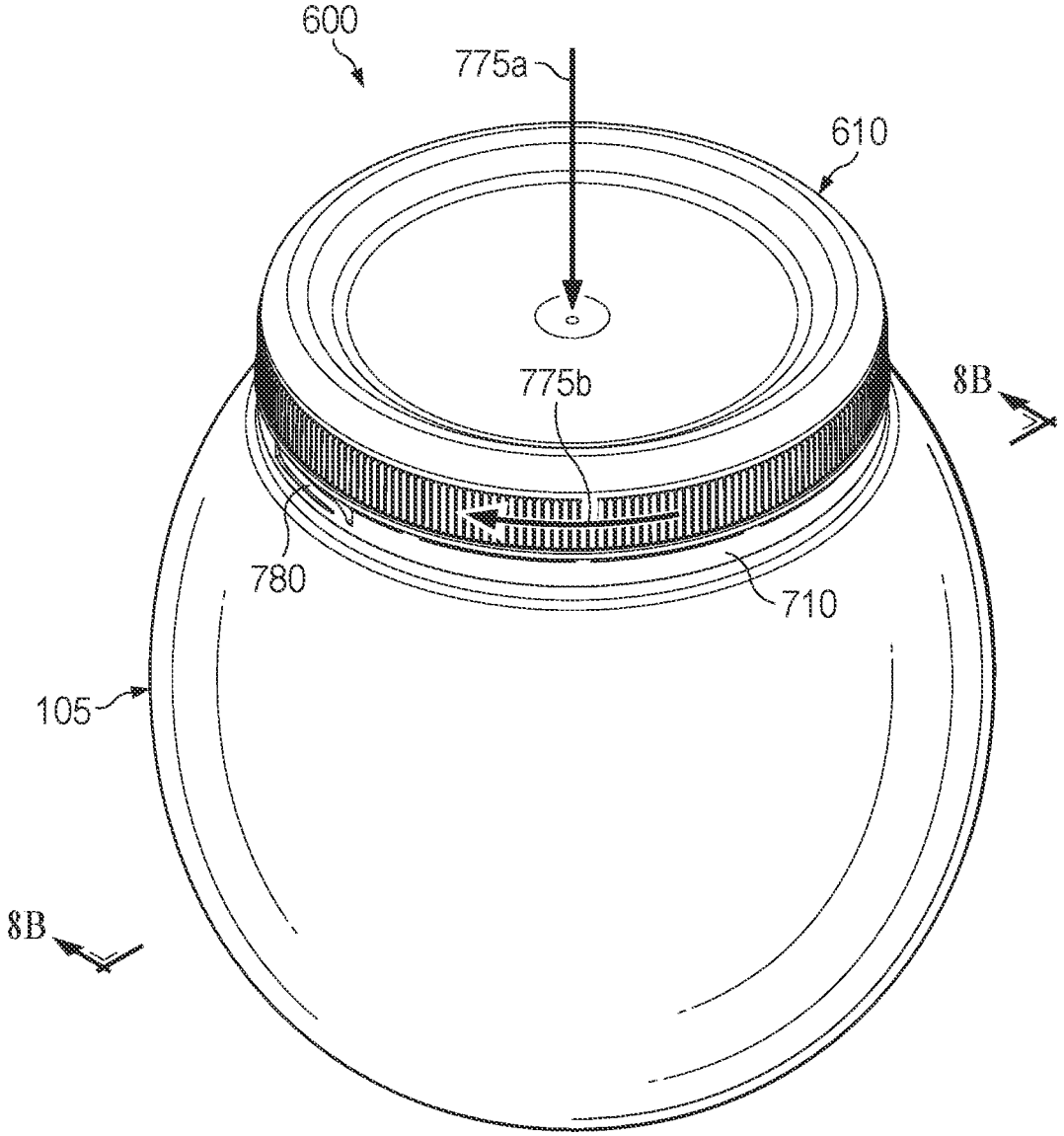
FIG. 8A is a top-front-left perspective view of the third container apparatus of FIG. 6 in a second operational state or configuration, according to one or more embodiments.
Figure 8B:
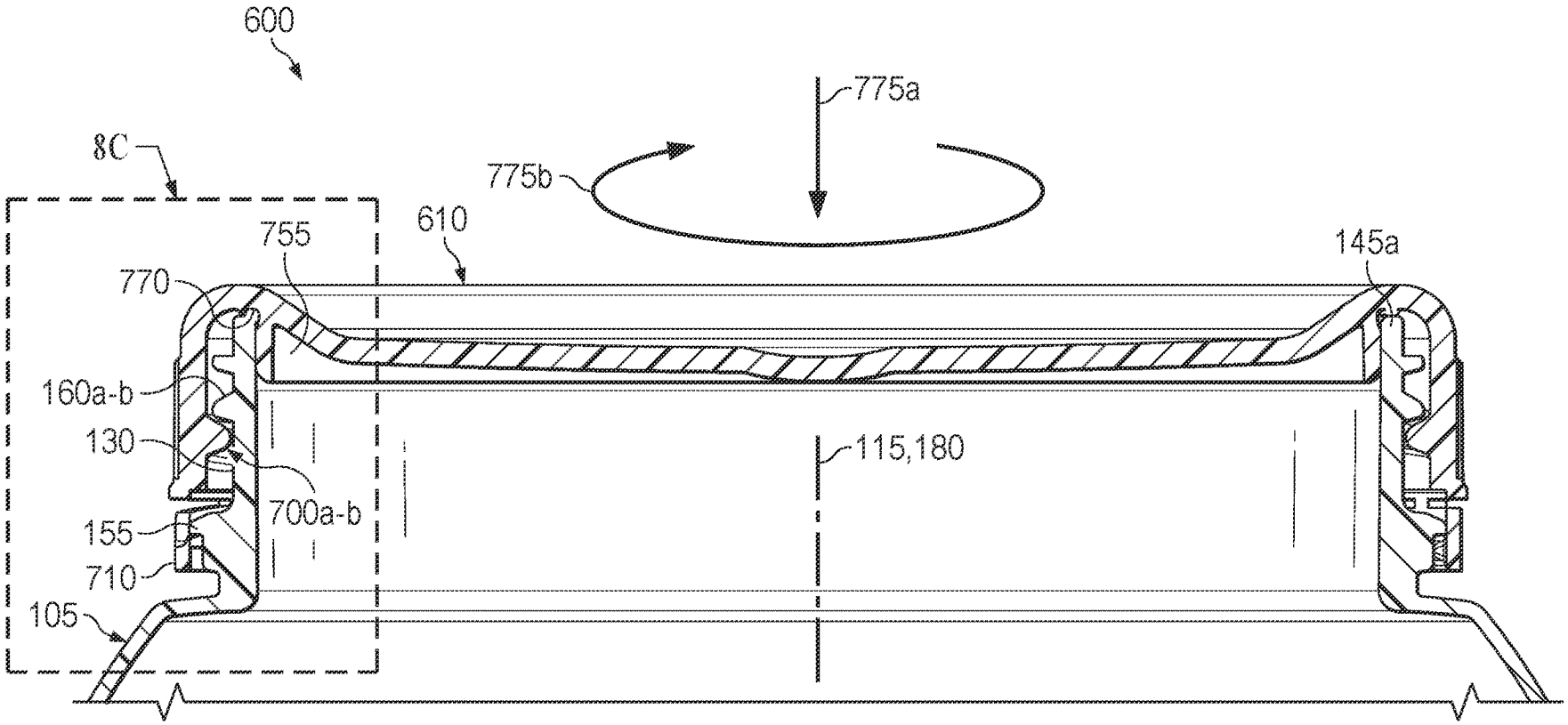
FIG. 8B is a cross-sectional view of the third container apparatus of FIG. 8A taken along the line 8B-8B of FIG. 8A, according to one or more embodiments.
Figure 8C:
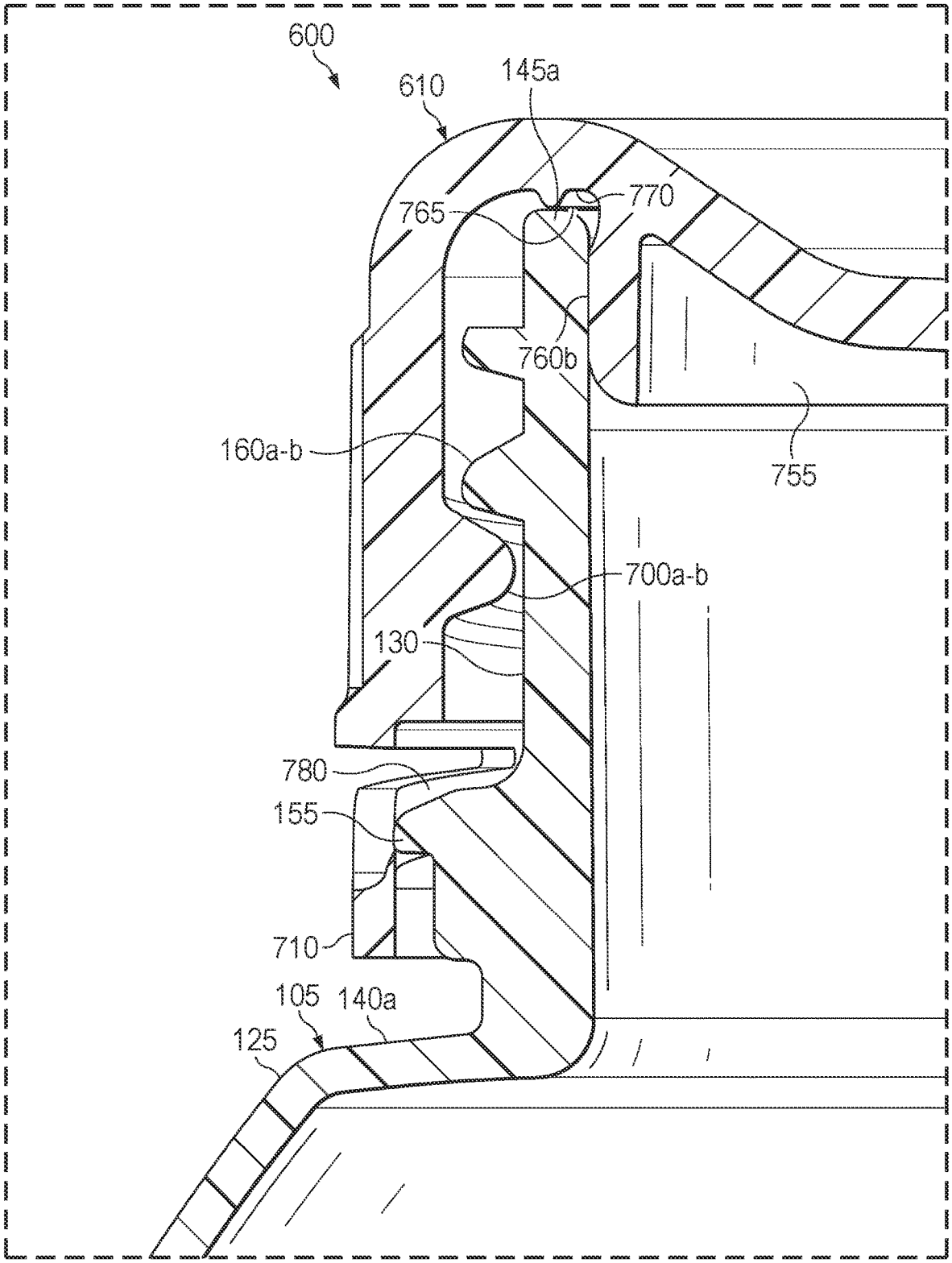
FIG. 8C is an enlarged cross-sectional view of a portion of the third container apparatus of FIG. 8B, according to one or more embodiments.

Referring to FIGS. 8A through 8C, with continuing reference to FIGS. 6 through 7G, in an embodiment, in operation, the container lid 610 is attachable to the container body 105 by threading the container lid 610 onto the neck 130 of the container body 105, as indicated by arrows 775*a-b* in FIGS. 8A and 8B. In addition, or instead, the container lid 610 may be attachable to the container body 105 using another attachment mechanism, such as, for example, "snap-on" feature(s), locking feature(s), other attachment feature(s), the like, or any combination thereof. In any case, once so attached, the container lid 610 is detachable from, and re-attachable to, the container body 105, as shown in FIGS. 9A through 9G, as discussed in further detail below. More particularly, to attach (or re-attach) the container lid 610 to the container body 105, the end portion 145*a* of the neck 130 of the container body 105 is received within the internal region 715 of the container lid 610 so that the internal threads 700*a-b* of the container lid 610 are engaged with the external threads 160*a-b* of the container body 105. Once so engaged, the container lid 610 is rotated relative to the container body 105 so that the end portions 700*ab* and 700*bb* (shown in FIGS. 7C-1 and 7C-2) of the internal threads 700*a-b* of the container lid 610 are received under, and engaged by, the end portions 160*aa* and 160*ba* (shown in FIGS. 2C-1 and 2C-2) of the external threads 160*a-b* of the container body 105. Once the end portions 700*ab* and 700*bb* of the internal threads 700*a-b* of the container lid 610 are so received under, and engaged by, the end portions 160*aa* and 160*ba* of the external threads 160*a-b* of the container body 105, continued rotation of the container lid 610 relative to the container body 105 threads the container lid 610 onto the container body 105 via sliding engagement between internal threads 700*a-b* of the container lid 610 and the external threads 160*a-b* of the container body 105. Although shown as being threaded onto the container body 105 in the clockwise direction, in one or more embodiments, the threads of the container lid 610 and the threads of the container body 105 are instead each spirally formed in the opposite direction so that the container lid 610 threads onto the container body 105 in a counter-clockwise direction.

In some embodiments, continued threading of the container lid 610 onto the container body 105 causes an end face defined by the end portion 145*a* of the neck 130 of the container body 105 to engage (e.g., sealingly) a portion of the container lid 610 defined by the internal annular groove 770. In addition, or instead, continued threading of the container lid 610 onto the container body 105 causes the internal collar 755 to move toward the end portion 145*a* of the neck 130 of the container body 105, eventually causing the end portion 145*a* of the neck 130 of the container body 105 to be received within the internal annular groove 770 of the container lid 610 so that one or both of the external bulbous protrusion 760*b* of the internal collar 755 and the internal ridge 765 of the container lid 610 engage(s) (e.g., sealingly) the end portion 145*a* of the neck 130 of the container body 105.

More particularly, in one or more embodiments, as the end portion 145*a* of the neck 130 of the container body 105 is received into the internal annular groove 770 of the container lid 610, the internal collar 755 flexes radially inwardly, thereby applying a radially-outward recoil force against the inside of the neck 130 at the end portion 145*a*, which radially-outward recoil force engages (e.g., sealingly) the external bulbous protrusion 760*b* of the internal collar 755 with the inside of the neck 130 at the end portion 145*a*. In such embodiment(s), the engagement between the external bulbous protrusion 760*b* of the internal collar 755 and the inside of the neck 130 at the end portion 145*a* facilitates (optionally, in combination with the engagement between the internal ridge 765 of the container lid 610 and the outside of the neck 130 at the end portion 145*a*, discussed below) the sealing of gas pressure within the internal cavity 120 of the container body 110 from atmosphere, even though the first ratio of the outer diameter D1 of the neck 130 to the outer diameter D2 of the side wall 125 is: greater than or equal to 1:2; greater than or equal to 1:2 and less than or equal to 7:8; greater than or equal to 1:2 and less than or equal to 3:4; greater than or equal to 2:3; greater than or equal to 2:3 and less than or equal to 7:8; or greater than or equal to 2:3 and less than or equal to 3:4.

In addition, or instead, in one or more embodiments, as the end portion 145*a* of the neck 130 of the container body 105 is received into the internal annular groove 770 of the container lid 610, the internal ridge 765 of the container lid 610 flexes radially outwardly, thereby applying a radially-inward recoil force against the outside of the neck 130 at the end portion 145*a*, which radially-inward recoil force engages (e.g., sealingly) the internal ridge 765 of the container lid 610 with the outside of the neck 130 at the end portion 145*a*. In such embodiment(s), the engagement between the internal ridge 765 of the container lid 610 and the outside of the neck 130 at the end portion 145*a* facilitates (optionally, in combination with the sealing engagement between the external bulbous protrusion 760*b* of the internal collar 755 and the inside of the neck 130 at the end portion 145*a*) the sealing of the gas pressure within the internal cavity 120 of the container body 105 from atmosphere, even though the third ratio of the inner diameter D4 of the side wall 685 of the container lid 610 to the outer diameter D2 of the side wall 125 of the container body 105 is: greater than or equal to 1:2; greater than or equal to 1:2 and less than or equal to 7:8; greater than or equal to 1:2 and less than or equal to 3:4; greater than or equal to 2:3; greater than or equal to 2:3 and less than or equal to 7:8; or greater than or equal to 2:3 and less than or equal to 3:4.

Continued threading of the container lid 610 onto the container body 105 also causes the security band 710 to move toward the external collar 155 of the container body 105, eventually causing the internal ridges 740 of the security band 710 to slide over and past the external collar 155, thereby trapping the security band 710 of the container lid 610 between the end portion 140*a* of the side wall 125 and the external collar 155 of the container body 105. In one or more embodiments, the tether 780 is located entirely below the external collar 155 of the container body 105 when the container lid 610 is in the second configuration. In one or more embodiments, a portion of the tether 780 extends across, or over, the external collar 155 of the container body 105.

In several embodiments, a fluid, such as a beverage for human consumption, is disposed within the internal cavity 120 of the container body 105; in some embodiments, one or more of the above-described sealing engagements seal gas pressure within the internal cavity 120 of the container body 105 from atmosphere. In several embodiments, a fluid, such as wine such as flavored wine, is disposed within the internal cavity 120 of the container body 105; in some embodiments, one or more of the above-described sealing engagements seal gas pressure within the internal cavity 120 of the container body 105 from atmosphere.

Figure 9A:
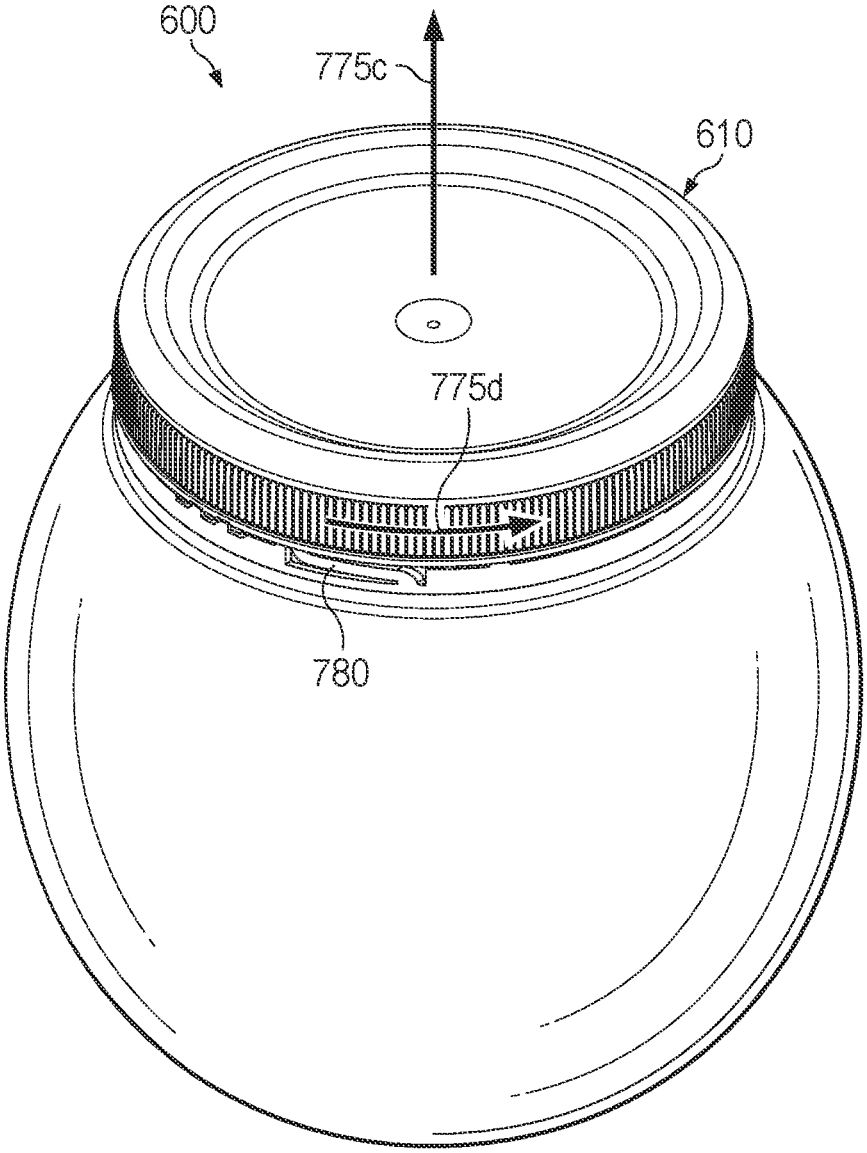
FIG. 9A is another top-front-left perspective view of the third container apparatus of FIG. 6 in the second operational state or configuration, according to one or more embodiments.
Figure 9B:
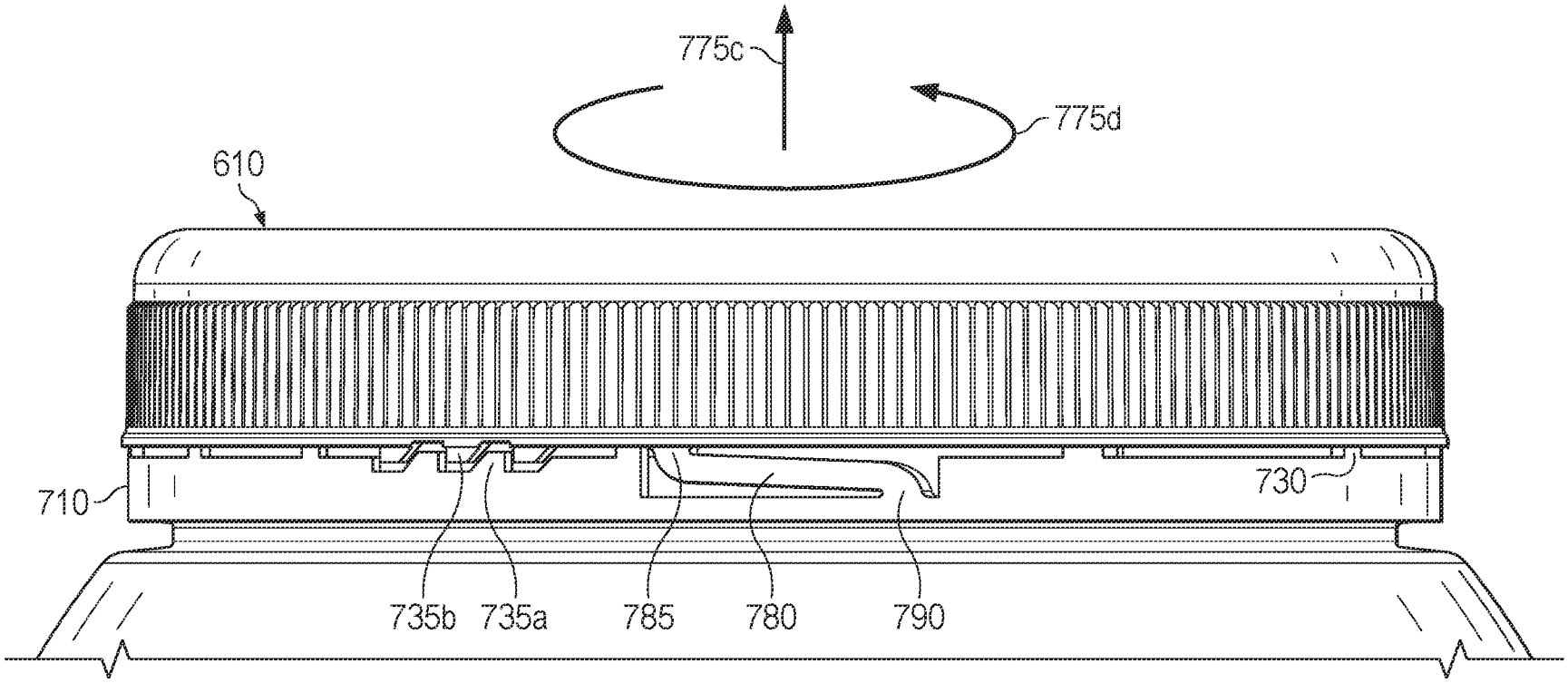
FIG. 9B is a front view of the third container apparatus of FIG. 6 in the second operational state or configuration, according to one or more embodiments.

Referring to FIGS. 9A through 9G, with continuing reference to FIGS. 8A through 8C, the threading off of the container lid 610 from the container body 105 is shown. FIGS. 9A and 9B show the container lid 610 in the second configuration prior to being threaded off of the container body 105. The separable segments 730 are unbroken and the ramp 735*a* of the security band 710 is not yet engaged with the ramp 735*b* of the side wall 685 of the container lid 610. In order to begin threading the container lid 610 off of the container body 105, the container lid 610 is rotated in the direction indicated by arrow 775*d*.

Figure 9C:
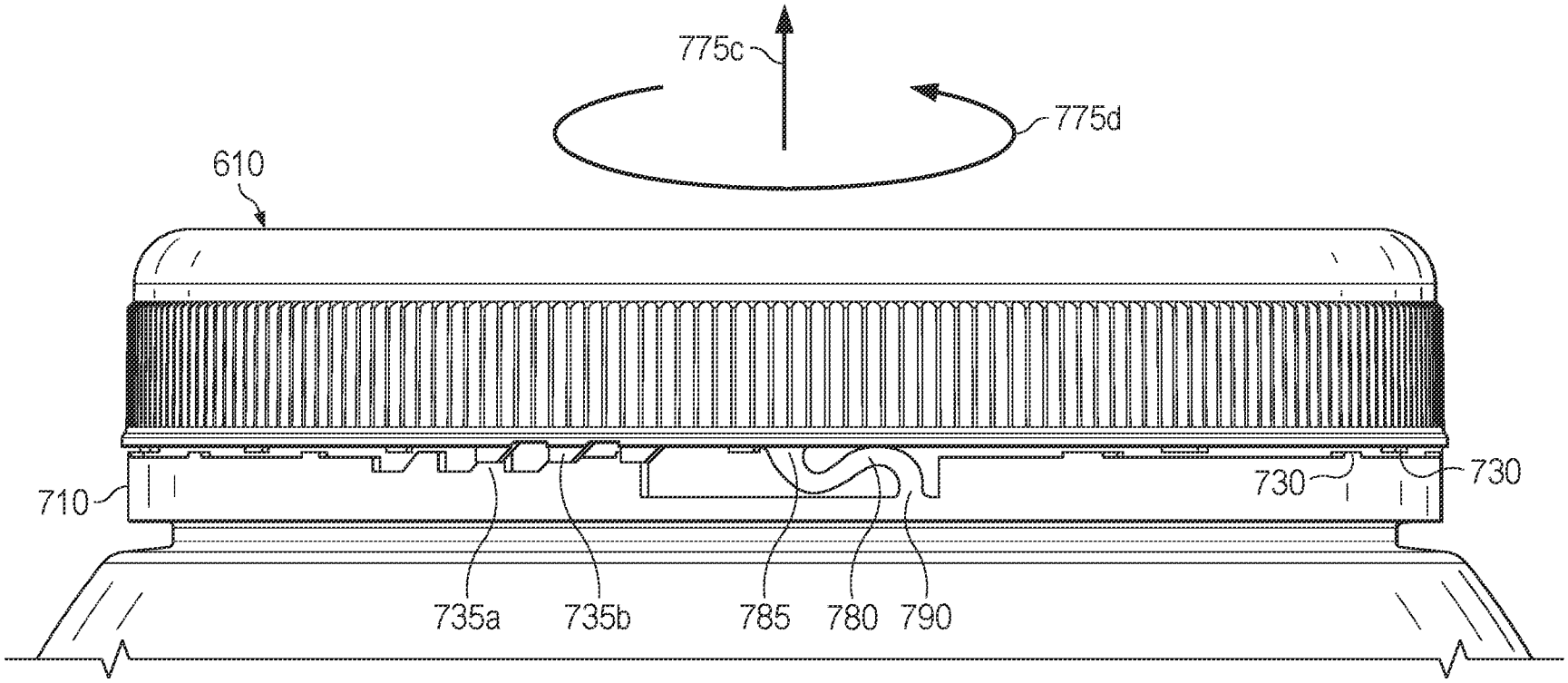
FIG. 9C is a front view of the third container apparatus of FIG. 6 in a third operational state or configuration, according to one or more embodiments.
Figure 9D:
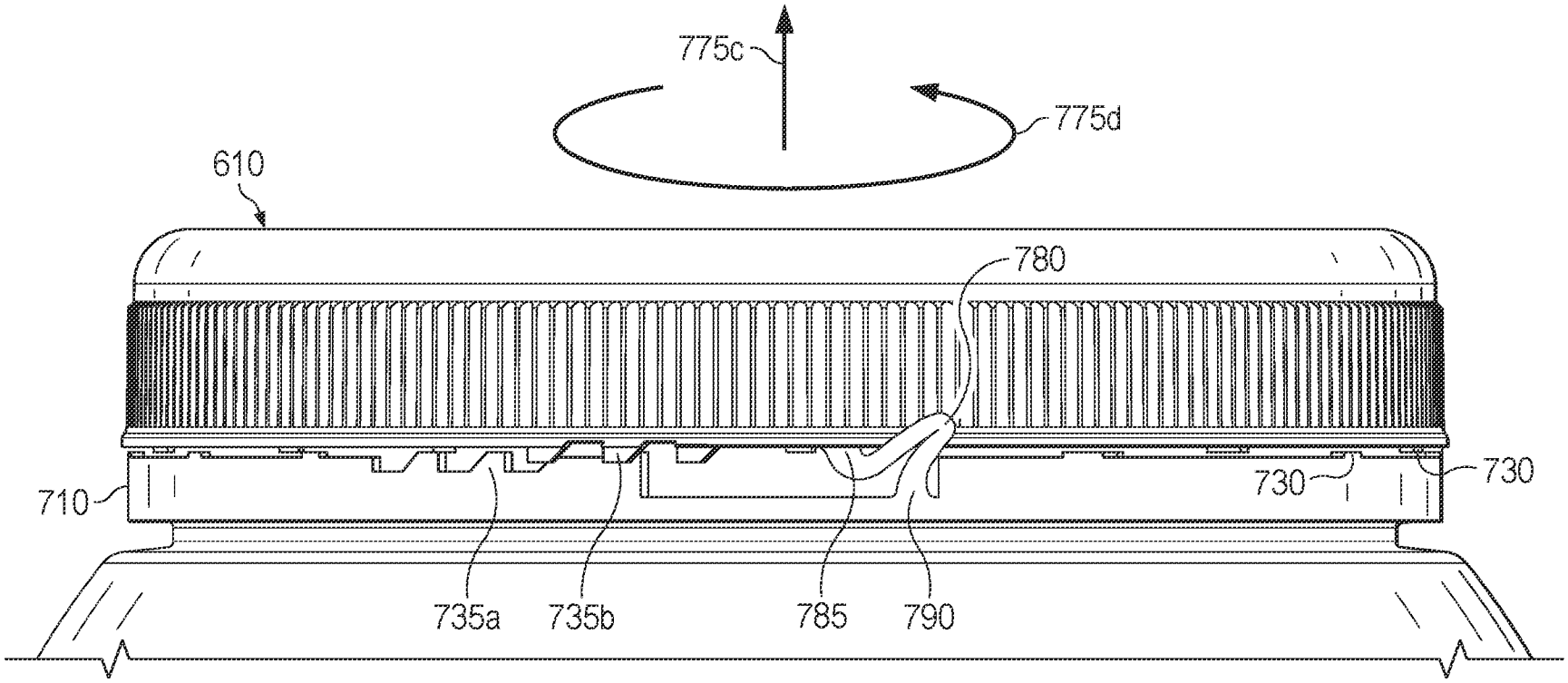
FIG. 9D is another front view of the third container apparatus of FIG. 6 in the third operational state or configuration, according to one or more embodiments.

FIGS. 9C and 9D show the container lid 610 in the third configuration as it is being threaded off of the container body 105. The trapping of the security band 710 between the end portion 140*a* of the side wall 125 and the external collar 155 of the container body 105 causes the internal ridges 740 of the security band 710 to contact the external collar 155 of the container body 105 when the container lid 610 is subsequently threaded off of the container body 105 (i.e., by rotating the container lid 610 in a direction opposite the direction 775*b* and relative to the container body 105). As a result of such threading off of the container lid 610 off of the container body 105, the internal ridges 740 of the security band 710 contact the external collar 155 of the container body 105, applying a tensile force to the separable segments 730 separably connecting the container lid 610 to the security band 710.

Rotational friction between the internal ridges 740 of the security band 710 and the external collar 155 causes relative rotation between the side wall 685 of the container lid 610 and the security band 710, which relative rotation causes the ramp 735*a* of the security band 710 to be engaged by the ramp 735*b* of the side wall 685 (the ramps 735*a-b* are shown in FIGS. 7A, 7C-1, 7C-2, 8A, and 9B through 9D).

Continued threading of the container lid 610 off of the container body 105 causes continued relative rotation between the side wall 685 of the container lid 610 and the security band 710. The continued relative rotation causes the ramp 735*b* of the side wall 685 to slide along the ramp 735*a* of the security band 710, thereby axially separating the container lid 610 from the security band 710 by breaking the separable segments 730 separably connecting the container lid 610 to the security band 710, as indicated by arrows 775*c-d* in FIGS. 9A through 9E. Once so axially separated, the security band 710 remains axially trapped between the end portion 140*a* of the side wall 125 and the external collar 155 of the container body 105, as shown in FIGS. 9E and 9F.

As further shown in FIGS. 9C and 9D, as the container lid 610 is threaded off the container body 105, the relative rotation of the container lid 610 to the security band 710 causes the tether 780 to bend, deform, or scrunch-up, as the circumferential offset of the first end portion 785 and the second end portion 790 of the tether is reduced (i.e., as the first end portion 785 of the tether 780 is rotated toward the second end portion 790 of the tether 780). The tether 780 is flexible enough bend without breaking in order to allow the container lid 610 to be threaded off of the container body 105.

In one or more embodiments, once the separable segments 730 are broken, the internal ridges 740 are no longer forced against the external collar 155. At this point, only the tether 780 remains attached to the security band 710 and able to act on the security band 710. Thus, without any other external forces applied, the security band 710 will rotate relative to the container lid 610 so that the tether 780 returns to an unloaded and unbent state.

Figure 9E:
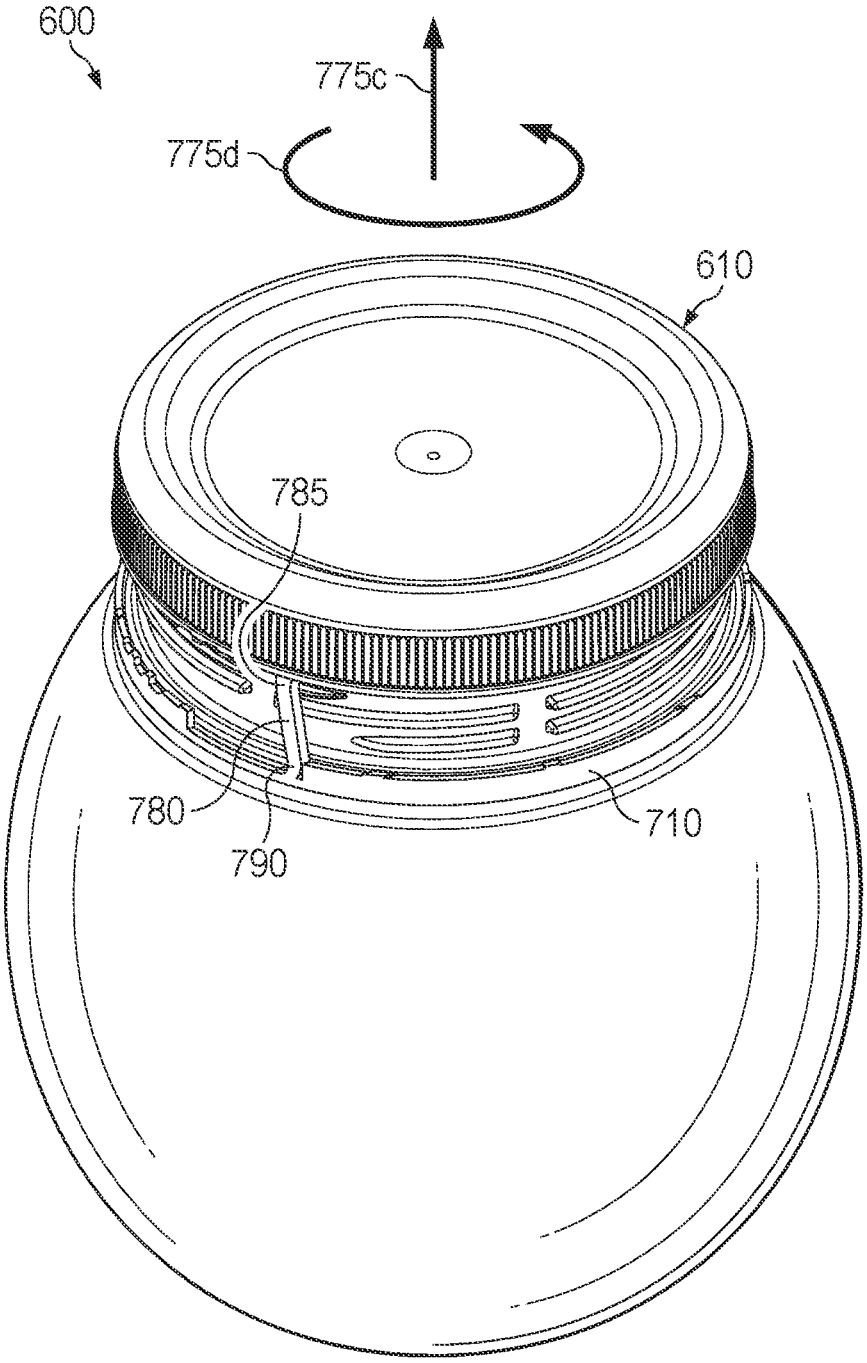
FIG. 9E is a top-front-left perspective view of the third container apparatus of FIG. 6 in the third operational state or configuration, according to one or more embodiments.
Figure 9F:
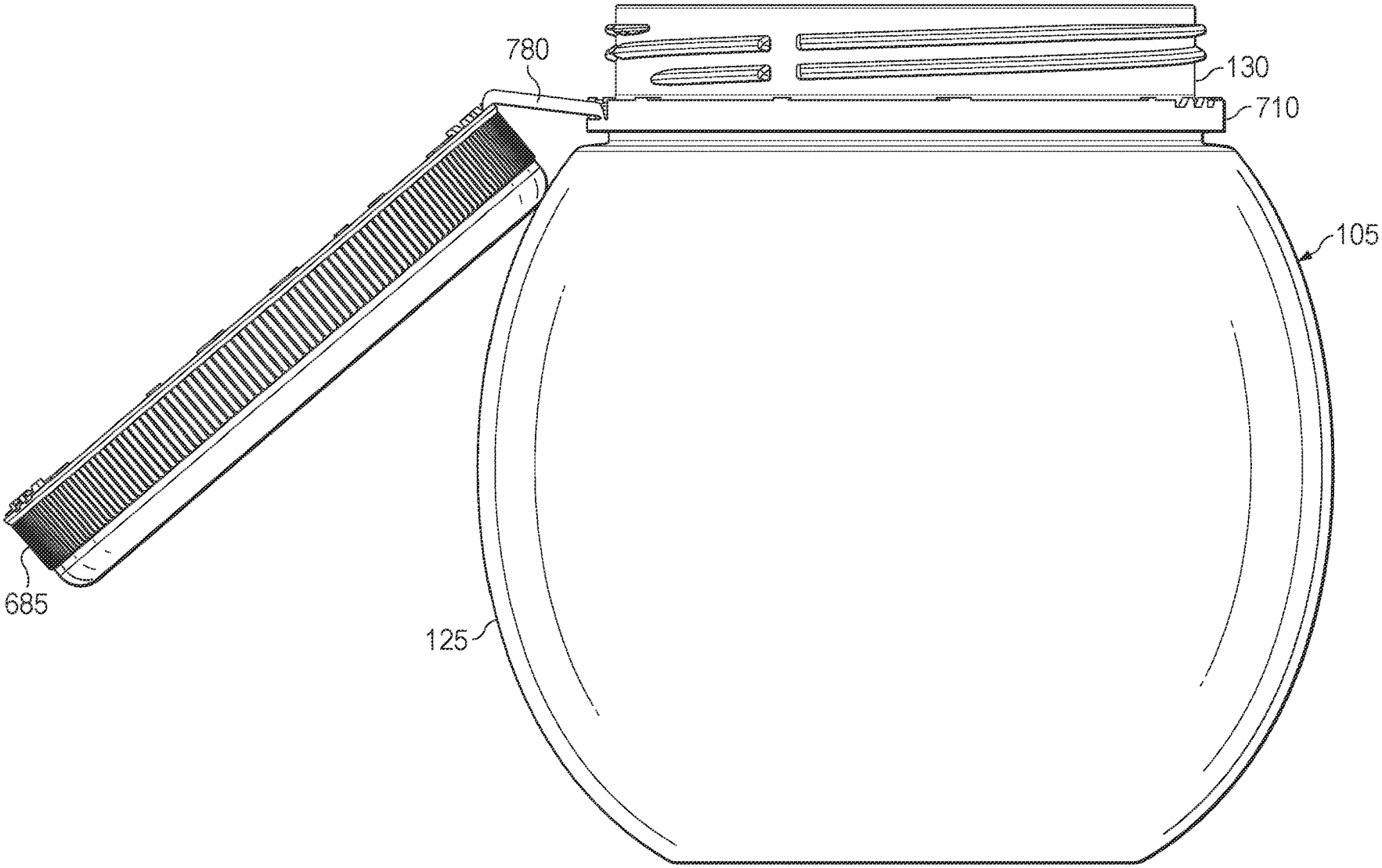
FIG. 9F is a front view of the third container apparatus of FIG. 6 in the third operational state or configuration, according to one or more embodiments.

FIG. 9E shows the container lid 610 further threaded off of the container body 105 and further axially spaced from the security band 710. The container lid 610 remains connected to the security band 710 via the tether 780. As shown in FIG. 9E, the tether 780 now extends substantially transverse to the circumferential extension of the side wall 685 of the container lid 610 and of the security band 710, and substantially parallel to the direction of extension of the central axis 180 (shown in FIGS. 7A through 7C-2). The length of the tether 780 is optimized such that the tether 780 is just long enough to allow the container lid 610 to be completely unthreaded and removed from the container body 105. At the point where the internal threads 700*a-b* of the container lid completely disengage from the external threads 160*a-b* of the container body 105, the axial separation of the container lid 610 from the security band 710 should cause the tether 780 to be substantially straight, extending in the direction of the central axis 180, with the first end portion 785 and the second end portion 790 of the tether 780 substantially aligned circumferentially and axially.

FIG. 9F shows the container lid 610 completely removed from the neck 130 of the container body 105. Once the internal threads 700*a-b* of the container lid completely disengage from the external threads 160*a-b* of the container body 105, the container lid 610 can be removed from, or pivoted off of, the neck 130 of the container body 105. When the container lid 610, or a portion thereof, is detached from the neck 130 of the container body 105, the detached portion of the container lid 610 remains connected to the security band 710 via the tether 780, and the security band 710 remains attached to the container body 105 as it remains axially trapped between the end portion 140*a* of the side wall 125 and the external collar 155 of the container body 105. As a result, when the container lid 610, or a portion thereof, is detached from the neck 130 of the container body 105, the container lid 610 remains coupled to the container body 105 via the connection of the container lid 610 to the security band 710 via the tether 780 and via the attachment of the security band 710 to the container body 105. Thus, when the container lid 610 is removed from the neck 130 of the container body 105, the container lid 610 hangs down along the side wall 125 of the container body 105. The length of the tether 780 prevents the container lid 610 from extending below the bottom wall 135 of the container body 105 (i.e., so that the container lid 610 does not touched the ground or such other surface that the container 600 may be sitting on). This ensures the container lid 610 stays clean and sanitary if it is to be reattached to the container body 105 or in case it comes in contact with the user as the user drinks from the container body 105.

In one or more embodiments, it may be desirable for the container lid 610 to serve as a coaster when removed from the container body 105. In such embodiment(s), the tether 780 may be longer such that the container lid 610 is capable of being axially aligned below the container body 105 so that the top wall 690 of the container lid 610 is adapted to receive the bottom wall 135 of the container body 105.

Additionally, when the container lid 610 is threaded off of the container body 105, the end portion 145*a* of the neck 130 is removed from the internal annular groove 770 so that the end portion 145*a* of the neck 130 is sealingly disengaged from one or both of the external bulbous protrusion 760*b* of the internal collar 755 and the internal ridge 765 of the container lid 610. This sealing disengagement of the end portion 145*a* of the neck 130 from the one or both of the external bulbous protrusion 760*b* of the internal collar 755 and the internal ridge 765 of the container lid 610 allows gas pressure within the internal cavity 120 of container body 105 to be released. More particularly, gas pressure is permitted to flow: between the internal collar 755 of the container lid 610 and the inside of the end portion 145*a* of the neck 130 of the container body 105; between the internal ridge 765 of the container lid 610 and the outside of the end portion 145*a* of the neck 130 of the container body 105; through the gaps 705*a-d* (shown in FIGS. 7B, 7C-1, and 7C-2) formed along the container lid 610; and through the gaps 165*a-d* (shown in FIGS. 2C-1, 2C-2, and 2D) formed along the container body 105. The gas pressure eventually exits to atmosphere adjacent the end portion 695*b* of the side wall 685 of the container lid 610 and the end portion 145*b* of the neck 130 of the container body 105.

In several embodiments, a fluid, such as a beverage for human consumption, is disposed within the internal cavity 120 of the container body; in some embodiments, one or more of the above-described sealing engagements seal gas pressure within the internal cavity 120 of the container body 110 from atmosphere; in several embodiments, when the container lid is detached from the container body 110, as shown in FIG. 4D, a human drinks the fluid from the internal cavity 120.

Figure 9G:
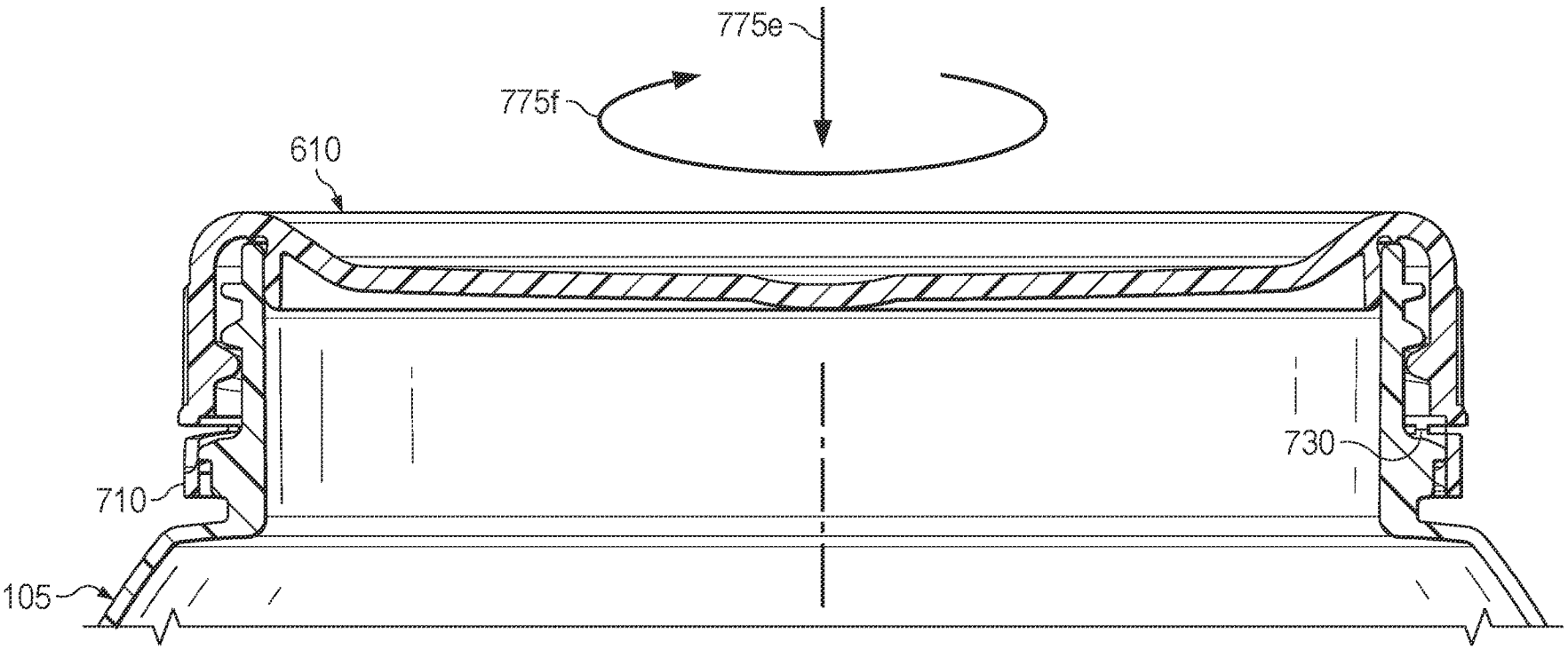
FIG. 9G is a cross-sectional view of the third container apparatus of FIG. 6 in the third operational state or configuration, according to one or more embodiments.

As indicated by arrows 775*e-f* in FIG. 9G, the container lid 610 can be subsequently re-attached to, and sealingly engaged with, the container body 105 in the same manner as that described above in connection with FIGS. 8A through 8C, except that the security band 710 is only connected to the container lid 610 via the tether 780 as the separable segments 730 are now broken and remain broken. Thus, upon reattachment, the security band 710 does not slide over and past the external collar 155, but instead remains axially trapped between the end portion 140*a* of the side wall 125 and the external collar 155 of the container body 105. As this is the only difference, the re-attachment (and sealing engagement) of the container lid 610 to the container body 105 will not be described in further detail.

In several embodiments, a fluid, such as a beverage for human consumption, is disposed within the internal cavity 120 of the container body; in some embodiments, one or more of the above-described sealing engagements seal gas pressure within the internal cavity 120 of the container body 110 from atmosphere; in several embodiments, when the container lid is detached from the container body 110, as shown in FIG. 4D, a human can drink the fluid from the internal cavity 120 via the mouth 150; in several embodiments, after drinking some of the fluid, the human reattaches the container lid 110 to the container body 105, as shown in FIG. 4E, so that the remaining (undrunk) fluid will not spill out of the internal cavity 120—in several embodiments, in the future the human again detaches the container lid 110 from the container body 105, and again drinks the fluid from the internal cavity 120 via the mouth 150.

Figure 10:
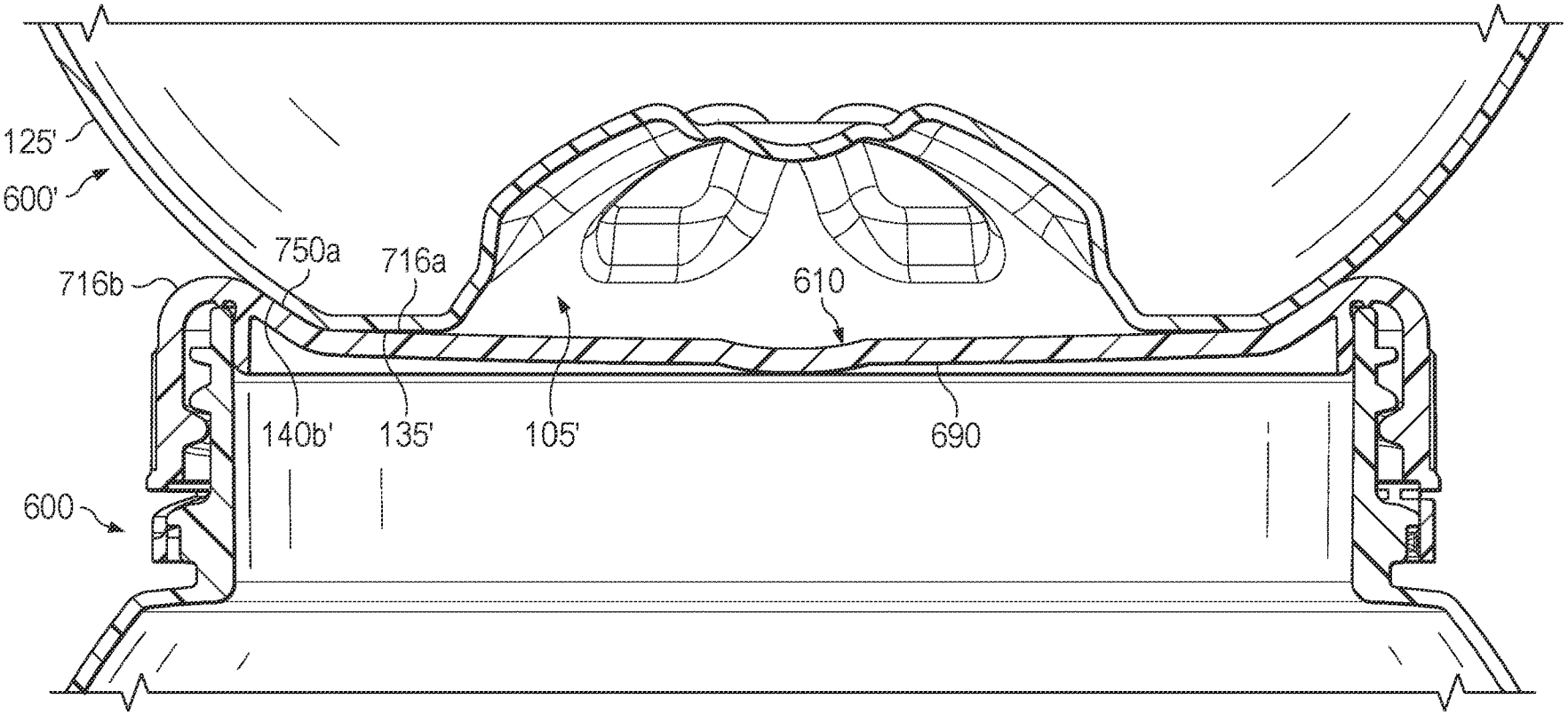
FIG. 10 is a cross-sectional view of the third container apparatus of FIG. 8A together with a fourth container apparatus, according to one or more embodiments.

Referring to FIG. 10, with continued reference to FIGS. 6 through 9G, in an embodiment, the container apparatus 600 is stackable with another container apparatus, which another container apparatus is substantially identical to the container apparatus 600, and, therefore, is given the same reference numeral, except with the suffix "'" added. In addition, or instead, the container apparatus 600' includes feature(s)/component(s) substantially identical to corresponding feature(s)/component(s) of the container apparatus 600', which substantially identical feature(s)/component(s) are given the same reference numerals, except with the suffix "'" added.

As shown in FIG. 10, when so stacked, a portion of the container body 105' of the container apparatus 600' matingly engages a portion of the container lid 610 of the container apparatus 600. More particularly, the bottom wall 135' of the container body 105' is matingly received by the central portion 716*a* of the top wall 690 of the container lid 610. Additionally, the end portion 140*b'* of the side wall 125' of the container body 105' is matingly received by the external surface 750*a* of the outer edge portion 716*b* of the top wall 690 of the container lid 610. For example, in those embodiment(s) in which the end portion 140*b'* of the side wall 125' of the container body 105' defines the radius of curvature R1', and the external surface 750*a* of the outer edge portion 716*b* of the top wall 690 of the container lid 610 defines the radius of curvature R3 (which is the same as the radius of curvature R1'), the end portion 140*b'* of the side wall 125' of the container body 105' matingly engages the external surface 750*a* of the outer edge portion 716*b* of the top wall 690 of the container lid 610. For another example, in those embodiment(s) in which the end portion 140*b'* of the side wall 125' of the container body 105' defines the frustoconical shape, and the external surface 750*a* of the outer edge portion 716*b* of the top wall 690 of the container lid 610 defines the frustoconical shape, the end portion 140*b'* of the side wall 125' of the container body 105' matingly engages the external surface 750*a* of the outer edge portion 716*b* of the top wall 690 of the container lid 610.

In several embodiments, one or more of the embodiments of the present application are provided in whole or in part as described and illustrated in the '332 Application, the entire disclosure of which has been incorporated herein by reference.

In several embodiments, one or more of the embodiments described and illustrated in the '332 Application are combined in whole or in part with one or more of the embodiments described above and/or one or more of the other embodiments described and illustrated in the '332 Application.

A first apparatus has been disclosed. The first apparatus generally includes: a container body defining an internal cavity, a first outer diameter, and a second outer diameter, the container body including: a first side wall surrounding the internal cavity, the first side wall defining the second outer diameter of the container body, which second outer diameter is a maximum outer diameter of the first side wall; and a neck connected to, and extending from, the first side wall, the neck defining the first outer diameter of the container body; and a container lid attached to, and sealingly engaged with, the neck of the container body; wherein the container lid is detachable from, and re-attachable to, the neck of the container body; wherein the first side wall of the container body is frustospherical or frustospheroidal; and wherein a ratio of the first outer diameter to the second outer diameter is greater than or equal to 1:2. In one or more embodiments, the container lid defines an internal region, the container lid including: a second side wall surrounding the internal region; and a top wall connected to the second side wall. In one or more embodiments, the container lid further includes an internal ridge extending inwardly and into the internal region, the internal ridge engaging an outside surface of the neck. In one or more embodiments, the container lid further includes an internal collar extending from the top wall and into the internal region, the internal collar engaging an inside surface of the neck. In one or more embodiments, the internal collar includes an external bulbous protrusion engaging the inside surface of the neck. In one or more embodiments, the container lid further includes an internal ridge extending inwardly and into the internal region, the internal ridge engaging an outside surface of the neck. In one or more embodiments, the container body defines a first three-dimensional profile at an end portion thereof opposite the neck; and the top wall of the container lid defines a second three-dimensional profile adapted to matingly receive the first three-dimensional profile of the container body. In one or more embodiments, at least a portion of the first three-dimensional profile of the container body defines a first radius of curvature; and at least a portion of the second three-dimensional profile of the container lid defines a second radius of curvature, which second radius of curvature is the same as the first radius of curvature.

A first method has also been disclosed. The first method generally includes: attaching a first container lid to a neck of a container body to sealingly engage the first container lid with the neck of the container body; wherein the first container lid is detachable from, and re-attachable to, the neck of the container body; wherein the container body defines an internal cavity, a first outer diameter, and a second outer diameter, the container body including: a first side wall surrounding the internal cavity, the first side wall defining the second outer diameter of the container body, which second outer diameter is a maximum outer diameter of the first side wall; and the neck, which is connected to, and extends from, the first side wall, the neck defining the first outer diameter of the container body; wherein the first side wall of the container body is frustospherical or frustospheroidal; and wherein a ratio of the first outer diameter to the second outer diameter is greater than or equal to 1:2. In one or more embodiments, the first container lid defines an internal region, the first container lid including: a second side wall surrounding the internal region; and a top wall connected to the second side wall. In one or more embodiments, sealingly engaging the first container lid against the neck of the container body includes engaging an internal ridge of the first container lid with an outside surface of the neck; and the internal ridge extends inwardly and into the internal region. In one or more embodiments, sealingly engaging the first container lid against the neck of the container body includes engaging an internal collar of the first container lid with an inside surface of the neck; and the internal collar extends from the top wall and into the internal region. In one or more embodiments, sealingly engaging the internal collar of the first container lid with the inside surface of the neck includes engaging an external bulbous protrusion of the internal collar with the inside surface of the neck. In one or more embodiments, sealingly engaging the first container lid against the neck of the container body further includes engaging an internal ridge of the first container lid with an outside surface of the neck; and the internal ridge extends inwardly and into the internal region. In one or more embodiments, the first method further includes: stacking the container body onto a second container lid so that a first three-dimensional profile of the second container lid matingly receives a second three-dimensional profile of the container body, which second three-dimensional profile is located at an end portion of the container body opposite the neck; wherein the second container lid is identical to the first container lid. In one or more embodiments, at least a portion of the second three-dimensional profile of the container body defines a first radius of curvature; and at least a portion of the first three-dimensional profile of the second container lid defines a second radius of curvature, which second radius of curvature is the same as the first radius of curvature.

A second apparatus has also been disclosed. The second apparatus generally includes: a container lid adapted to be attached to, and sealingly engaged with, a container body, the container lid defining an internal region and an inner diameter, and the container lid including: a first side wall surrounding the internal region, the first side wall defining the inner diameter of the container lid; a top wall connected to the first side wall; and an internal collar extending from the top wall and into the internal region, the internal collar including an external bulbous protrusion adapted to engage an inside surface of the container body; and the container body; wherein, after the container lid is attached to, and sealingly engaged with, the container body, the container lid is detachable from, and re-attachable to, the container body. In one or more embodiments, the container lid further includes an internal ridge extending inwardly and into the internal region, the internal ridge being adapted to engage an outside surface of the container body. In one or more embodiments, the container body defines an internal cavity and an outer diameter, the container body including: a second side wall surrounding the internal cavity, the second side wall defining the outer diameter of the container body, which outer diameter is a maximum outer diameter of the second side wall; and a neck connected to, and extending from, the second side wall; and the container lid is adapted to seal against the neck of the container body. In one or more embodiments, the second side wall of the container body is frustospherical or frustospheroidal. In one or more embodiments, a ratio of the inner diameter of the container lid to the outer diameter of the container body is greater than or equal to 1:2. In one or more embodiments, the container body defines a first three-dimensional profile at an end portion thereof opposite the neck; and the top wall of the container lid defines a second three-dimensional profile adapted to matingly receive the first three-dimensional profile of the container body. In one or more embodiments, at least a portion of the first three-dimensional profile of the container body defines a first radius of curvature; and at least a portion of the second three-dimensional profile of the container lid defines a second radius of curvature, which second radius of curvature is the same as the first radius of curvature.

A second method has also been disclosed. The second method generally includes: attaching a first container lid to a container body to sealingly engage the first container lid with the container body, the first container lid defining an internal region and an inner diameter, and the first container lid including: a first side wall surrounding the internal region, the first side wall defining the inner diameter of the first container lid; a top wall connected to the first side wall; and an internal collar extending from the top wall and into the internal region, the internal collar including an external bulbous protrusion; wherein the first container lid is detachable from, and re-attachable to, the container body; and wherein sealingly engaging the first container lid against the container body includes engaging the external bulbous protrusion with an inside surface of the container body. In one or more embodiments, sealingly engaging the first container lid against the container body further includes engaging an internal ridge of the first container lid with an outside surface of the neck; and the internal ridge extends inwardly and into the internal region. In one or more embodiments, sealingly engaging the first container lid against the container body includes sealingly engaging the first container lid against a neck of the container body; and the container body defines the internal cavity and an outer diameter, the container body including: a second side wall surrounding the internal cavity, the second side wall defining the outer diameter of the container body, which outer diameter is a maximum outer diameter of the second side wall; and the neck, which is connected to, and extends from, the second side wall. In one or more embodiments, the second side wall of the container body is frustospherical or frustospheroidal. In one or more embodiments, a ratio of the inner diameter of the first container lid to the outer diameter of the container body is greater than or equal to 1:2. In one or more embodiments, the second method further includes: stacking the container body onto a second container lid so that a first three-dimensional profile of the second container lid matingly receives a second three-dimensional profile of the container body, which second three-dimensional profile is located at an end portion of the container body opposite the neck; wherein the second container lid is identical to the first container lid. In one or more embodiments, at least a portion of the second three-dimensional profile of the container body defines a first radius of curvature; and at least a portion of the first three-dimensional profile of the second container lid defines a second radius of curvature, which second radius of curvature is the same as the first radius of curvature.

It is understood that variations may be made in the foregoing without departing from the scope of the disclosure.

In one or more embodiments, the elements and teachings of the various illustrative embodiments may be combined in whole or in part in some or all of the illustrative embodiments. In addition, one or more of the elements and teachings of the various illustrative embodiments may be omitted, at least in part, or combined, at least in part, with one or more of the other elements and teachings of the various illustrative embodiments.

Any spatial references such as, for example, "upper," "lower," "above," "below," "between," "bottom," "vertical," "horizontal," "angular," "upwards," "downwards," "side-to-side," "left-to-right," "left," "right," "right-to-left," "top-to-bottom," "bottom-to-top," "top," "bottom," "bottom-up," "top-down," etc., are for the purpose of illustration only and do not limit the specific orientation or location of the structure described above.

In one or more embodiments, while different steps, processes, and procedures are described as appearing as distinct acts, one or more of the steps, one or more of the processes, or one or more of the procedures may also be performed in different orders, simultaneously or sequentially. In one or more embodiments, the steps, processes or procedures may be merged into one or more steps, processes or procedures. In one or more embodiments, one or more of the operational steps in each embodiment may be omitted. Moreover, in some instances, some features of the present disclosure may be employed without a corresponding use of the other features. Moreover, one or more of the embodiments disclosed above and in the '332 Application, or variations thereof, may be combined in whole or in part with any one or more of the other embodiments described above and in the '332 Application, or variations thereof.

Although one or more embodiments have been disclosed in detail above and in the '332 Application, the embodiments disclosed are exemplary only and are not limiting, and those skilled in the art will readily appreciate that many other modifications, changes, and substitutions are possible in the embodiments without materially departing from the novel teachings and advantages of the present disclosure. Accordingly, all such modifications, changes, and substitutions are intended to be included within the scope of this disclosure as defined in the following claims. In the claims, means-plus-function clauses are intended to cover the structures described herein as performing the recited function and not only structural equivalents, but also equivalent structures. Moreover, it is the express intention of the applicant not to invoke 35 U.S.C. § 112(f) for any limitations of any of the claims herein, except for those in which the claim expressly uses the word "means" together with an associated function.

What is claimed is:

1. An apparatus, comprising:

a container body defining an internal cavity, a first outer diameter, and a second outer diameter, the container body comprising:

a first side wall surrounding the internal cavity, the first side wall defining the first outer diameter of the container body, which first outer diameter is a maximum outer diameter of the first side wall;

a neck connected to the first side wall and axially above the first side wall, at least a portion of the neck defining a mouth via which the internal cavity of the container body is accessible, the at least a portion of the neck defining the mouth further defining the second outer diameter of the container body;

external threads extending around the at least a portion of the neck defining the mouth and further defining the second outer diameter of the container body; and a bottom portion connected to the first side wall;

wherein the bottom portion of the container body defines a base extending within a plane, the base defining an outline extending circumferentially within the plane in which the base of the bottom portion extends;

wherein the base defines an outer diameter that is less than the first outer diameter of the container body and thus is less than the maximum outer diameter of the first side wall; and wherein the container body is made out of plastic; and a container lid attached to the neck of the container body, the container lid comprising:

a second side wall;

a top wall connected to the second side wall;

wherein the container lid is made out of plastic;

wherein the second side wall is cylindrical;

wherein the second side wall at least partially defines an internal region of the container lid;

wherein the container lid further comprises internal threads;

wherein the internal threads of the container lid are engaged with the external threads of the container body so that the container lid is threaded onto the neck of the container body and thus the container lid is attached to the container body by the threaded engagement between the internal threads of the container lid and the external threads of the container body;

wherein the top wall comprises a central portion and an outer edge portion;

wherein the outer edge portion comprises a radially-inwardly-facing external surface circumferentially extending around the central portion;

wherein at least the radially-inwardly-facing external surface and the central portion, in combination, define an external region of the container lid, the external region being axially opposite the internal region;

wherein the container lid is detachable from the neck of the container body by threading off the internal threads of the container lid from the external threads of the container body via rotation of the container lid, in a first circumferential direction and relative to the container body;

wherein the container lid is re-attachable to the neck of the container body by re-engaging the internal threads of the container lid with the external threads of the container body via rotation of the container lid, in a second circumferential direction and relative to the container body;

wherein the second circumferential direction, in which the container lid is rotated relative to the container body to re-attach the container lid to the neck of the container body, is opposite the first circumferential direction, in which the container lid is rotated relative to the container body to detach the container lid from the neck of the container body;

wherein, when the container lid is detached from the neck of the container body, the bottom portion of the container body is adapted to be received by the external region of the container lid, which external region is defined by at least the combination of the radially-inwardly-facing external surface and the central portion of the container lid, so that:

the radially-inwardly-facing external surface of the container lid extends circumferentially around at least a portion of the container body; and the container body is adjacent or proximate the radially-inwardly-facing external surface of the container lid;

wherein at least a portion of the first side wall of the container body is curved, the curved portion of the first side wall defining a radius of curvature in a plane that is perpendicular to the plane in which the base of the bottom portion extends;

wherein the curved portion defines the first outer diameter of the container body and thus the maximum diameter of the first side wall of the container body;

wherein the second outer diameter defined by the at least a portion of the neck of the container body is less than the first outer diameter defined by the curved portion of the container body;

wherein at least another portion of the first side wall defines another outer diameter that is less than the first outer diameter of the container body and thus is less than the maximum outer diameter of the first side wall of the container body;

wherein the another outer diameter defined by the at least another portion of the first side wall is greater than the second outer diameter defined by the at least a portion of the neck of the container body;

wherein the second outer diameter defined by the at least a portion of the neck of the container body is less than each of a plurality of outer diameters defined by the first side wall of the container body;

wherein each of the outer diameters in the plurality of outer diameters is defined in a respective plane that is spaced in a parallel relation from the plane in which the base of the bottom portion of the container body extends, the plurality of outer diameters including each of:

the first outer diameter defined by the curved portion of the first side wall of the container body and thus the maximum diameter of the first side wall of the container body;

the another outer diameter defined by the at least another portion of the first side wall of the container body; and yet another outer diameter defined by at least yet another portion of the first side wall of the container body;

wherein the first outer diameter defined by the curved portion of the first side wall of the container body, and thus the maximum outer diameter of the first side wall of the container body, extends in a plane axially above the plane in which the base of the bottom portion of the container body extends;

wherein the another outer diameter, which is defined by the at least another portion of the first side wall of the container body, extends in another plane axially above the plane in which the base of the bottom portion of the container body extends;

wherein the another plane, in which the another outer diameter defined by the at least another portion of the first side wall of the container body extends, is axially above the plane in which the first outer diameter defined by the curved portion of the first side wall of the container body, and thus the maximum diameter of the first side wall of the container body, extends;

wherein the yet another outer diameter, which is defined by the at least yet another portion of the first side wall of the container body, extends in yet another plane axially above the plane in which the base of the bottom portion of the container body extends;

wherein the yet another plane, in which the yet another outer diameter defined by the at least yet another portion of the first side wall of the container body extends, is either:

(i) axially below the plane in which the first outer diameter defined by the curved portion of the first side wall of the container body, and thus the maximum diameter of the first side wall of the container body, extends, and thus also axially below the another plane in which the another outer diameter, which is defined by the at least another portion of the first side wall of the container body, extends;

or (ii) axially above the another plane in which the another outer diameter, which is defined by the at least another portion of the first side wall of the container body, extends, and thus also axially above the plane in which the first outer diameter defined by the curved portion of the first side wall of the container body, and thus the maximum diameter of the first side wall of the container body, extends;

wherein the bottom portion of the container body, including the base, at least partially defines a first three-dimensional profile;

wherein the radially-inwardly-facing external surface and the central portion of the container lid at least partially define a second three-dimensional profile;

and wherein, when the container lid is detached from the neck of the container body, the bottom portion of the container body is adapted to be received by the external region of the container lid so that also:

the second three-dimensional profile of the container lid matingly receives the first three-dimensional profile of the container body.

2. The apparatus of claim 1, wherein the yet another plane is (i) axially below the plane in which the first outer diameter defined by the curved portion of the first side wall of the container body, and thus the maximum diameter of the first side wall of the container body, extends, and thus also axially below the another plane in which the another outer diameter, which is defined by the at least another portion of the first side wall of the container body, extends.

3. The apparatus of claim 1, wherein the yet another plane is (ii) axially above the another plane in which the another outer diameter, which is defined by the at least another portion of the first side wall of the container body, extends, and thus also axially above the plane in which the first outer diameter defined by the curved portion of the first side wall of the container body, and thus the maximum diameter of the first side wall of the container body, extends.

4. The apparatus of claim 3, wherein the plurality of outer diameters further includes:

still yet another outer diameter defined by at least still yet another portion of the first side wall of the container body;

wherein the still yet another outer diameter extends in still yet another plane axially above the plane in which the base of the bottom portion of the container body extends; and wherein the still yet another plane, in which the still yet another outer diameter defined by the at least still yet another portion of the first side wall of the container body extends, is axially below the plane in which the first outer diameter defined by the curved portion of the first side wall of the container body, and thus the maximum diameter of the first side wall of the container body, extends, and thus also axially below the another plane in which the another outer diameter, which is defined by the at least another portion of the first side wall of the container body, extends.

5. The apparatus of claim 4, wherein the outer diameter defined by the base of the container body is less than each of the outer diameters in the plurality of outer diameters defined by the first side wall of the container body.

6. The apparatus of claim 1, wherein the outer diameter defined by the base of the container body is less than each of the outer diameters in the plurality of outer diameters defined by the first side wall of the container body.

7. The apparatus of claim 1, wherein, when the container lid is detached from the neck of the container body, the bottom portion of the container body is adapted to be received by the external region of the container lid so that also:

the container body contacts at least a portion of the radially-inwardly-facing external surface of the container lid.

8. The apparatus of claim 1, wherein, when the container lid is detached from the neck of the container body, the bottom portion of the container body is adapted to be received by the external region of the container lid so that also:

the base of the bottom portion of the container body contacts the central portion of the top wall of the container lid; and the first side wall of the container body contacts the radially-inwardly-facing external surface of the top wall of the container lid.

9. The apparatus of claim 1, further comprising a beverage for human consumption, wherein the beverage for human consumption is disposed within the internal cavity of the container body.

10. An apparatus, comprising:

a container body defining an internal cavity, a first outer diameter, and a second outer diameter, the container body comprising:

a first side wall surrounding the internal cavity, the first side wall defining the first outer diameter of the container body, which first outer diameter is a maximum outer diameter of the first side wall;

a neck connected to the first side wall and axially above the first side wall, at least a portion of the neck defining a mouth via which the internal cavity of the container body is accessible, the at least a portion of the neck defining the mouth further defining the second outer diameter of the container body;

external threads extending around the at least a portion of the neck defining the mouth and further defining the second outer diameter of the container body; and a bottom portion connected to the first side wall;

wherein the bottom portion of the container body defines a base extending within a plane, the base defining an outline extending circumferentially within the plane in which the base of the bottom portion extends;

wherein the base defines an outer diameter that is less than the first outer diameter of the container body and thus is less than the maximum outer diameter of the first side wall; and and a container lid attached to the neck of the container body, the container lid comprising:

a second side wall;

a top wall connected to the second side wall;

wherein the second side wall at least partially defines an internal region of the container lid;

wherein the container lid further comprises internal threads;

wherein the internal threads of the container lid are engaged with the external threads of the container body so that the container lid is threaded onto the neck of the container body and thus the container lid is attached to the container body by the threaded engagement between the internal threads of the container lid and the external threads of the container body;

wherein the top wall comprises a central portion and an outer edge portion;

wherein the outer edge portion comprises a radially-inwardly-facing external surface circumferentially extending around the central portion;

wherein at least the radially-inwardly-facing external surface and the central portion, in combination, define an external region of the container lid, the external region being axially opposite the internal region;

wherein the container lid is detachable from the neck of the container body by threading off the internal threads of the container lid from the external threads of the container body via rotation of the container lid, in a first circumferential direction and relative to the container body;

wherein the container lid is re-attachable to the neck of the container body by re-engaging the internal threads of the container lid with the external threads of the container body via rotation of the container lid, in a second circumferential direction and relative to the container body;

wherein the second circumferential direction, in which the container lid is rotated relative to the container body to re-attach the container lid to the neck of the container body, is opposite the first circumferential direction, in which the container lid is rotated relative to the container body to detach the container lid from the neck of the container body;

wherein, when the container lid is detached from the neck of the container body, the bottom portion of the container body is adapted to be received by the external region of the container lid, which external region is defined by at least the combination of the radially-inwardly-facing external surface and the central portion of the container lid, so that:

the radially-inwardly-facing external surface of the container lid extends circumferentially around at least a portion of the container body; and the container body is adjacent or proximate the radially-inwardly-facing external surface of the container lid;

wherein at least a portion of the first side wall of the container body is curved, the curved portion of the first side wall defining a radius of curvature in a plane that is perpendicular to the plane in which the base of the bottom portion extends;

wherein the curved portion defines the first outer diameter of the container body and thus the maximum diameter of the first side wall of the container body;

wherein the second outer diameter defined by the at least a portion of the neck of the container body is less than the first outer diameter defined by the curved portion of the container body;

wherein at least another portion of the first side wall defines another outer diameter that is less than the first outer diameter of the container body and thus is less than the maximum outer diameter of the first side wall of the container body;

wherein the another outer diameter defined by the at least another portion of the first side wall is greater than the second outer diameter defined by the at least a portion of the neck of the container body;

wherein the second outer diameter defined by the at least a portion of the neck of the container body is less than each of a plurality of outer diameters defined by the first side wall of the container body;

wherein each of the outer diameters in the plurality of outer diameters is defined in a respective plane that is spaced in a parallel relation from the plane in which the base of the bottom portion of the container body extends, the plurality of outer diameters including each of:

the first outer diameter defined by the curved portion of the first side wall of the container body and thus the maximum diameter of the first side wall of the container body;

the another outer diameter defined by the at least another portion of the first side wall of the container body; and yet another outer diameter defined by at least yet another portion of the first side wall of the container body;

wherein the first outer diameter defined by the curved portion of the first side wall of the container body, and thus the maximum outer diameter of the first side wall of the container body, extends in a plane axially above the plane in which the base of the bottom portion of the container body extends;

wherein the another outer diameter, which is defined by the at least another portion of the first side wall of the container body, extends in another plane axially above the plane in which the base of the bottom portion of the container body extends;

wherein the another plane, in which the another outer diameter defined by the at least another portion of the first side wall of the container body extends, is axially above the plane in which the first outer diameter defined by the curved portion of the first side wall of the container body, and thus the maximum diameter of the first side wall of the container body, extends;

wherein the yet another outer diameter, which is defined by the at least yet another portion of the first side wall of the container body, extends in yet another plane axially above the plane in which the base of the bottom portion of the container body extends;

wherein the yet another plane, in which the yet another outer diameter defined by the at least yet another portion of the first side wall of the container body extends, is either:

(i) axially below the plane in which the first outer diameter defined by the curved portion of the first side wall of the container body, and thus the maximum diameter of the first side wall of the container body, extends, and thus also axially below the another plane in which the another outer diameter, which is defined by the at least another portion of the first side wall of the container body, extends;

or (ii) axially above the another plane in which the another outer diameter, which is defined by the at least another portion of the first side wall of the container body, extends, and thus also axially above the plane in which the first outer diameter defined by the curved portion of the first side wall of the container body, and thus the maximum diameter of the first side wall of the container body, extends;

wherein the bottom portion of the container body, including the base, at least partially defines a first three-dimensional profile;

wherein the radially-inwardly-facing external surface and the central portion of the container lid at least partially define a second three-dimensional profile;

and wherein, when the container lid is detached from the neck of the container body, the bottom portion of the container body is adapted to be received by the external region of the container lid so that also:

the second three-dimensional profile of the container lid matingly receives the first three-dimensional profile of the container body.

11. The apparatus of claim 10, wherein the container body is made out of plastic.

12. The apparatus of claim 11, wherein the container lid is made out of plastic.

13. The apparatus of claim 10, wherein the container lid is made out of plastic.

14. The apparatus of claim 10, wherein the second side wall of the container lid is cylindrical.

15. The apparatus of claim 10, wherein the yet another plane is (i) axially below the plane in which the first outer diameter defined by the curved portion of the first side wall of the container body, and thus the maximum diameter of the first side wall of the container body, extends, and thus also axially below the another plane in which the another outer diameter, which is defined by the at least another portion of the first side wall of the container body, extends.

16. The apparatus of claim 10, wherein the yet another plane is (ii) axially above the another plane in which the another outer diameter, which is defined by the at least another portion of the first side wall of the container body, extends, and thus also axially above the plane in which the first outer diameter defined by the curved portion of the first side wall of the container body, and thus the maximum diameter of the first side wall of the container body, extends.

17. The apparatus of claim 16, wherein the plurality of outer diameters further includes:

still yet another outer diameter defined by at least still yet another portion of the first side wall of the container body;

wherein the still yet another outer diameter extends in still yet another plane axially above the plane in which the base of the bottom portion of the container body extends; and wherein the still yet another plane, in which the still yet another outer diameter defined by the at least still yet another portion of the first side wall of the container body extends, is axially below the plane in which the first outer diameter defined by the curved portion of the first side wall of the container body, and thus the maximum diameter of the first side wall of the container body, extends, and thus also axially below the another plane in which the another outer diameter, which is defined by the at least another portion of the first side wall of the container body, extends.

18. The apparatus of claim 17, wherein the outer diameter defined by the base of the container body is less than each of the outer diameters in the plurality of outer diameters defined by the first side wall of the container body.

19. The apparatus of claim 10, wherein the outer diameter defined by the base of the container body is less than each of the outer diameters in the plurality of outer diameters defined by the first side wall of the container body.

20. The apparatus of claim 10, wherein, when the container lid is detached from the neck of the container body, the bottom portion of the container body is adapted to be received by the external region of the container lid so that also:

the container body contacts at least a portion of the radially-inwardly-facing external surface of the container lid.

21. The apparatus of claim 10, wherein, when the container lid is detached from the neck of the container body, the bottom portion of the container body is adapted to be received by the external region of the container lid so that also:

the base of the bottom portion of the container body contacts the central portion of the top wall of the container lid; and the first side wall of the container body contacts the radially-inwardly-facing external surface of the top wall of the container lid.

22. The apparatus of claim 10, further comprising a beverage for human consumption, wherein the beverage for human consumption is disposed within the internal cavity of the container body.

* * * * *